US006183932B1

(12) United States Patent
Asami et al.

(10) Patent No.: US 6,183,932 B1
(45) Date of Patent: Feb. 6, 2001

(54) SILVER HALIDE PHOTOSENSITIVE MATERIAL FOR COLOR PHOTOGRAPHY AND COLOR IMAGE FORMING METHOD

(75) Inventors: Masahiro Asami; Hideaki Naruse, both of Kanagawa (JP)

(73) Assignee: Fuji Photo Film Co., Ltd., Minami-Ashigara (JP)

( * ) Notice: Under 35 U.S.C. 154(b), the term of this patent shall be extended for 0 days.

(21) Appl. No.: 09/236,578

(22) Filed: Jan. 26, 1999

(30) Foreign Application Priority Data

Jan. 27, 1998 (JP) ..... 10-029273

(51) Int. Cl.[7] ..... G03C 8/40; G03C 8/36; G03C 8/10; G03C 1/035

(52) U.S. Cl. ..... 430/203; 430/217; 430/218; 430/226; 430/351; 430/380; 430/543; 430/553; 430/959

(58) Field of Search ..... 430/203, 217, 430/218, 226, 380, 351, 959, 558, 543, 553

(56) References Cited

U.S. PATENT DOCUMENTS

| | | | | |
|---|---|---|---|---|
| 4,358,525 | * | 11/1982 | Mooberry et al. | 430/959 |
| 4,554,243 | * | 11/1985 | Ono et al. | 430/959 |
| 4,789,623 | * | 12/1988 | Sato et al. | 430/203 |
| 5,830,625 | * | 11/1998 | Hirano | 430/959 |
| 5,834,155 | * | 11/1998 | Uehara | 430/203 |
| 5,976,756 | * | 11/1999 | Nakamura et al. | 430/203 |

FOREIGN PATENT DOCUMENTS

| | | |
|---|---|---|
| 62-32454 | 2/1987 | (JP) . |
| 9-152705 | 6/1997 | (JP) . |

* cited by examiner

*Primary Examiner*—Richard L. Schilling
(74) *Attorney, Agent, or Firm*—Burns, Doane, Swecker & Mathis, LLP

(57) ABSTRACT

There is provided a silver halide photosensitive material for color photography which can stably form an image having high quality through a process that is simple, quick and causes less environmental damage. A photosensitive material comprising a substrate carrying thereon a photographic constituent layer containing at least one photographic photosensitive layer containing a photosensitive silver halide, wherein said photosensitive material comprises a compound represented by one of the following general formulae [I], [II] and [III] and further comprises at least one silver halide emulsion in which the variation coefficient of particle size of contained silver halide particle is 20% or less and the variation coefficient of a halogen composition between particles is 25% or less. In the formulae, Z represents a carbamoyl group, an acyl group, or the like, and Q represents an atom group forming an unsaturated ring with C. $R_1$ to $R_4$ represent a hydrogen atom or a substituent. A represents a hydroxyl group or a substituted amino group. X represents a connecting group such as —CO—, —SO—, —$SO_2$—, or the like. $Y_2$ represents a bivalent connecting group. $Z_2$ represents a group that is a nucleophilic and can attack X when the present compound is oxidized.

General formula [I]

General formula [II]

General formula [III]

24 Claims, No Drawings

SILVER HALIDE PHOTOSENSITIVE MATERIAL FOR COLOR PHOTOGRAPHY AND COLOR IMAGE FORMING METHOD

BACKGROUND OF THE INVENTION

1. Field of the Invention

The present invention relates to a novel silver halide photosensitive material for color photography providing an ornamental image, and a method for forming a color image using the same.

2. Description of the Related Art

Photosensitive materials for photography utilizing a silver halide are increasingly being developed recently, and at present, a color image having high image quality is easily available. For example, ordinary, in a method called color photography, photography is conducted using a color negative film, and image information recorded on a color negative film after development is printed optically on color photographic paper, to thereby obtain a color print. Recently, this process has developed to a high degree, and color laboratories that are large centralized apparatuses for producing large amounts of color prints with high efficiency and so-called miniature laboratories that are compact and simple printer processors placed in shops are now widely spread. As a result, any one can enjoy color photography easily.

Thus, while a system utilizing a silver halide (hereinafter, referred to as "silver halide system") have been developed, means by which digital image information is output via a personal computer and the like have also been developed to a remarkably degree. Though the silver halide system has reached a stage wherein simple and quick treatment is possible, it requires a specialized processing device using special processing solution such as developing solution, bleach-fix solution and the like and skilled operators. Meanwhile, an inkjet method, electrophotography method and sublimation type transfer method are spreading in offices and families as a system for obtaining a color image easily. Further, image quality obtained in these systems is recently excellent, and selling competition is intense to attract users with so-called "photographic quality". However, it can not be admitted yet that the outputted image in these systems has leached the same level as that of the silver halide system, though it has improved to a certain extent. Therefore, it is strongly required that the high quality image that is characteristic of the silver halide system be obtained with the same ease as in other systems.

Simply stated, the constant on the silver halide system represented by color photography is that processing with a specialized color laboratory is necessary. When use in offices and general households is considered, the ordinary silver halide system has a defect in that it has a complicated and time-consuming processing method. The reason for this is that, for example, when a color print is made using color photographic paper, a specialized color printer for printing color negative information on photographic paper while maintaining a suitable color balance is required. Further, to operation the color printer, skilled operators are usually necessary. Next, to treat the exposed color photographic paper, a color processor is required for conducting color development, bleach-fixing, and washing or stabilization processing under strictly controlled conditions, and for this treatment, a time of about 4 minutes is usually required. Moreover, the environmental load that has been recently observed cannot be ignored. Namely, processing solutions thereof contain substances whose discharge should be restricted such as color developing agents, iron chelate compounds which are bleaching agents, and the like, and developing equipment often require exclusive facilities.

Therefore, if these processes can be effected simply and quickly, it is expected that the high quality characteristic of the silver halide system can be utilized for output of color images in various fields. Namely, simple and quick processing is an important subject for further developing the silver halide system.

In view of this background, there have been suggested many improved technologies for making a system that uses neither a color developing agent nor a bleaching agent, which are used in current color image forming systems.

For example, in IS & T's 48th Annual Conference Proceedings, p. 180, a system is disclosed which removes developed silver and an unreacted silver halide by allowing a pigment formed in a developing reaction to migrate into a printing layer and then releasing the layer, making a bleach-fix bath, which is essential for conventional color photography processing unnecessary. However, in this suggested technology, a developing process in a processing bath containing a color developing agent is still necessary, and it can not be said that the environmental problem has been solved.

As a system requiring no processing solution containing a color developing agent, a pictrography system is provided by Fuji Photo Film Co., Ltd. In this system, a development reaction is caused by supplying a small amount of water to a photosensitive member containing a base precursor, laminating this with an image receiving member, and heating the laminate. This method is advantageous in that the above-described treatment bath is not used.

Pigment image formation by pictrography is roughly divided into a method in which a compound which releases a pigment in a developing reaction of exposed silver halide particles is used and the pigment is released corresponding to development, and a method in which a pigment is released reverse-corresponding to development by consuming a compound in which an oxide of a contained developing agent generated accompanying development of a silver halide causes a pigment releasing reaction. In both of the methods, a so-called pre-formed dye compound containing a pigment part previously in the molecule is taken into a photosensitive member. Consequently, in both methods, a colored material shall be contained in a photosensitive emulsion layer, and imparting high sensitivity is difficult. Further, compounds used in these color developing methods require complicated molecular structures for precisely controlling the above-described reactions, and are disadvantageous in terms of cost.

Since further development of a quick and simple image forming system can be expected by solving these problems of the pictrography method, development of novel technologies has been desired. As an example of such novel system, Japanese Patent Application Laid-Open (JP-A) No. 9-152705 discloses a technology for forming an ornamental image using a developing agent which can thermally develop a silver halide and a compound that releases a pigment through a coupling reaction with an oxide thereof.

Investigation has been conducted on a system for simply obtaining a color print having high quality in a short period of time based on the above-described technologies, and as a result, it has been found that image concentration varies according to variation in the amount of water used in thermal development, and that strict control of the amount of water is necessary for stably forming an image having high quality.

In such an image forming method, a small amount of water is used for the purpose of progressing a thermal developing reaction quickly. In detail, the developing reaction and the pigment releasing reaction are caused by heating in the presence of water between a photosensitive material and a pigment fixing material which fixes a generated pigment, the amount of water being in an amount corresponding to 1/10 to 1-fold of that required for the maximum swelling of a layer composed of these materials. In this procedure, variation in reaction amount of development or pigment release, which accompanies variation in the amount of water is not preferable for stably forming an image having high quality. Namely, it has become clear that when the amount of water varies, there is the fear that an image having constant quality can not be obtained repeatedly or that image concentration varies in one image and the like. Further, these problems regarding variation in image concentration, increasingly worsen when the temperature is raised to shorten processing time.

SUMMARY OF THE INVENTION

As apparent from the above descriptions, the first object of the present invention is to provide a silver salt photosensitive material that can stably form an image having high quality and form a color image successfully through a process that is simple, quick and causes less environmental damage. More particularly, the object is to provide a color photosensitive material that is advantageous in terms of cost and can improve sensitivity when using as a dye-forming compound an uncolored compound before a development reaction, and to provide a method using the material to form a color image that can form an ornamental image that is of a high quality and is stable.

The above-described object of the present invention has been accomplished through the following means 1) to 12).

1) A silver halide photosensitive material for color photography comprising a substrate carrying thereon a photographic constituent layer including at least one photographic photosensitive layer containing a photosensitive silver halide, wherein the photosensitive material comprises at least one silver halide emulsion in which the variation coefficient of the particle size of contained silver halide particles is 20% or less and the variation coefficient of a halogen composition between particles is 25% or less, and further comprises a compound represented by any one of the following general formulae [I], [II] and [III], and comprises a color coupler which is capable of forming a diffusible dye by a coupling reaction with the compound represented by any one of the following formulae [I], [II] and [III]:

General formula [I]

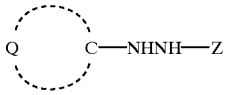

wherein, Z represents a carbamoyl group, acyl group, alkoxycarbonyl group, aryloxycarbonyl group, sulfonyl group or sulfamoyl group, and Q represents an atom group forming an unsaturated ring with C; and General formula [II]

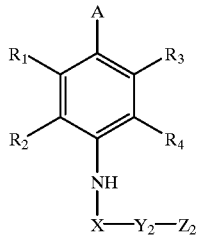

General formula [III]

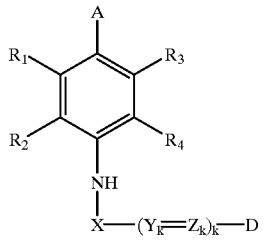

wherein, in the general formula [II], $R_1$ to $R_4$ each independently represents a hydrogen atom or a substituent, A represents a hydroxyl group or a substituted amino group, X represents a connecting group selected from —CO—, —SO—, —$SO_2$—, —(Q)PO— (Q represents a monovalent group connected to a phosphorus atom), $Y_2$ represents a bivalent connecting group, $Z_2$ represents a group that is a nucleophilic and can attack X when the present compound is oxidized, and two or more atoms optionally selected from $R_1$ and $R_2$, $R_3$ and $R_4$, and substituents thereof may be each independently connected to form a ring, and in the general formula [III], $R_1$ to $R_4$, A and X are as defined for the general formula [II], $Y_k$ and $Z_k$ represent a nitrogen atom or a group of —$CR_5$= (herein, $R_5$ represents a hydrogen atom or substituent), k represents an integer of 0 or more, D represents a proton dissociating group or a group which can be a cation, and two or more atoms optionally selected from $R_1$ and $R_2$, $R_3$ and $R_4$, and $Y_k$, $Z_k$ and D and substituents thereof may be each independently connected to form a ring.

2) A silver halide photosensitive material for color photography according to the above-described 1), wherein the variation coefficient of the particle size of the particles comprising the silver halide emulsion is 15% or less.

3) A silver halide photosensitive material for color photography according to the above-described 1), wherein the variation coefficient of the particle size of the particles comprising the silver halide emulsion is 12% or less.

4) A silver halide photosensitive material for color photography according to the above-described 1), wherein the variation coefficient of the halogen composition between the particles comprising the silver halide emulsion is 20% or less.

5) A silver halide photosensitive material for color photography according to the above-described 1), wherein the variation coefficient of the halogen composition between the particles comprising the silver halide emulsion is 15% or less.

6) A silver halide photosensitive material for color photography according to the above-described 1), 2), 3), 4) or 5), wherein the silver halide emulsion comprises silver chloride bromide particles of normal crystal.

7) A silver halide photosensitive material for color photography according to the above-described 1), 2), 3), 4) or 5), wherein the silver halide emulsion comprises silver iodide bromide particles of normal crystal.

8) A silver halide photosensitive material for color photography according to the above-described 1), 2), 3), 4) or 5), wherein the silver halide emulsion comprises silver chloride iodide bromide particles of normal crystal.

9) A silver halide photosensitive material for color photography according to the above-described 1), 2), 3), 4), 5), 6), 7) or 8), wherein said photosensitive material contains in the photographic constituent layer as a yellow coupler capable of forming a diffusible dye, at least one compound represented by the following general formula [IV]:

General formula [IV]

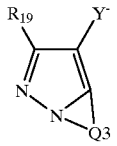

wherein, $R_{19}$ represents a hydrogen atom or a substituent, $Q_3$ represents a group of nonmetallic atoms required for forming a 5-membered azole ring containing 2 to 4 nitrogen atoms, and the azole ring may have a substituent (including a fused ring)

10) A silver halide photosensitive material for color photography according to the above-described 1), 2), 3), 4), 5), 6), 7), 8) or 9), wherein the photosensitive material contains in the photographic constituent layer as a magenta coupler capable of forming a diffusible dye, at least one compound represented by the general formula [IV] or the following general formula [V]:

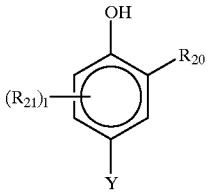

wherein, $R_{20}$ represents a hydrogen atom or a group selected from $—CONR_{22}R_{23}$, $—SO_2NR_{22}R_{23}$, $—NHCOR_{22}$, $—NHCONR_{22}R_{23}$, and $—NHSO_2NR_{22}R_{23}$, $R_{22}$ and $R_{23}$ each independently represents a hydrogen atom or a substituent, $R_{21}$ represents a substituent, l represents an integer selected from 0 to 2, and when l is 2, $R_{21}$ may be different.

11) A silver halide photosensitive material for color photography according to the above-described 1), 2), 3), 4), 5), 6), 7), 8), 9) or 10), wherein the photosensitive material contains in the photographic constituent layer as a cyan coupler capable of forming a diffusible dye, at least one compound represented by the general formula [V], the following general formula [VI] or the following general formula [VII]:

General formula [VI]

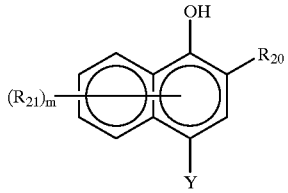

wherein, $R_{20}$ represents a hydrogen atom or a group selected from $—CONR_{22}R_{23}$, $—SO_2NR_{22}R_{23}$, $—NHCOR_{22}$, $—NHCONR_{22}R_{23}$, and $—NHSO_2NR_{22}R_{23}$, $R_{22}$ and $R_{23}$ each independently represents a hydrogen atom or a substituent, $R_{21}$ represents a substituent, m represents an integer selected from 0 to 4, and when m is 2 or more, $R_{21}$ may be different;

General formula [VII]

[VII-1]

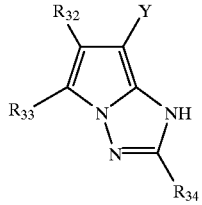

[VII-2]

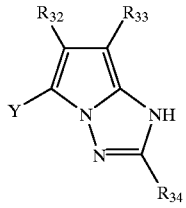

[VII-3]

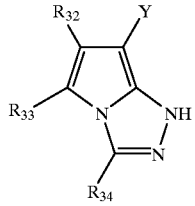

[VII-4]

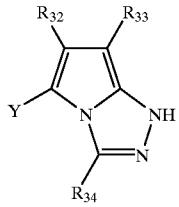

the general formula [VII] being representable by the general formula [VII-1], the general formula [VII-2], the general formula [VII-3] and the general formula [VII-4], in which, $R_{32}$, $R_{33}$ and $R_{34}$ each independently represents a hydrogen atom or a substituent.

12) A color image forming method, wherein a silver halide photography photosensitive material according to 9), 10) or 11) is exposed imagewise, an image receiving material separately prepared comprising a substrate carrying thereon an image receiving layer is laminated with the photosensitive material with water present between the photosensitive material and the image receiving material in an amount corresponding to 1/10 to 1-fold of that required for the maximum swelling of the entire coated film of the photosensitive material and the image receiving material, and the laminate is heated at a temperature between 60° C. to 100° C. for 5 or more to 60 or less seconds to form an image on the image receiving material.

DESCRIPTION OF THE PREFERRED EMBODIMENTS

First, compounds represented by the general formula [I] used in the present invention will be described in detail.

In the general formula [I], Z represents a carbamoyl group, acyl group, alkoxycarbonyl group, aryloxycarbonyl group, sulfonyl group or sulfamoyl group. Among these, the carbamoyl group is preferred, and a carbamoyl group having a hydrogen atom on a nitrogen atom is particularly preferable.

As the carbamoyl group, a carbamoyl group having 1 to 50 carbon atoms is preferable and one having 6 to 40 carbon atoms is more preferable. Specific examples thereof include a carbamoyl group, methylcarbamoyl group, ethylcarbamoyl group, n-propylcarbamoyl group, sec-butylcarbamoyl group, n-octylcarbamoyl group, cyclohexylcarbamoyl group, tert-butylcarbmoyl group, dodecylcarbamoyl group, 3-dodecyloxypropylcarbamoyl group, octadecylcarbamoyl group, 3-(2,4-tert-pentylphenoxy)propylcarbamoyl group, 2-hexyldecylcarbamoyl group, phenylcarbamoyl group, 4-dodecyloxyphenylcarbamoyl group, 2-chloro-5-dodecyloxycarbonylphenylcarbamoyl group, naphthylcarbamoyl group, 3-pyridylcarbamoyl group, 3-5-bis-octyloxycarbonylphenylcarbamoyl group 3,5-bis-tetradecyloxyphenylcarbamoyl group, benzyloxycarbamoyl group, 2,5-dioxo-1-pyrrolidinylcarbamoyl group and the like.

As the acyl group, an acyl group having 1 to 50 carbon atoms is preferable, and one having 6 to 40 carbon atoms is more preferable. Specific examples thereof include a formyl group, acetyl group, 2-methylpropanoyl group, cyclohexylcarbonyl group, n-octanoyl group, 2-hexyldecanoyl group, dodecanoyl group, chloroacetyl group, trifluoroacetyl group, benzoyl group, 4-dodecyloxybenzoyl group, 2-hydroxymethylbenzoyl group, 3-(N-hydroxyl-N-methylaminocarbonyl)propanyl group and the like.

As the alkoxycarbonyl group and aryloxycarbonyl group, an alkoxycarbonyl group and an aryloxycarbonyl group having 2 to 50 carbon atoms are respectively preferable and an alkoxycarbonyl group and an aryloxycarbonyl group having 6 to 40 carbon atoms are more preferable, respectively. Specific examples thereof include a methoxycarbonyl group, ethoxycarbonyl group, isobutyloxycarbonyl group, cyclohexyloxycarbonyl group, dodecyloxycarbonyl group, benzyloxycarbonyl group, phenoxycarbonyl group, 4-octyloxyphenoxycarbonyl group, 2-hydroxymethylphenoxycarbonyl group, 4-dodecyoxyphenoxycarbonyl group and the like.

As the sulfonyl group, a sulfonyl group having 1 to 50 carbon atom is preferable, and one having 6 to 40 carbon atoms is more preferable. Specific examples thereof include a methylsulfonyl group, butylsulfonyl group, octylsulfonyl group, 2-hexyldodecysulfonyl group, 3-dodecyloxypropylsulfonyl group, 2-n-octyloxy-5-t-octylphenylsulfonyl group, 4-dodecyoxyphenylsulfonyl group and the like.

As the sulfamoyl group, a sulfamoyl group having 1 to 50 carbon atoms is preferable, and one having 6 to 40 carbon atoms is more preferable. Specific examples thereof include a sulfamoyl group, ethylsulfamoyl group, 2-ethylhexylsulfamoyl group, decylsulfamoyl group, hexadecylsulfamoyl group, 3-(2-ethylhexyloxy)propylsulfamoyl group, (2-chloro-5-dodecyloxycarbonylphenyl)sulfamoyl group 2-tetradecyloxyphenylsulfamoyl group and the like.

Q represents an atom group that forms an unsaturated ring with C, and as the formed unsaturated ring, a 3 to 8-membered ring is preferable, and a 5 to 6-membered ring is more preferable. Examples thereof include a benzene ring, pyridine ring, pyradine ring, pyrimidine ring, pyridazine ring, 1,2,4-triazine ring, 1,3,5-triazine ring, pyrrole ring, imidazole ring, pyrazole ring, 1,2,3-triazole ring, 1,2,4-triazole ring, tetrazole ring, 1,3,4-thiadiazole ring, 1,2,4-thiadiazole ring, 1,2,5-thiadiazole ring, 1,3,4-oxadiazole ring, 1,2,4-oxadiazole ring, 1,2,5-oxadiazole, thiazole ring, oxazole ring, isothiazole ring, isooxazole ring thiophene ring and the like. Further, condensed rings obtained by condensation of these rings are preferable used.

Further the rings may have a substituent, and examples of the substituent include a straight or branched, linear or cyclic alkyl group having 1 to 50 carbon atoms (such as trifluoromethyl, methyl, ethyl, propyl, heptafluoropropyl, isopropyl, butyl, t-butyl, t-pentyl, cyclopentyl, cyclohexyl, octyl, 2-ethylhexyl, dodecyl and the like), a straight or branched, linear or cyclic alkenyl group having 2 to 50 carbon atoms (such as vinyl, 1-methylvinyl, cyclohexene-1-yl and the like), an alkynyl group having 2 to 50 carbon atoms in total (such as ethynyl, 1-propynyl and the like), an aryl group having 6 to 50 carbon atoms (such as phenyl, naphthyl, anthryl and the like), an acyloxy group having 1 to 50 carbon atoms (such as acetoxy, tetradecanoyloxy, benzoyloxy and the like), an alkoxycarbonyloxy group having 2 to 50 carbon atoms (such as methoxycarbonyloxy, 2-methoxyethoxycarbonyloxy groups and the like), an aryloxycarbonyloxy group having 7 to 50 carbon atoms (such as a phenoxycarbonyloxy group and the like), a carbamoyloxy group having 1 to 50 carbon atoms (such as N,N-dimethylcarbamoyloxy and the like), a carbonamide group having 1 to 50 carbon atoms (such as formamide, N-methylacetoamide, acetoamide, N-methylformamide, benzamide and the like), a sulfonamide group having 1 to 50 carbon atoms (such as methanesulfonamide, dodecanesulfonamide, benzenesulfonamide, p-toluenesulfonamide and the like), a carbamoyl group having 1 to 50 carbon atoms (such as N-methylcarbamoyl, N,N-diethylcarbamoyl, N-mesylcarbamoyl and the like), a sulfamoyl group having 0 to 50 carbon atoms (such as N-butylsulfamoyl, N,N-diethylsulfamoyl, N-methyl-N-(4-methoxyphenyl) sulfamoyl and the like), analkoxy group having 1 to 50 carbon atoms (such as methoxy, propoxy, isopropoxy, octyloxy, t-octyloxy, dodecyoxy, 2-(2,4-di-t-pentylphenoxy)ethoxy and the like), an aryloxy group having 6 to 50 carbon atoms (such as phenoxy, 4-methoxyphenoxy, naphthoxy and the like), an aryloxycarbony group having 7 to 50 carbon atoms (such as phenoxycarbonyl, naphthoxycarbonyl and the like), an alkoxycarbonyl group having 2 to 50 carbon atoms (such as methoxycarbonyl, t-butoxycarbonyl and the like), a N-acylsulfamoyl group having 1 to 50 carbon atoms (such as N-tetradecanoylsulfamoyl, N-benzoylsulfamoyl and the like), a N-sulfamoylcarbamoyl group having 1 to 50 carbon atoms (such as N-methanesulfonylcarbamoyl group and the like), an alkylsulfonyl group having 1 to 50 carbon atoms (such as methanesulfonyl, octylsulfonyl, 2-methoxyethylsulfonyl, 2-hexyldecylsulfonyl and the like), an arylsuofonyl group having 6 to 50 carbon atoms (such as benzensulfonyl, p-toluenesulfonyl, 4-phenylsulfonyl, phenylsulfonyl and the like), an alkoxycarbonylamino group having 2 to 50 carbon atoms (such as ethoxycarbonylamino and the like), an aryloxycarbonylamino group having 7 to 50 carbon atoms (such as phenoxycarbonylamino, naphthoxycarbonylamino and the like), an amino group having 0 to 50 carbon atoms (such as amino, methylamino, diethylamino, diisopropylamino, anilino, morpholino and the like), anammonio group having 3 to 50 carbon atoms (such as trimethylammonio, dimethylbenzylammonio groups and the like), a cyano group, a nitro group, a carboxyl group, a hydroxy group, a sulfo group, a mercapto group, an alkylsulfinyl group having 1 to 50 carbon atoms (such as methanesulfinyl, octanesulfinyl and the like) an arylsulfinyl group having 6 to 50 carbon atoms (such as benzenesulfinyl, 4-chlorophenylsulfinyl, p-toluenesulfinyl and the like), an alkylthio group having 1 to 50 carbon atoms (such as methylthio, octylthio, cyclohexylthio and the like), arylthio group having 6 to 50 carbon atoms (such as phenylthio, naphthylthio and the like), a ureido group having 1 to 50 carbon atoms (such as 3-methylureido, 3,3-dimethylureido, 1,3-diphenylureido and the like), a heterocyclic group having 2 to 50 carbon atoms (such as 3 to 12-membered monocyclic or condensed rings containing at least one hetero atom such as nitrogen, oxygen, sulfur and the like, for example, 2-furyl, 2-pyranyl, 2-pyridyl, 2-thienyl, 2-imidazoyl, morpholino, 2-quinolyl, 2-benzoimidazolyl, 2-benzothiazolyl, 2-benzooxazolyl and the like), an acyl group having 1 to 50 carbon atoms (such as acetyl, benzoyl, trifluoroacetyl and the like), a sulfamoylamino group having 0 to 50 carbon atoms (such as N-butylsulfamoylamino, N-phenylsulfamoylamino and the like), a silyl group having 3 to 50 carbon atoms (such as trimethylsilyl, dimethyl-t-butylsilyl, triphenylsilyl and the like), and a halogen atom (such as fluorine, chlorine, bromine atoms and the like). The substituent may have a substituent, and examples thereof include those listed above.

The number of carbon atoms of the substituent is preferably 50 or less, more preferably 42 or less and further preferably 30 or less. For sufficient diffusion ability of a dye, which is produced by a reaction of a color developing agent and a coupler in the present invention, the total number of carbon atoms of a unsaturated ring formed from Q and C and a substituent thereof is preferably from 1 or more to 30 or less, more preferably from 1 or more to 24 or less, and most preferably from 1 or more to 18 or less.

When the ring formed from Q and C is composed solely of carbon atoms (such as benzene, naphthalene, anthracene rings and the like), the total value of Hammett substituent constants σ (in the case of 1,2, 1,4, - - - position thereof relative to C, σp value is adopted, and in the case of 1,3, 1,5, - - - position thereof relative to C, σm value is adopted) of all the substituents is preferably 0.8 or more, more preferably 1.2 or more and most preferably 1.5 or more.

The details of Hammett substituent constants σp and σm are described in, for example, N. Inamoto, "Hammett Rule—Structure and Reactivity—" (Maruzen), "New Experimental Chemical Seminar 14·Synthesis and Reaction of Organic Compound V" p. 2605 (published by Japan Chemical Institute, Maruzen), T. Nakaya, "Theoretical Organic Chemistry Commentary" p. 217 (Tokyo Chemical Coterie), Chemical Review, 91, pp. 165 to 195 (1991) and the like.

Specific examples of the color developing agent represented by the general formula [I] will be described below; however, they do not limit the scope of the present invention.

(1)

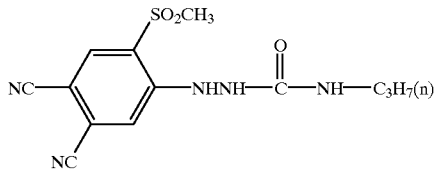

(2)

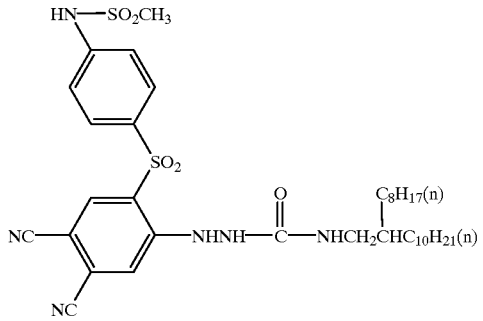

-continued
(3)
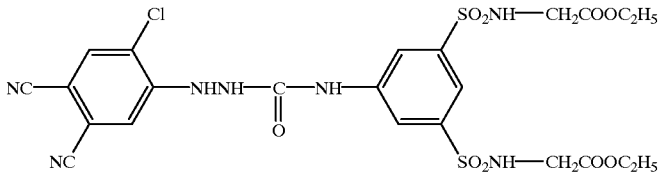
(4)
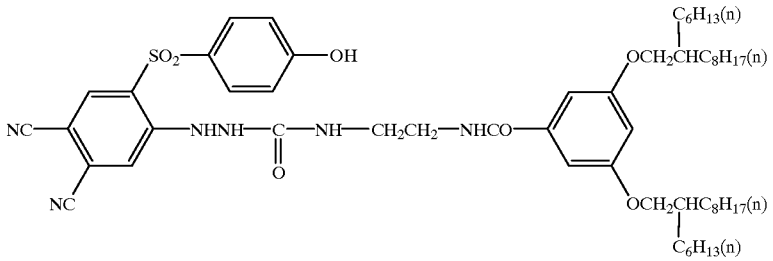
(5)
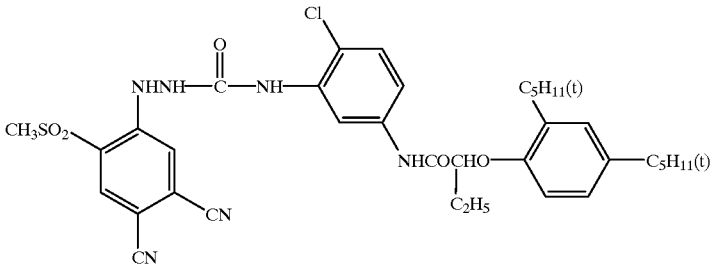
(6)
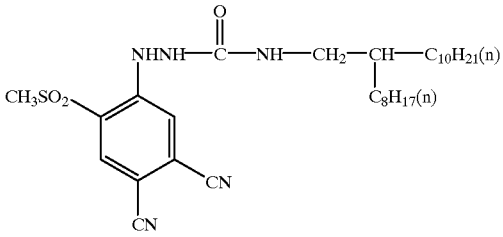
(7)
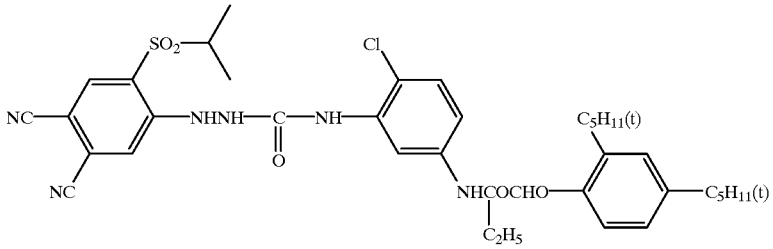
(8)
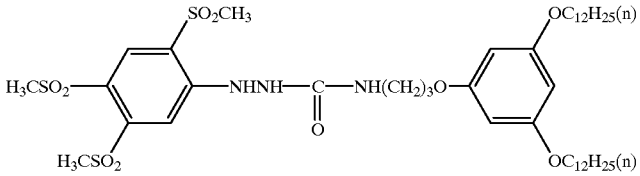

-continued
(9)
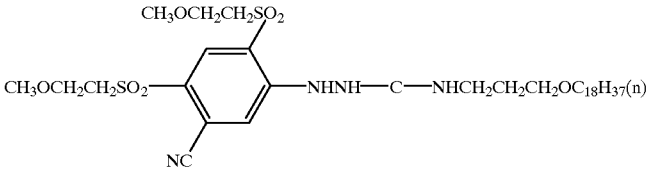
(10)
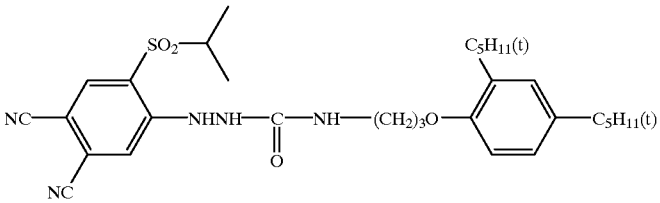
(11)
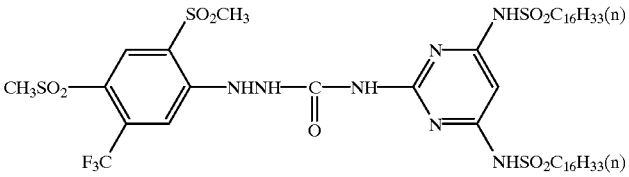
(12)
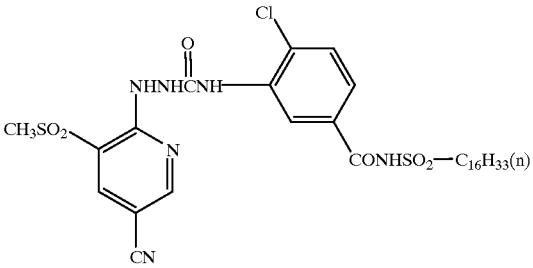
(13)
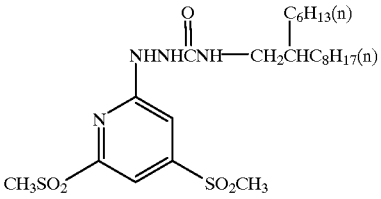
(14)
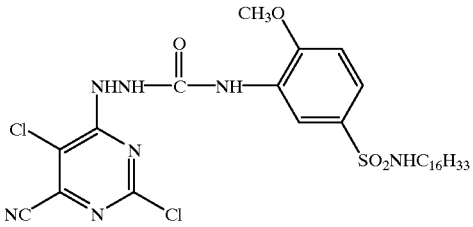
(15)
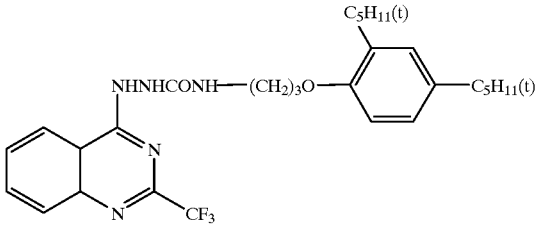

-continued
(16)
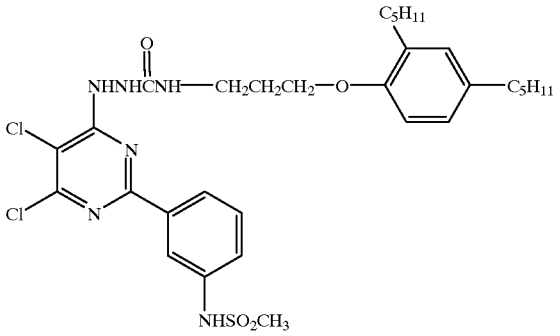
(17)
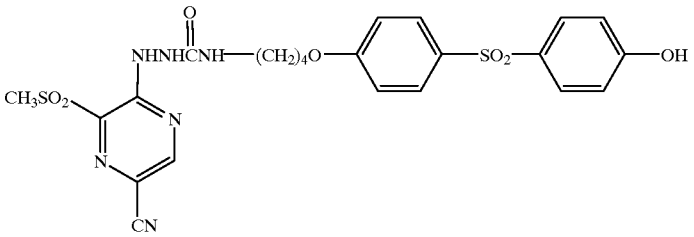
(18)
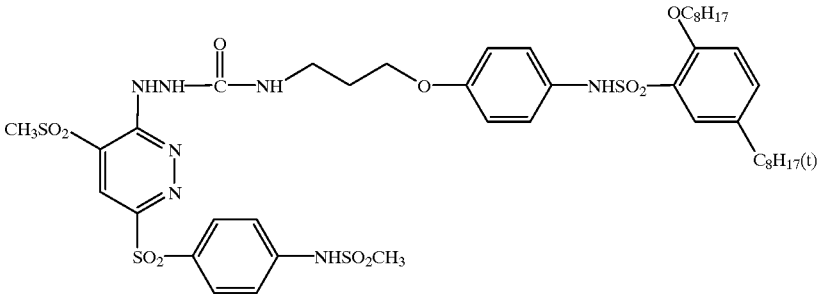
(19)
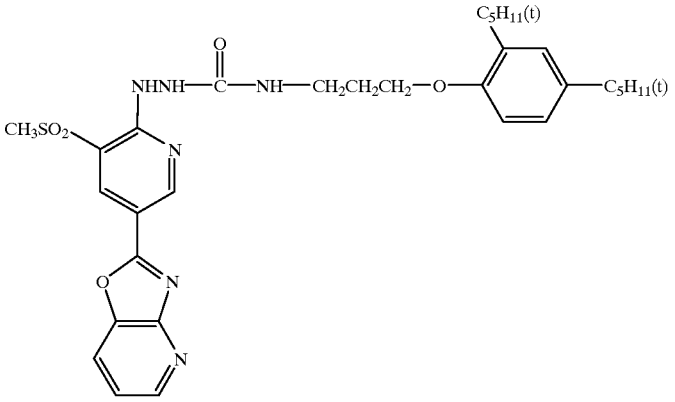
(20)
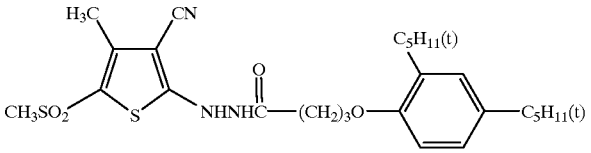

-continued
(21)
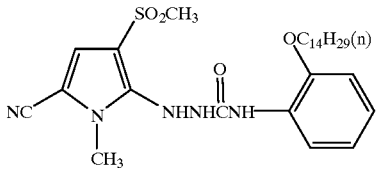
(22)
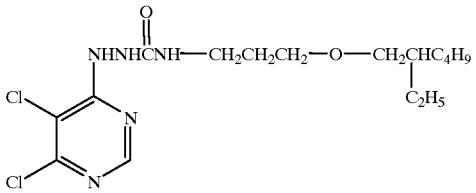
(23)
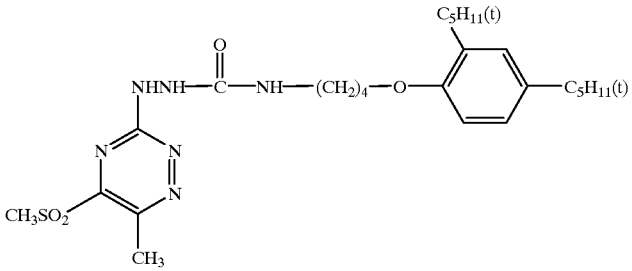
(24)
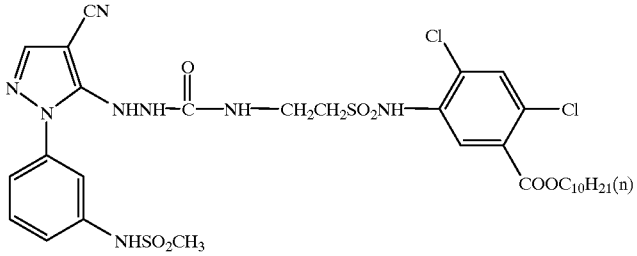
(25)
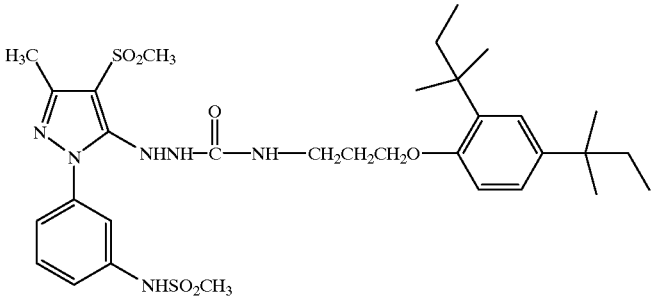
(26)
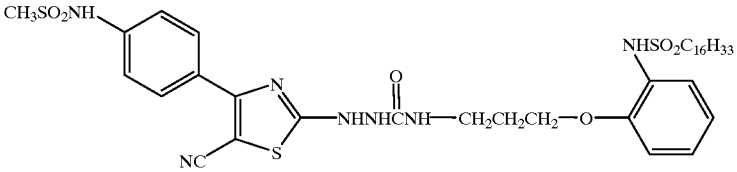
(27)
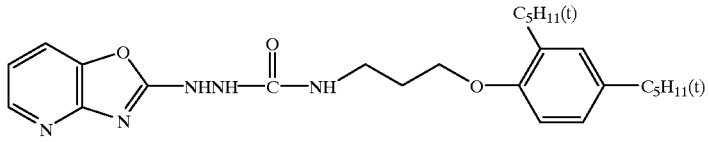

-continued (28)

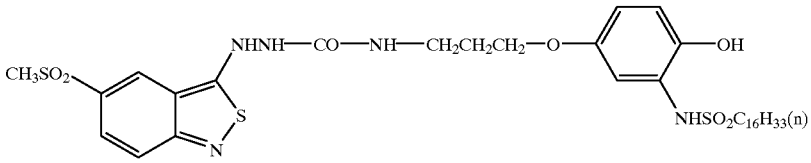

(29)

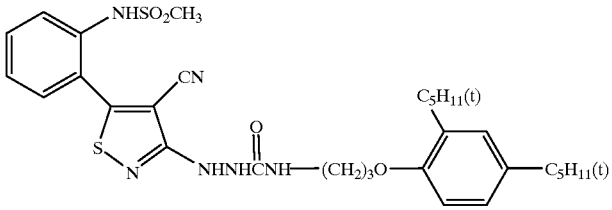

(30)

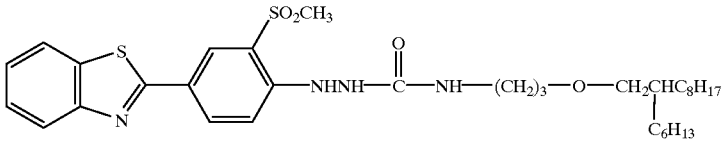

Next, general synthesis methods for the compound of the present invention are described below. A typical example of a synthesis method of a compound used in the present invention is described below. Other compounds can be synthesized in the same manner as described below.

Synthesis Example 1. Synthesis of exemplary compound (1)

The compound (1) was synthesized according to the following synthesis route.

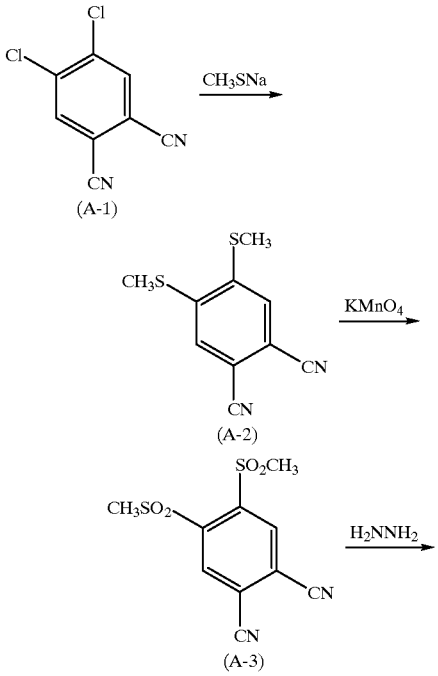

-continued

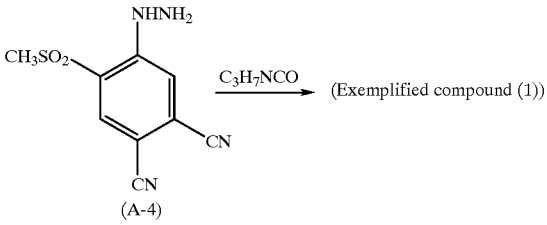

Synthesis of compound (A-2)

53.1 g of 1,2-dichloro-4,5-dicyanobenzene (A-1) (CAS Registry No. 139152-08-2) was dissolved in 1.1 liters of N,N-dimethylformamide. To this was added dropwise 268 g of an aqueous methylmercaptane sodium salt solution (15%) at room temperature over a period of 1 hour, and the resulting mixture was stirred for 1 hour at 60° C. The reaction solution was cooled to room temperature, water was added to this solution, and the resulting mixture was stirred for 30 minutes. The produced white solid was collected by filtration, washed with water, and dried. Yield: 46.5 g, 78.1%

Synthesis of compound (A-3)

41.1 g of compound (A-2) was suspended in 400 ml of acetic acid, and to this was added dropwise a solution obtained by dissolving 89.3 g of potassium permanganate in 400 ml of water over a period of 1 hour while water-cooling. The mixture was allowed to stand overnight at room temperature, then, 2 liters of water and 2 liters of ethyl acetate were added, and the resulted mixture was subjected to Celite filtration. The filtrate was separated, and the resulted organic layer was washed with water, an aqueous sodium hydrosulfite solution, a sodium hydrogencarbonate solution and a sodium chloride solution, before drying over anhydrous magnesium sulfate. After filtration, the solvent was distilled off, and to the residue was added a mixed solvent composed of ethyl acetate and hexane for crystallization, to obtain 29.4 g of compound (A-3) as a white solid. Yield 55.0%

Synthesis of compound (A-4)

29.4 g of compound (A-3) was dissolved in 200 ml of dimethylsulfoxide (DMSO). To this was added dropwise 8.7 g of hydrazine monohydrate over a period of 15 minutes while water-cooling, and the mixture was stirred for 10 minutes while water-cooling. Water was poured into the reaction solution, and the produced yellow solid was collected by filtration, washed with water, and dried. Yield: 17.4 g, 70.9%

Synthesis of exemplary compound (1)

11.8 g of compound (A-4) was dissolved in 50 ml of tetrahydrofuran. To this was added dropwise 4.7 g of propyl isocyanate over a period of 30 minutes at room temperature, and the mixture was stirred for 1 hour. To the reaction mixture was added water, and extraction was carried out with ethyl acetate. The organic layer was washed with a hydrochloric acid solution and a sodium chloride solution before drying over anhydrous magnesium sulfate, and after filtration, the solvent was removed. The residue was crystallized from a mixed solvent of ethyl acetate-hexane (1:10) to obtain 14.5 g of exemplary compound (1) as a white solid. Yield: 90.2%

Synthesis Example 2. Synthesis of exemplary compound (5)

Exemplary compound (5) was synthesized according to the following synthesis route.

Synthesis of compound (A-6)

44.5 g of compound (A-5) (CAS Registry No. 51461-11-1) was dissolved in 500 ml of ethyl acetate, and to the result was added 500 ml of water into which 25 g of sodium hydrogencarbonate had been dissolved. To this solution was added dropwise 16.4 g of phenyl chlorocarbonate over a period of 30 minutes at room temperature, and the result was stirred for 1 hour. The reaction mixture was separated, and the organic layer was washed with a sodium chloride solution before drying over anhydrous magnesium sulfate, and after filtration, the solvent was distilled off to obtain 54.0 g of compound (A-6) as a pale yellow oil. Yield: 95.6%

Synthesis of exemplary compound (5)

5.0 g of compound (A-4), 13.0 g of compound (A-9) and 0.50 g of DMAP (N,N-dimethylaminopyridine) were dissolved in 100 ml of acetonitrile, and the result was stirred for 3 hours at 60° C. Water was poured into the reaction mixture, and extraction was carried out with ethyl acetate. The resulted organic layer was washed with a sodium hydrogencarbonate solution, ahydrochloric acid solution and a sodium chloride solution before drying over anhydrous magnesium sulfate. After filtration, the solvent was distilled off. The residue was purified by silica gel column chromatography (eluant: ethyl acetate/hexane=½), and crystallized from hexane to obtain 7.5 g of exemplary compound (5) as a white solid.

Synthesis Example 3. Synthesis of exemplary compound (15)

Exemplary compound (15) was synthesized according to the following synthesis route.

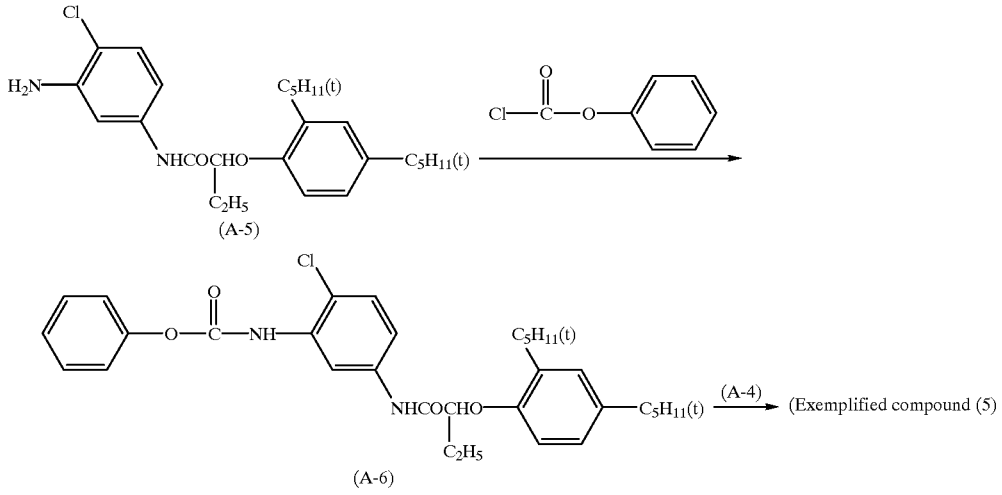

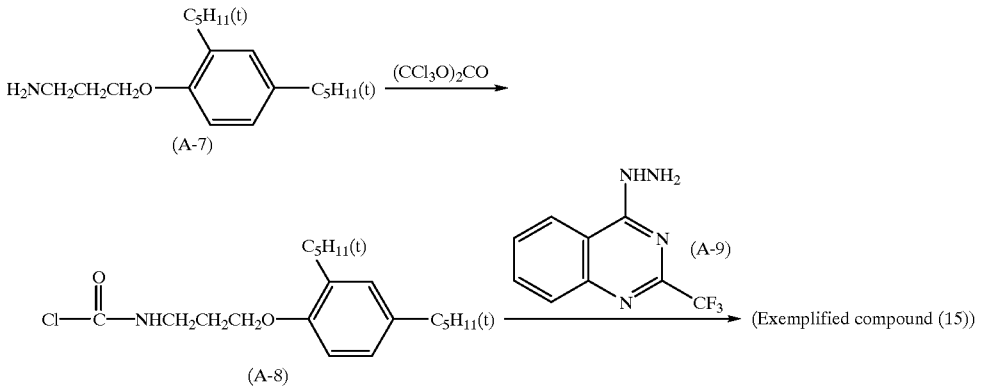

Synthesis of exemplary compound (15)

4.6 g of triphosgene was dissolved in 100 ml of THF. To this was added dropwise 13.6 g of compound (A-7) (CAS Registry No. 61053-26-7) over a period of 10 minutes at room temperature, and to this was further added dropwise 18.7 ml of triethylamine over a period of 10 minutes at room temperature. The mixture was reacted for 30 minutes to obtain a solution of compound (A-8) To this reaction solution was added 9.0 g of compound (A-9) in portions over a period of 10 minutes at room temperature. The mixture was further stirred for 1 hour. Thereafter, water was poured, and extraction was carried out with ethyl acetate. The organic layer was washed with a sodium hydrogencarbonate solution, a hydrochloric acid solution and a sodium chloride solution before drying over anhydrous magnesium sulfate, and after filtration, the solvent was distilled off. The residue was purified by silica gel column chromatography, and crystallized from a ethyl acetate/hexane=1/10 mixed solution to obtain exemplary compound (15) as a white solid.

The compound (A-9) was synthesized according to the method described in EP No. 545491A1.

As a method for adding the developing agent represented by the general formula (I), it is possible to add the agent by: dissolving the agent in an organic solvent with a high boiling point (for example, phosphates such as an alkyl phosphate, aryl phosphate and the like, phthalates such as an alkyl phthlate, aryl phthalate and the like), dispersing the solution in water (or an aqueous solution of a water-soluble binder such as gelatin and the like) in the presence of a surfactant using an emulsifying and dispersing method known in the field, and then carrying out addition. In this procedure, an organic solvent having a low boiling point (such as, ethyl acetate, methyl ethyl ketone and the like) can be used as an auxiliary solvent. Further, compounds such as a coupler, color development accelerating agent and the like can be simultaneously mixed and dissolved, and the result can be dispersed and added. Moreover, the developing agent can also be added by a solid dispersion method described in JP-A No. 63-271,339.

It is preferable that the compound represented by the general formula [I] is an oil-soluble compound if the compound is added by the emulsifying dispersion method among the above-described methods. For this purpose, it is required that at least one group having ballasting property is contained. The ballasting group herein represents an oil-soluble group containing an oil-soluble partial structure having 8 to 80, preferably 10 to 40 carbon atoms. Particularly, when the present compound is used for a diffusion transfer type color photosensitive material, it is preferable that a ballasting group is contained in a portion represented by z.

The color developing agent of the present invention is added in an amount from 0.01 to 100-fold, preferably from 1 to 10-fold, and further preferably from 0.2 to 5-fold based on a coupler.

Next, the compounds represented by the general formula [II] and the general formula [III] used in the present invention will be described in detail below.

The compounds represented by the general formula [II] and the general formula [III] are compounds classified as aminophenol derivatives and phenylenediamine derivatives, and have natures wherein storability before used is excellent, and have characteristics wherein they react with the equivalent of two couplers efficiently.

Examples of the substituent represented by $R_1$ to $R_4$ include a halogen atom (such as chloro and bromo groups), an alkyl group (such as methyl, ethyl, isopropyl, n-butyl and t-butyl groups), an aryl group (such as phenyl, tolyl group and xylyl groups), a carbonamide group (such as acetylamino, propionylamino, butyloylamino and benzoylamino groups), a sulfonamide group (such as methanesulfonylamino, ethanesulfonylamino, benzenesulfonylamino and toluenesulfonylamino groups), an alkoxy group (such as methoxy and ethoxy groups), an aryloxy group (such as a phenoxy group), an alkylthio group (such as methylthio, ethylthio and butylthio groups), an arylthio group (such as methylcarbamoyl, dimethylcarbamoyl, ethylcarbamoyl, diethylcarbamoyl, dibutylcarbamoyl, piperidinocarbamoyl, morpholinocarbamoyl, phenylcarbamoyl, methylphenylcarbamoyl, ethylphenylcarbamoyl and benzylphenylcarbamoyl groups), a sulfamoyl group (such as methylsulfamoyl, dimethylsulfamoyl, ethylsulfamoyl, diethylsulfamoyl, dibutylsulfamoyl, piperidinosulfamoyl, morpholinosulfamoyl, phenylsulfamoyl, methylphenylsulfamoyl, ethylphenylsulfamoyl and benzylphenylsulfamoyl groups), a cyano group, a sulfonyl group (such as methanesulfonyl, ethanesulfonyl, phenylsulfonyl, 4-chlorophneylsulfonyl and p-toluenesulfonyl groups), an alkoxycarbonyl group (such as methoxycarbonyl, ethoxycarbonyl and butoxylcarbonyl groups), an aryloxycarbonyl group (such as a phenoxycarbonyl group), an acyl group (such as acetyl, propionyl, butyloyl, benzoyl and alkylbenzoyl groups), a ureido group (such as methylaminocarbonamide and diethylaminocarbonamide groups), a urethane group (such as methoxycarbonamide and buxotycarbonamide groups), an acyloxy group (such as acetyloxy, propionyloxy and butyloyloxy groups) and the like. Among $R_1$ to $R_4$, $R_2$ and/or $R_4$ preferably represents a hydrogen atom. When A represents a hydroxy group, the total of Hammett's constants $\sigma p$ of $R_1$ to $R_4$ is preferably 0 or more, and when A represents a substituted amino group, the total of Hammett's constants σp of $R_1$ to $R_4$ is preferably 0 or less.

Two or more atoms selected from $R_1$ and $R_2$, $R_3$ and $R_4$, or substituents may be each independently connected to form a ring.

A represents a hydroxy group or a substituted amino group. As the substituted amino group, for example, a dimethylamino group, a diethylamino group and an ethylhydroxyethylamino group are listed. A hydroxyl group is preferable as A in the general formula [III].

X represents a connecting group selected from —CO—, —SO—, —$SO_2$— and —(Q)PO—. Herein, Q is a substituent substituted for a phosphorus atom, and specifically, it may be a group represented by the following formula (1) in addition to the above-described substituents described for $R_1$ to $R_4$. $R_1$ to $R_4$ and A in the formula (1) are as defined in the same way as that of the general formula [I].

In the case of the general formula [II], it may be —$Y_2$—$Z_2$, and in the case of the general formula [III], it may be —$(Y_k{=}Z_k)_k$-D.

$Y_2$ represents a 2-equivalent connecting group. This connecting group represents a group that connects $Z_2$ to such a position that convenient intramolecular nucleophilic attack to X of a non-covalent electron pair and the like on $Z_2$ via Y is possible. In practice, it is preferable that atoms are connected so that a 5 to 6-membered ring can be formed containing 5 to 6 atoms in a transition condition when the nucleophilic group effects a nucleophilic attack upon X. Preferable examples of $Y_2$ include a 1,2- or 1,3-alkylene group, 1,2-cycloalkylene group, Z-vinylene group, 1,2-arylene group, 1,8-naphthalene group and the like.

$Z_2$ represents a nucleophilic group. A nucleophilic group means a group which can attack nucleophilically a carbon atom, sulfur atom or a phosphorus atom represented by X after an oxide generated by oxidation of the present compound by a silver halide is coupled with a coupler and can form a dye by this attack. In such nucleophilic groups, those exhibiting nucleophilicity are atoms having a non-covalent electron pair (for example, a nitrogen atom, phosphorus atom, oxygen atom, sulfur atom, selenium atom and the like) an anions (for example, a nitrogen anion, oxygen anion, carbon anion, sulfur anion) as usual in the field of organic chemistry. As examples of the substituent having nucleophilicity contained in Z, there are listed groups having partial structures or dissociated materials thereof exemplified below.

Formula (1)

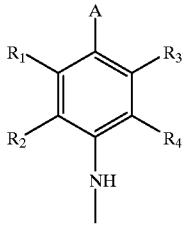

Examples of partial structures having nucleophilicity contained in Z.

(an atom underlined by = has nucleophilicity)

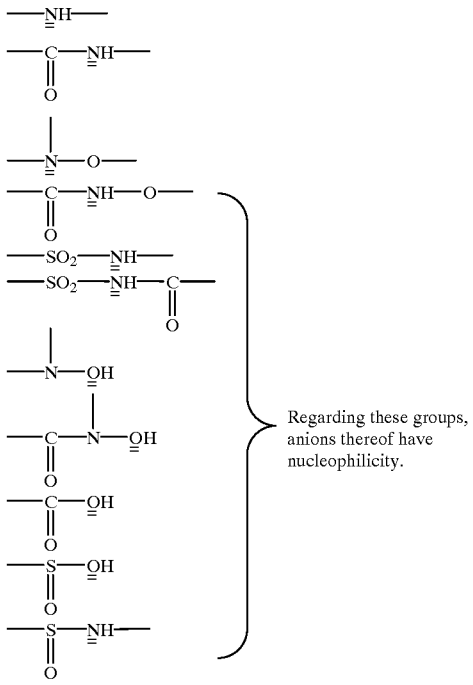

In the generalformula [II], $R_1$ to $R_4$, A and X are as defined in the same way as that of the general formula [I]. However, A is preferably a hydroxyl group.

$Y_k$ and $Z_k$ each represent a nitrogen atom (—N═) or a group represented by —C($R_5$)═. $R_5$ represents a hydrogen atom, halogen atom, alkylgroup, arylgroup, carbonamidegroup, sulfoneamide group, alkoxy group, aryloxy group, alkylthio group, arylthio group, carbamoyl group, sulfamoyl group, cyano group, sulfonyl group, alkoxycarbonyl group, aryloxycarbonyl group, acyl group, ureido group, urethane group, acyloxy group or the like. Wherein, as further specific examples of $R_5$, there can be listed those specific examples exemplified as the substituent for $R_1$ to $R_4$.

K represents an integer of 0 or more, and preferably an integer from 1 to 10.

D represents a group that can be a proton dissociating group or a cation.

After an oxide generated by oxidation reaction of the present compound by a silver halide is coupled with a coupler, a dye is formed by cutting of a N—X bond caused by electron migration from D, and by releasing a substituent bonded to coupling part of the coupler. Specifically, after the coupling reaction, electron migration occurs from a non-covalent electron pair of an atom which can become an anion or a cation proton-dissociated on D, to the coupling part, and a double bond is formed between X and $Y_k$ (when k=0, between X and D) to allow a N—X bond to be cut, and further, a substituent on the coupler side is released as an anion simultaneously with formation of a double bond between the coupling part of the coupler and a N atom. By this series of a electron migration mechanism, formation of a dye and releasing of a substituent occur. Examples of the atom which can be a proton-dissociated anion include an oxygen atom, sulfur atom, selenium atom and electron attracting groups, or a nitrogen atom, carbon atom and the like substitutedby an aromatic group rich in an electron (for example, an aryl group and heteroaromatic ring group). As the atom which can become a cation, a nitrogen atom, sulfur atom and the like can be listed. The proton dissociating group is a group containing an atom that can be this proton-dissociated anion, and the group that can become a cation is a group containing an atom that can become this cation.

D is a substituent containing an atom causing the above-described electron migration, and this atom can be substituted by various substituents. Examples of the substituents substituted on the atom include a halogen atom (such as chloro and bromo groups), analkyl group (such as methyl, ethyl, isopropyl, n-butyl and t-butyl groups), an aryl group (such as phenyl, tolyl group and xylyl groups), a carbonamide group (such as acetylamino, propionylamino, butyloylamino and benzoylamino groups), a sulfonamide group (such as methanesulfonylamino, ethanesulfonylamino, benzenesulfonylamino and toluenesulfonylamino groups), an alkoxy group (such as methoxy and ethoxy groups), an aryloxy group (such as a phenoxy group), an alkylthio group (such as methylthio, ethylthio and butylthio groups), an arylthio group (such as methylcarbamoyl, dimethylcarbamoyl, ethylcarbamoyl, diethylcarbamoyl, dibutylcarbamoyl, piperidinocarbamoyl, morpholinocarbamoyl, phenylcarbamoyl, methylphenylcarbamoyl, ethylphenylcarbamoyl and benzylphenylcarbamoyl groups), a sulfamoyl group (such as methylsulfamoyl, dimethylsulfamoyl, ethylsulfamoyl, diethylsulfamoyl, dibutylsulfamoyl, piperidinosulfamoyl, morpholinosulfamoyl, phenylsulfamoyl, methylphenylsulfamoyl, ethylphenylsulfamoyl and benzylphenylsulfamoyl groups), a cyano group, a sulfonyl group (such as methanesulfonyl, ethanesulfonyl, phenylsulfonyl, 4-chlorophneylsulfonyl and p-toluenesulfonyl groups), an alkoxycarbonyl group (such as methoxycarbonyl, ethoxycarbonyl and butoxylcarbonyl groups), an aryloxycarbonyl group (such as a phenoxycarbonyl group), an acyl group (such as acetyl, propionyl, butyloyl, benzoyl and alkylbenzoyl groups), an acyloxy group (such as acetyloxy, propionyloxy and butyloyloxy groups) and the like, a ureido group, a urethane group, and the like.

As D, an aralkyl group (particularly, a benzyl group), an anilino group, a hetero cyclic group, or a methylene group or methine group substituted by an electron attracting group. These groups may be substituted by a hydroxyl group, an amino group, or by the substituents described for $R_1$ to $R_4$.

Two or more atoms selected from $R_1$ and $R_2$, $R_3$ and $R_4$, and $Y_k$, $Z_k$ and D or substituents may be each independently connected to form a ring.

Specific examples of the compounds of the present invention represented by the general formula [II] and the general formula [III] include, but are not limited to, the following compounds.

D-1

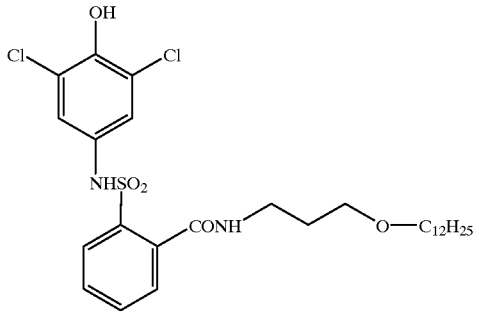

-continued

D-2

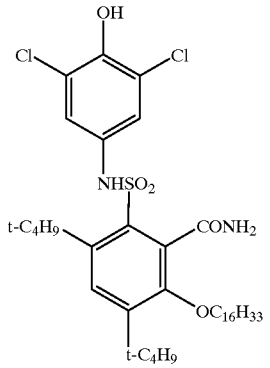

D-3

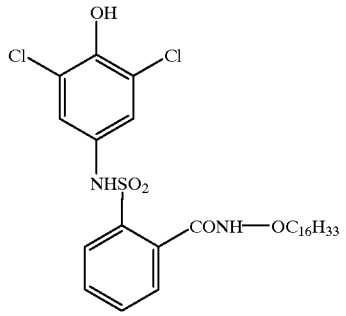

D-4

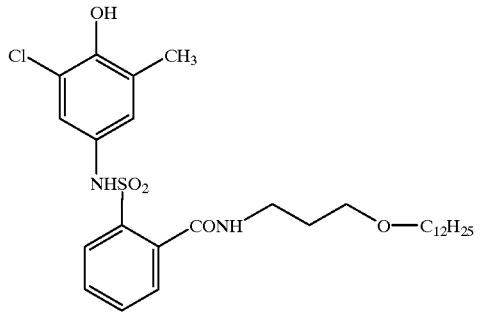

D-5

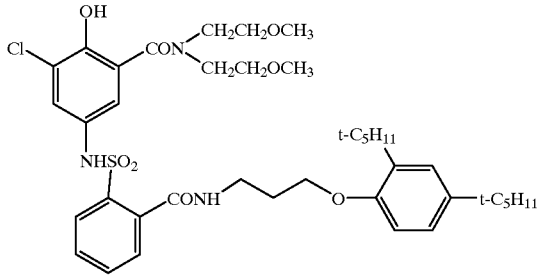

-continued
D-6
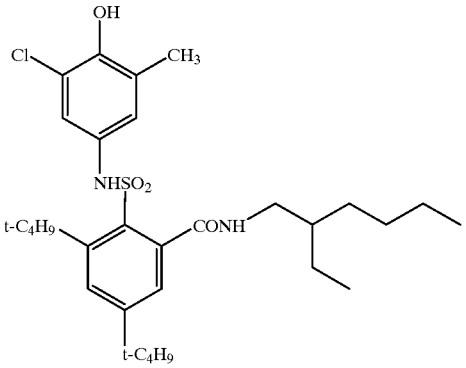
D-7
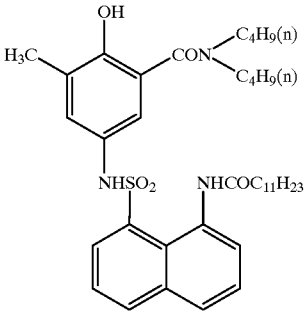
D-8
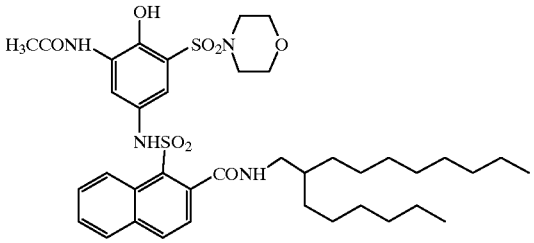
D-9
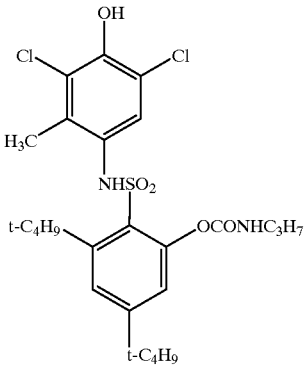
-continued
D-10
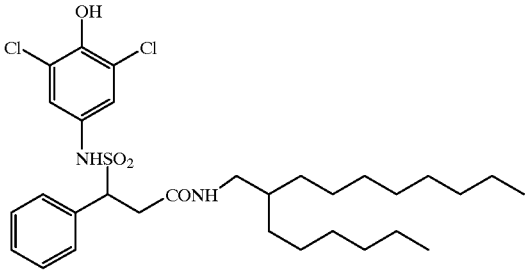
D-11
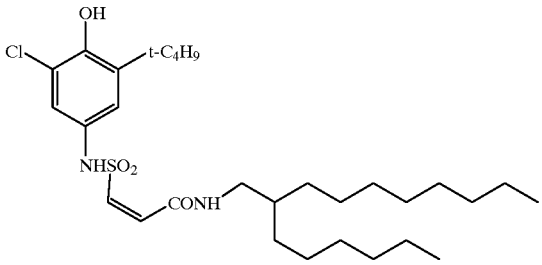
D-12
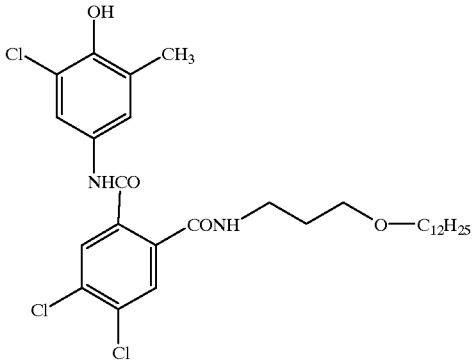
D-13
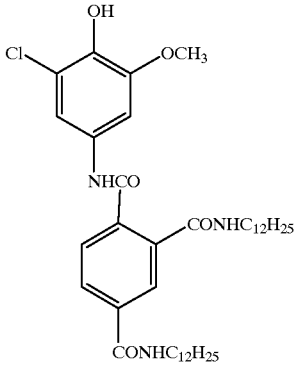

-continued
D-14
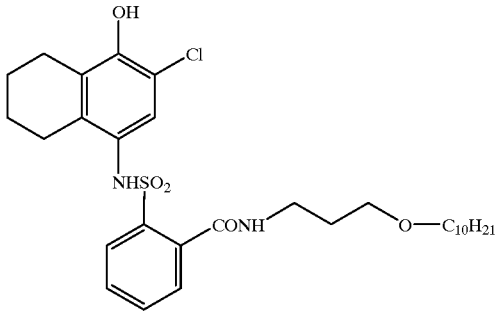
D-15
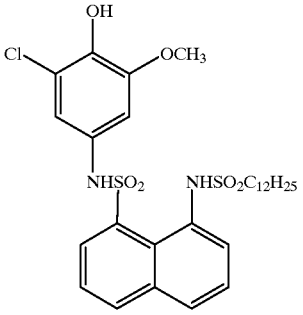
D-16
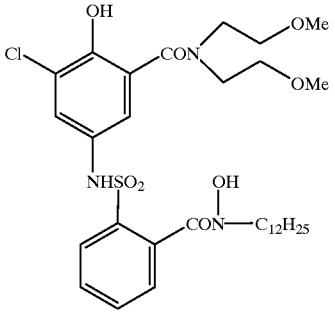
D-17
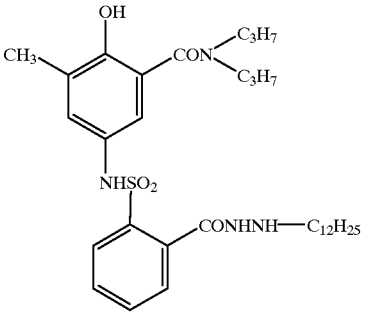
D-18
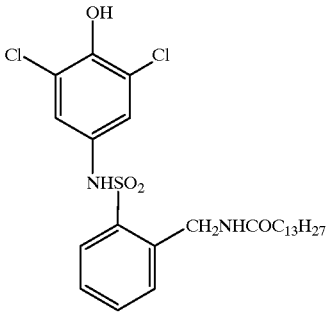
-continued
D-101
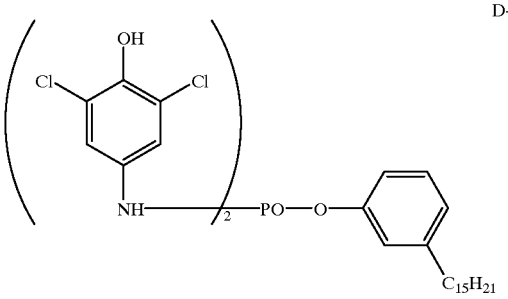
D-102
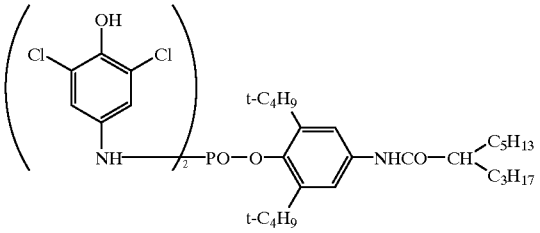
D-103
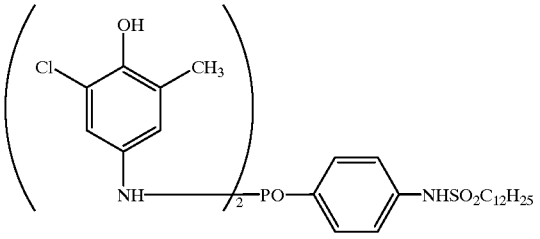
D-104
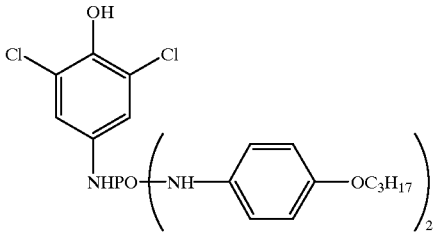
D-105
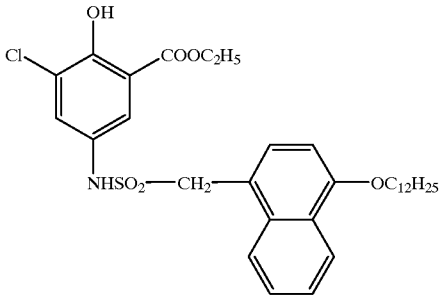

-continued

D-106

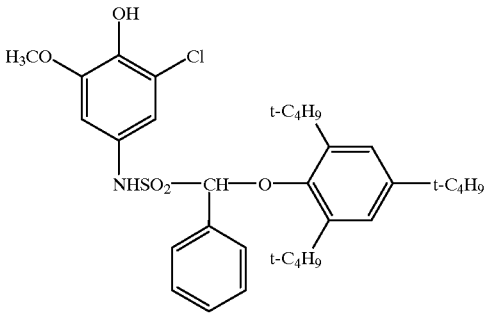

D-107

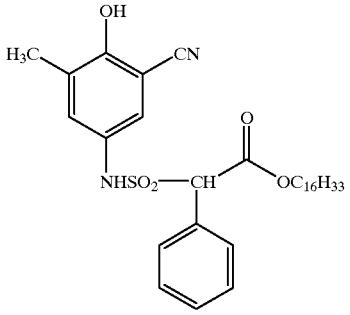

D-108

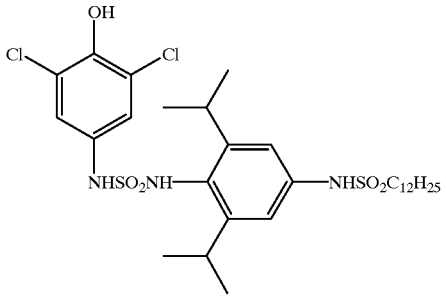

D-109

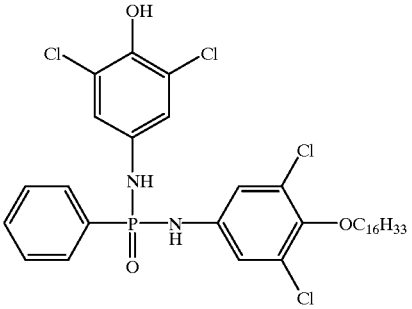

D-110

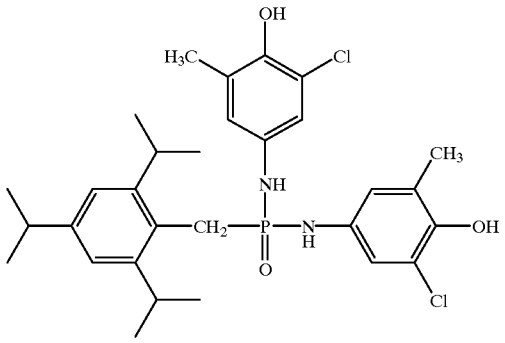

-continued

D-111

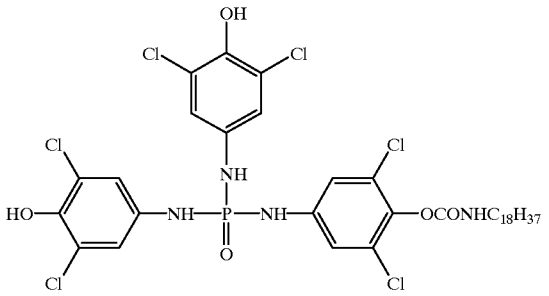

D-112

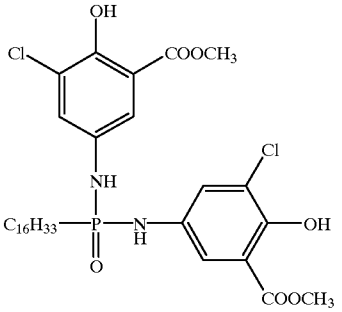

D-113

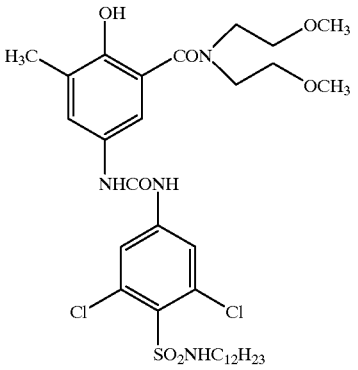

As a method for adding the developing agent represented by the general formula [II] and the general formula [III], it is possible to add the agent by dissolving the agent in an organic solvent with a high boiling point (for example, phosphates such as an alkyl phosphate, aryl phosphate and the like, phthalates such as an alkyl phthlate, aryl phthalate and the like), dispersing the solution in water (or an aqueous solution of a water-soluble binder such as gelatin and the like) in the presence of a surfactant by using an emulsifying and dispersing method known in the field, and then carrying out addition. In this procedure, an organic solvent having a low boiling point (such as, ethyl acetate, methyl ethyl ketone and the like) can be used as an auxiliary solvent. Further, compounds such as a coupler, color development accelerating agent and the like can be simultaneously mixed and dissolved, and the result can be dispersed and added. Moreover, the developing agent can also be added by a solid dispersion method described in JP-A No. 63-271,339.

It is preferable that the compound represented by the general formula [II] and the general formula [III] is an oil-soluble compound when the compound is added by the emulsifying dispersion method among the above-described methods. For this purpose, it is required that at least one group having ballasting property is contained. The ballasting group herein represents an oil-soluble group containing an oil-soluble partial structure having 8 to 80, preferably 10 to 40 carbon atoms. For this, it is preferable that a ballasting group having 8 or more carbon atoms is substituted on any of $R_1$ to $R_4$, X, $Y_k$, $Z_k$, P, $Y_2$ and $Z_2$. Particularly, when the present compound is used for a diffusion transfer type color photosensitive material, it is preferable that a ballasting group is preferably substituted on $Y_{1k}$, $Z_{1k}$, P, $Y_2$ and $Z_2$. The carbon number of this ballasting group is preferably from 8 to 80, more preferably from 8 to 20.

The color developing agent of the present invention is added in an amount from 0.01 to 100-fold, preferably from 1 to 10-fold, further preferably from 0.2 to 5-fold based on a coupler.

Next, the compounds represented by the general formula [IV] used in the present invention will be described below. The general formula [IV] represents a coupler called a pyrazoloazole-based coupler, and in the formula, $R_{19}$ represents a hydrogen atom or a substituent. $Q_3$represents a group composed nonmetal atoms required for forming 5-membered azole ring containing 2 to 4 nitrogen atoms, and said azole ring may have a substituent (including a fused ring).

Among the pyrazoloazole-based couplers represented by the above-described general formula [IV], imidazo[1,2-b] pyrazoles described in U.S. Pat. No. 4,500,630, pyrazolo[1, 5-b]-1,2,4-triazoles described in U.S. Pat. No. 450,654 and pyrazolo[5,1-c]-1,2,4-triazoles described in U.S. Pat. No. 3,725,067 are preferable in the point of absorption property of a color developing pigment.

The details of substituents on an azole ring represented by $R_{19}$ and $Q_3$ are described, for example, in U.S. Pat. No. 4,540,654, 2nd column, lines 41 to 8th column, line 27. Preferable examples thereof include a pyrazoloazole coupler in which a branched alkyl group directly bonds to the 2, 3 or 6-position of a pyrazolotriazole group described in Japanese Patent Application Laid-Open (JP-A) No. 61-65,245 and U.S. Pat. No. 5,541,501, a pyrazoloazole coupler containing a sulfoneamide group in the molecule described in Japanese Patent Application Laid-Open (JP-A) No. 61-65, 245, a pyrazoloazole coupler having an alkoxyphenylsulfoneamide ballast group described in Japanese Patent Application Laid-Open (JP-A) No. 61-147,254, a pyrazoloazole coupler having an alkoxy group and aryloxy group in the 6-position described in Japanese Patent Application Laid-Open (JP-A) No. 62-209,457 or 63-307,453, and a pyrazoloazole coupler having a carbonamide group in the molecule described in JP-A No. 2-201,443.

Next, the compounds represented by the general formula [V] used in the present invention will be described. The general formula [V] is a coupler called a phenol-based coupler, wherein, $R_{20}$ represents a hydrogen atom or a group selected from —$CONR_{22}R_{23}$, —$SO_2NR_{22}R_{23}$, —$NHCOR_{22}$, —$NHCONR_{22}R_{23}$, and —$NHSO_2NR_{22}R_{23}$. $R_{12}$ and $R_{23}$ each independently represents a hydrogen atom or a substituent. $R_{21}$ represents a substituent, l represents an integer selected from 0 to 2 and m represents an integer selected from 0 to 4. When l and m are 2 or more, $R_{21}$ may be different each other. As substituents for $R_{21}$ to $R_{23}$, there are listed those examples exemplified as the substituent for the above-described ring formed by Q and C.

Preferable examples of the phenol-based coupler represented by the above-described formula [V] include 2-alkylamino-5-alkylphenol-based couplers described in U.S. Pat. Nos. 2,369,929, 2,801,171, 2,772,162, 2,895,826, 3,772,002 and the like, 2,5-dialkylaminophenol-based couplers described in U.S. Pat. Nos. 2,772,162, 3,758,308, 4,126,396, 4,334,011, 4,327,173, OLS 3,329,729, Japanese Patent Application Laid-Open (JP-A) No. 59-166956 and the like, 2-phenylureido-5-acylaminophenol-based couplers described in U.S. Pat. Nos. 3,446,622, 4,333,999, 4,451,559, 4,427,767, and the like. The phenol-coupler represented by above formula [V] generally forms a magenta dye by a coupling reaction with the oxide of a compound represented by above formula [I]. Further, the phenol-coupler represented by above formula [V] generally forms a cyan dye by a coupling reaction with the oxide of a compound represented by above formula [II] or [III].

Next, the compounds represented by the general formula [VI] used in the present invention will be described below. The general formula [VI] is a coupler called a naphthol-based coupler, and in the formula, $R_{20}$ and $R_{21}$ are defined in the same way as $R_{20}$ and $R_{21}$ in the general formula [V].

Preferable examples of the naphthol coupler represented by the above-described formula [VI] include 2-carbamoyl-1-naphtol-based couplers described in U.S. Pat. Nos. 2,474, 293, 4,052,212, 4,146,396, 4,228,233, 4,296,200 and the like, 2-carbamoyl-5-amide-1-naphtol-based couplers described in U.S. Pat. No. 4,690,889, and the like.

Next, the compounds represented by the general formula [VII] used in the present invention will be described below.

The general formula [VII] is a coupler called a pyrrolotriazole, and more particularly, is represented by the general formula [VII-1], the general formula [VII-2], the general formula [VII-3] and the general formula [VII-4]. In the formulae, $R_{32}$, $R_{33}$ and $R_{34}$ each independently represents a hydrogen atom or a substituent. As substituents for $R_{32}$, $R_{33}$ and $R_{34}$, there are listed those examples exemplified as the substituent for the above-described ring formed by Q and C. As preferable examples of the pyrrolotriazole-based coupler presented by the general formula [VII-1], the general formula [VII-2], the general formula [VII-3] and the general formula [VII-4] , there are listed couplers in which at least one of $R_{32}$ and $R_{33}$ is an electron attractive group described in EP Nos. 488,248A1, 491,197A1 and 545,300 and U.S. Pat. No. 5,384,236.

In the general formulae [I] to [VII], Y is a group which imparts diffusion resistance to a coupler and can be released by coupling reaction with an oxidized product of a developing agent. Examples of Y include a heterocyclic group (a 5 to 7 membered saturated or unsaturated monocyclic or condensed ring having at least one hetero atom such as nitrogen, oxygen, sulfur and the like, examples thereof include succinimide, maleinimide, phthalimide, diglycolimide, pyrrole, pyrazole, imidazole, 1,2,4-triazole, tetrazole, indole, benzopyrazole, benzoimidazole, benzotriazole, imidazoline-2,4-dione, oxazolidine-2,4-dione, thiozolidine-2,4-dione, imidazolidine-2-one, oxazolidine-2-one, thiazoline-2-one, benzoimidazoline-2-one, benzooxazoline-2-one, benzothiazoline-2-one, 2-pyrroline-5-one, 2-imidazoline-5-one, indoline-2,3-dione, 2,6-dioxypurine, parabanic acid, 1,2,4-triazolidine-3,5-dione, 2-pyridone, 4-pyridone, 2-pyrimidone, 6-pyridazone, 2-pyrazone, 2-amino-1,3,4-thiazolidine, 2-imino-1,3,4-thiazolidine-4-one and the like.), a halogen atom (such as chlorine and bromine atoms and the like), an aryloxy group (such as phenoxy and 1-naphthoxy groups and the like), a heterocyclicoxy group (such as pyridyloxy and pyrazolyloxy groups and the like), an acyloxy group (such as acetoxy and benzoyloxy groups and the like), an alkoxy group (such as methoxy and dodecyloxy groups and the like), a carbamoyloxy group (such as N,N-diethylcarbamoyloxy and morpholinocarbonyloxy groups and the like), an aryloxycarbonyloxy group (such as a phenoxycarbonyloxy group and the like), an alkoxycarbonyloxy group (such as methoxycarbonyloxy and ethoxycarbonyloxy groups and the like), an arylthio group (such as phenylthio and naphthylthio groups and the like), aheterocyclic thio group (such as tetrazolylthio, 1,3,4-thiadiazolylthio, 1,3,4-oxadiazolylthio and benzoimidazolylthio groups and the like), an alkylthio group (such as methylthio, octylthio and hexadecylthio groups and the like), an alkylsulfonyloxy group (such as a methanesulfonyloxy group and the like), an arylxulfonyloxy group (such as benzenesulfonyloxy and toluenesulfonyloxy groups and the like), a carbonamide group (such as acetamide and torifluoroacetamide groups and the like), a sulfonamide group (such as methanesulfonamide and benzenesulfonamide groups and the like), an alkylsulfonyl group (such as a methanesulfonyl group and the like), an arylsulfonyl group (such as a benzenesulfonyl group and the like), an alkylsulfinyl group (such as methanesulfinyl group and the like), an arylsulfinyl group (such as a benzenesulfinyl group and the like), an arylazo group (such as phenylazo and naphthylazo groups and the like), a carbamoylamino group (such as a N-methylcarbamoylamino group and the like), and the like.

Y may be substituted with a substituent, and examples of the substituent for Y include the examples of the substituent on a ring formed from Q and C. The total number of carbon atoms contained in Y is preferably from 6 to 50, more preferably from 8 to 40, and most preferably from 10 to 30.

Y is preferably an aryloxy, heterocyclicoxy, acyloxy, aryloxycarbonyloxy, alkoxycarbonyloxy or carbamoyloxy group.

In the present invention, in addition to the above-described couplers of the general formulae [IV] to [VII], there can be used couplers having structures such as condensed ring phenol, imidazole, pyrrole, 3-hydroxypyridine, active methine, 5,5-condensed ring heterocyclic and 5,6-condensed ring heterocyclic.

As the above-described condensed phenol-based coupler, there can be used couplers described in U.S. Pat. Nos. 4,327,173, 4,564,586, 4,904,575 and the like.

As the above-described imidazole-based coupler, there can be used couplers described in U.S. Pat. Nos. 4,818,672, 5,051,347 and the like.

As the above-described 3-hydroxypyridine-based coupler, there can be used couplers described in Japanese Patent Application Laid-Open (JP-A) No. 1-315,736 and the like.

As the above-described active methylene-based and active methine-based coupler, there can be used couplers described in U.S. Pat. Nos. 5,104,783, 5,162,196 and the like.

As the above-described 5,5-condensed ring heterocyclic-based couplers, there can be used pyrrolopyrazole-based couplers described in U.S. Pat. No. 5,164,289, pyrroloimidazole-based couplers described in Japanese Patent Application Laid-Open (JP-A) No. 4-174,429, and the like.

As the above-described 5,6-condensed ring heterocyclic-based couplers, there can be used pyrazolopyrimidine-based couplers described in U.S. Pat. No. 4,950,585, pyrrolotriazine-based couplers described in Japanese Patent Application Laid-Open (JP-A) No. 4-204,730, couplers described in EP No. 556,700, and the like.

Further, in the present invention, in addition to the above-described couplers of the general formulae [IV] to [VII], there can be used couplers described in German Patent Nos. 3,819,051A, 3,823,049, U.S. Pat. Nos. 4,840,883, 5,024,930, 5,051,347, 4,481,268, EP Nos. 304,856A2, 329,036, 354,549A2, 374,781A2, 379,110A2, 386,930A1, Japanese Patent Application Laid-Open (JP-A) Nos. 63-141,055, 64-32,260,32,261, 2-297,547, 2-44,340,2-110,555, 3-7,938, 3-160,440, 3-172,839,4-172,447, 4-179,949, 4-182,645, 4-184,437, 4-188,138, 4-188,139, 4-194,847, 4-204,532, 4-204,731, 4-204,732, and the like.

In the coupler used in the present invention, the total number of carbon atoms in parts other than Y is preferably from 1 to 30, more preferably from 1 to 24, and most preferably from 1 to 18.

Specific examples of the couplers which can be used in the present invention include, but are not limited to, the following compounds.

C-1

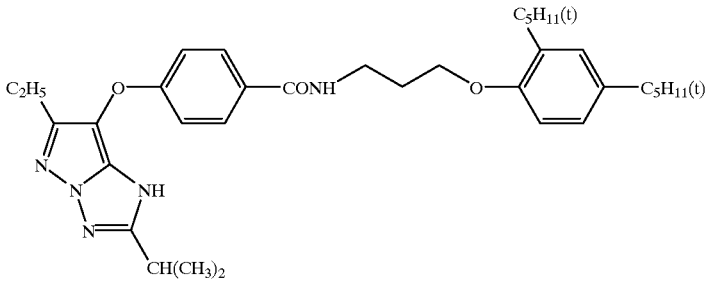

-continued
C-2
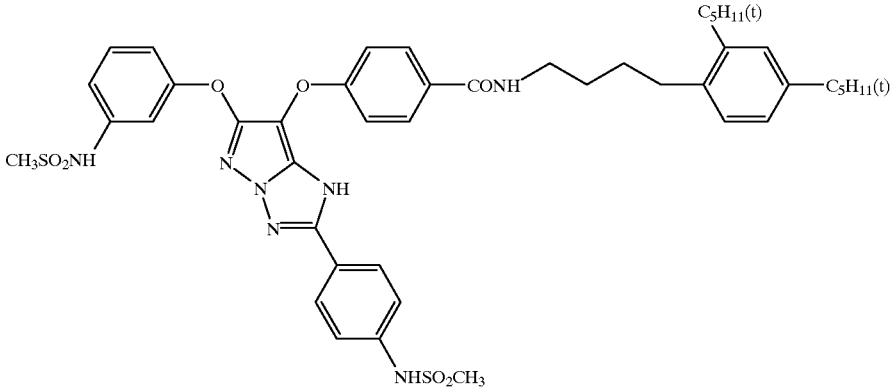
C-3
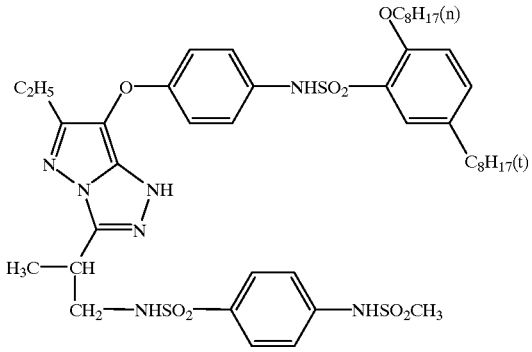
C-4
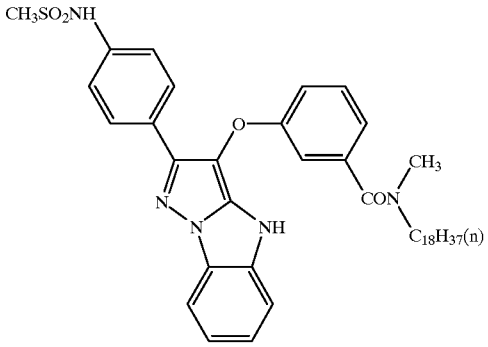
C-5
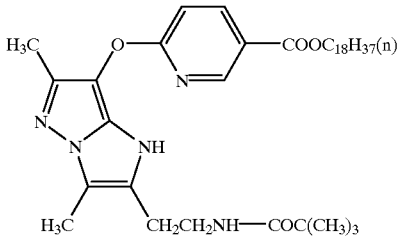

-continued
C-6
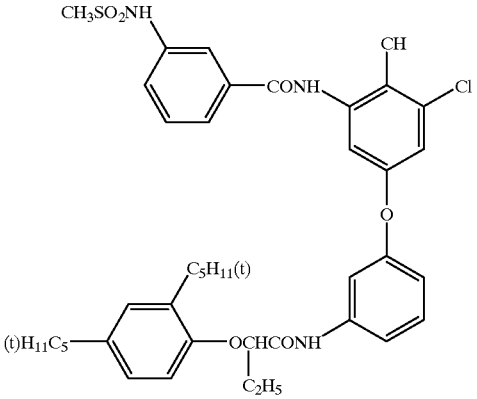
C-7
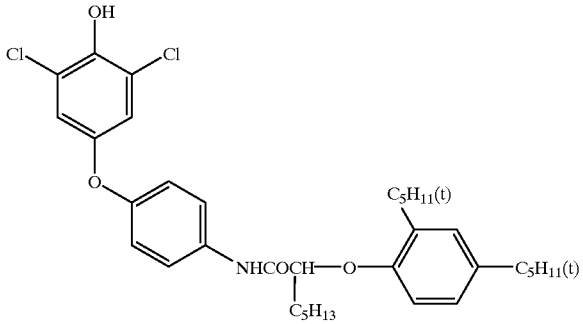
C-8
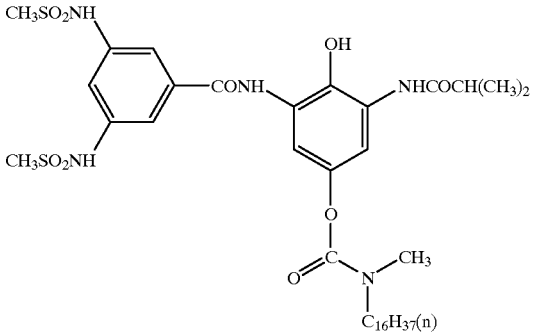
C-9
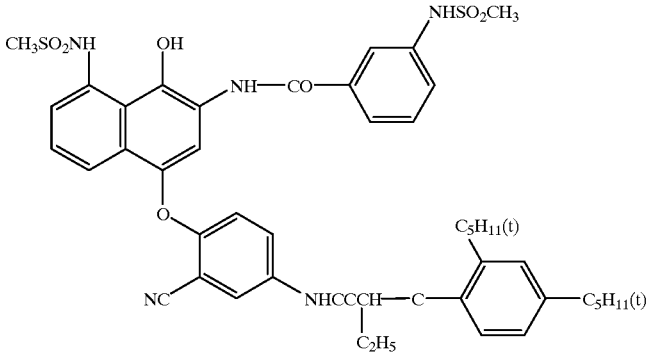

-continued
C-10
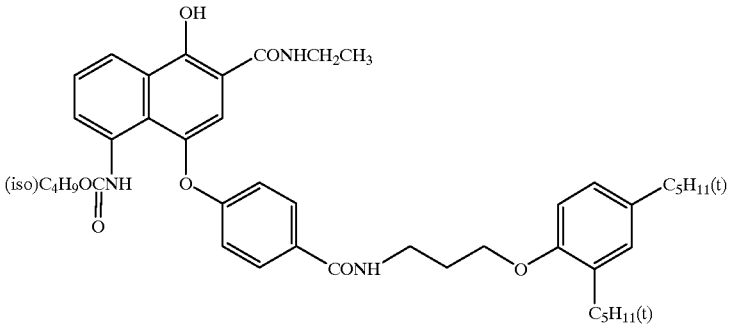
C-11
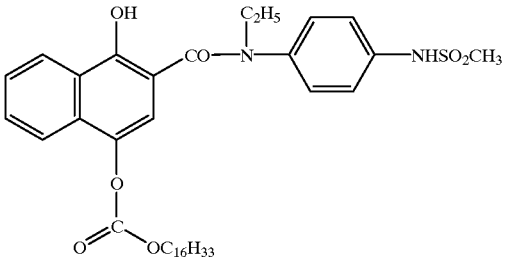
C-12
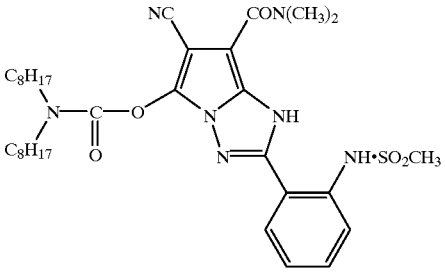
C-13
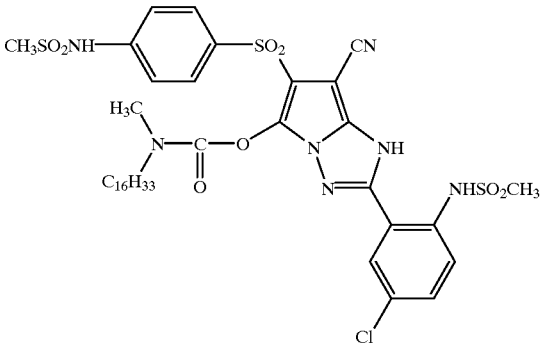

-continued
C-14
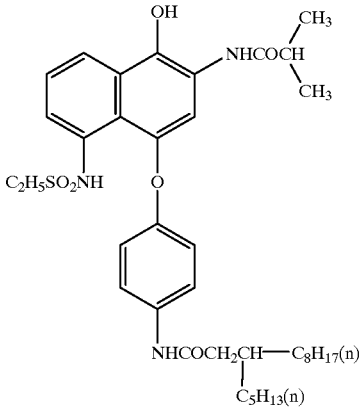
C-15
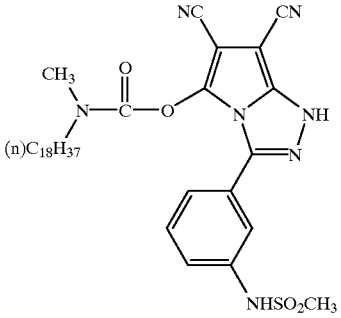
C-16
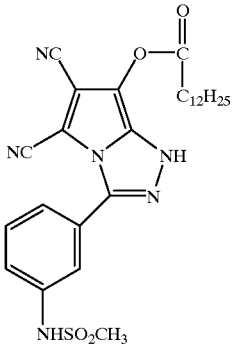
C-17
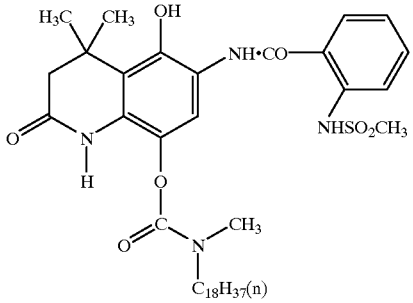
C-18
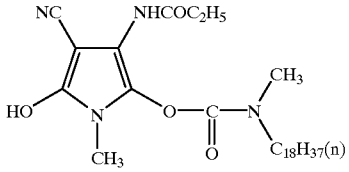

-continued

C-19

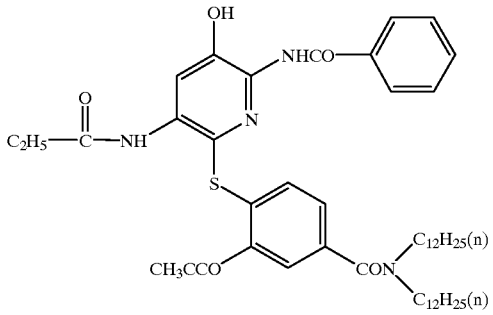

C-20

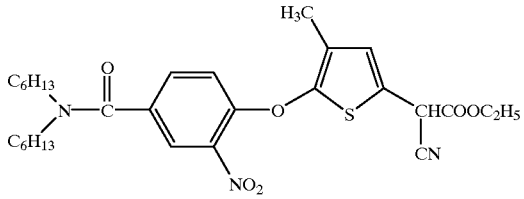

C-21

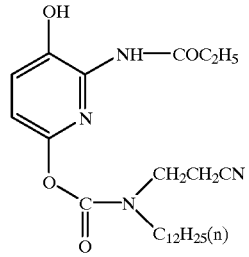

C-22

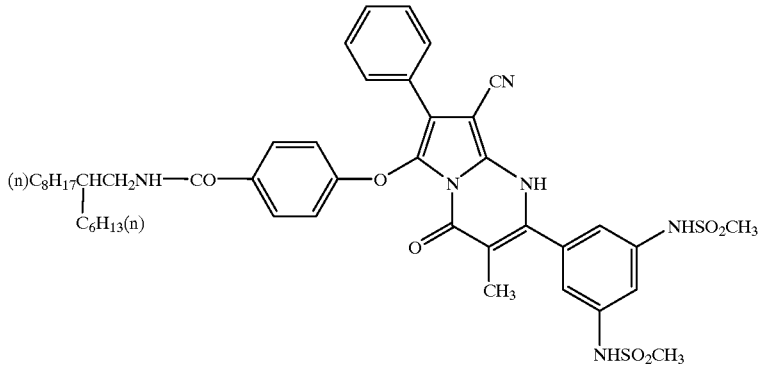

C-23

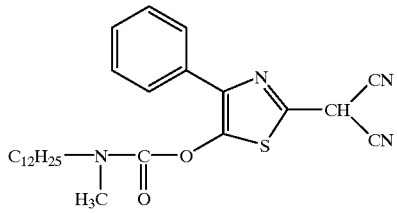

The amount added of the above-described coupler used in the present invention depends on molar absorptivity (ϵ) of a pigment formed, and in the case of a coupler in which ϵ of a pigment produced by coupling is from about 5,000 to 500,000, it is suitable that the amount coated is from about 0.001 to 100 mmol/$m^2$, preferably from about 0.01 to 10 mmol/$m^2$, and more preferably from about 0.05 to 5 mmol/$m^2$, for obtaining an image concentration of 1.0 or more in terms of reflection concentration. The couplers can be used in combination of two or more.

In at least one of the silver halide emulsions used in the present invention, the contained silver halide particles must have a variation coefficient of particle size distribution of 20% or less and a variation coefficient of halogen composition between particles of 25% or less.

In the silver halide emulsion used in the photography photosensitive material, a silver halide fine crystal having a size from about 0.05 to 3$\mu$ is dispersed in a binder such as gelatin and the like. The variation coefficient of particle size of contained silver halide particles as referred in the present invention is a value which is obtained as a result of statistical treatment of the particle size distribution of these silver halide fine crystal particles, and a value represented in terms of % obtained by dividing a so-called standard deviation of the particle size distribution by an average particle size.

The particle size distribution of silver halide particles contained in an emulsion can be known by observation with an electron microscope of the form of the silver halide fine crystals excepting a binder according to a carbon replica method and the like. Particle sizes are measured of silver halide particles of a statistically necessary number, namely, at least several decades or more, preferably several hundreds or more silver halides, the number-average thereof is calculated to obtain an average particle size. The particle size is represented by a diameter of a circle equivalent to the projected area of a particle observed with an electron microscope.

The standard deviation of the particle size distribution of the observed particles is calculated, and this value is divided by the above-described particle size to obtain a variation coefficient of the particle size distribution. In the present invention, the values are multiplied by 100 and represented in terms of %.

In at least one of the silver halide emulsions used in the present invention, the contained silver halide particle must have a variation coefficient of particle size distribution of 20% or less. This variation coefficient is preferably 15% or less, further preferably 12% or less. When an emulsion having a variation coefficient of particle size distribution of contained silver halide particles of over 20% is used, color developing concentration dependency when the amount of water varies in developing is large; therefore, such a variation coefficient is not preferable.

A technology using silver halide emulsion composed of silver halide particles having a small variation coefficient of particle size distribution as a photosensitive material for high temperature development is disclosed in JP-A No. 62-32454. According to the description of this patent specification, suppression of fogging particularly in high temperature development and improvement of maximum color developed concentration are effectively attained by using a silver halide emulsion composed of silver halide particles having a small variation coefficient of particle size distribution together with a nitrogen-containing heterocyclic compound as a photosensitive material for high temperature development. However, the means disclosed in the above-described technology is only a technology for improving the above-described discrimination in a system using a pigment donative compound which releases a pigment in developing an exposed silver halide or using a coupler which forms a pigment having diffusion resistance with using a p-aminophenol derivative as a developing agent, and it is a technology which is utterly different from a technology which suppresses variation in abilities caused by variation in the amount of water imparted, in a system which releases a diffusive pigment following coupling reaction using a specific developing agent prescribed in the present invention.

In the present invention, the effect can be obtained only if not only the variation coefficient of particle size distribution is lowered but also the variation coefficient of halogen composition distribution between particles is lowered. This point is completely different from the conventional technologies. The present invention accomplished by an utterly novel finding.

In the present invention, it is also required that the variation coefficient of halogen composition distribution between silver halide fine crystals contained. The halogen composition of each silver halide fine crystal can be measured by applying an EPMA method and the like to fine crystal particles dispersed on a silicon substrate and the like. In the case of a silver chloride bromide emulsion particle, the composition can be determined by measuring a ratio of the signal strength of bromine to signal strength of silver regarding one particle and correcting it using a standard sample of which composition is known. Likewise, also regarding silver iodide bromide, the composition can be determined by measuring a ratio of the signal strength of iodine to signal strength of silver regarding one particle. When halogen compositions of fine crystal particles of statistically significant number, namely, at least several decades or more are measured, the variation coefficient of halogen composition distribution can be calculated by statistically treating the resulted compositions. In the same manner as for the particle size distribution, the variation coefficient can be obtained by measuring the standard deviation of halogen composition distribution and by dividing this value by average halogen composition between particles. In the present invention, this value is multiplied by 100 and represented in terms of %.

In at least one of silver halide emulsions used in the present invention, a silver halide particle contained must have the variation coefficient of the particle size distribution of 25% or less. This variation coefficient is preferably 20% or less, further preferably 15% or less. When an emulsion having a variation coefficient of halogen composition distribution of silver halide particles contained of over 25% is used, color developing concentration dependency when the amount of water varies in developing is large even if the emulsion is composed of silver halide particles having small particle size distribution, therefore, such variation coefficient is not preferable.

Accordingly, in the present invention, it is necessary that regarding at least one of silver halide emulsions used, both the variation coefficient of particle size distribution and the variation coefficient of halogen composition distribution of silver halide particles contained satisfy the prescriptions of the present invention.

The volume of a silver halide particle constituting a silver halide emulsion used in the present invention can take various values depending on sensitivity intended, and preferably from 0.1 $\mu$m to 5 $\mu$m in terms of the diameter of a sphere having the same volume.

Regarding particle shape of each silver halide fine crystal, a so-called normal crystal of cube, tetradecanehedron, crystal dodecahedron, octahedron or the like is preferable in view of uniformity in particle size distribution and uniformity in halogen composition distribution between particles.

Those in which crystal surface determining outer shape of the crystal is not so definite as described above, for example, particles partially containing round shape and intermediate particles between the above-described crystal shapes can also be used preferable. Further, it is also possible to use hexagonal flat plate particle having two or more twin crystals providing the particle size distribution can be narrowed to level of a variation coefficient of 20% or less.

The composition of the silver halide emulsion of the present invention can take various compositions for imparting intended abilities, and preferably selected from silver chloride bromide, silver iodide bromide and silver chloride iodide bromide. Such silver chloride bromide, silver iodide bromide and silver chloride iodide bromide which are not a so-called mixed crystal can make the whole silver halide particle to be composed of a single composition, however, they are not preferable since they can not easily impart various required properties to a photosensitive material.

The silver halide particle constituting the silver halide emulsion used in the present invention can take various particle structures for the purposed of obtaining high sensitivity.

A preferable example is a method in which a particle is constituted of a plurality of layers having different halogen compositions. In the present invention, a plurality of layers can be laminated forming co-axial polyhedral shape by changing halogen composition on the way of forming a particle. For example, when a silver chloride bromide particle is illustrated as an example, a core having high silver bromide content is placed at the center of a particle and a shell having low silver bromide content can be formed around the core. Reversely, a shell having high silver bromide content can be formed around a core having high silver chloride content. Further, a plurality of shells can be formed surrounding a core.

Also regarding a silver iodide bromide particle, layers having different silver iodide contents are preferably formed to make laminated structure.

Also, the physical properties of a silver halide crystal can be significantly changed by allowing a silver chloride bromide particle to contain a small amount of iodine. For this, iodine is preferably contained in any concentration in the above-described core and shell. The content of silver bromide and silver iodide can be changed optionally within the range wherein the object of the present invention is not lost.

Various methods can be adopted for changing the halogen composition at various parts of a particle. In normal method, it is conducted by changing the composition of a water-soluble silver halide such as a silver halide alkali and the like introduced in a reaction system simultaneously with a water-soluble silver salt such as silver nitrate and the like during particle formation. Further, a particle is also preferably grown by supplying a ultra-fine particle of silver halide previously formed. In this case, the partial composition of a particle can be changed by changing the composition of a silver halide ultra-fine particle. Further, for introducing silver bromide and silver iodide into a particle, there is also preferably used an organic compound such as, for example, β-bromopronionic acid and sodium p-iodinated acetamidebenzenesulfonate which can generate a bromide ion and iodide ion by reacting with a base, sulfite and the like in an emulsion.

It is also preferable to form a projected part composed of a silver halide epitaxially connected onto the surface of a particle. Since the projected part is constituted of silver halide, crystal type thereof is the same face centered crystal type rock salt type as the host particle, however, since the halogen composition is different from that of the host particle, epitaxial connecting part is formed contributing to increase in sensitivity.

Control of the halogen composition of the epitaxial projected part is conducted by changing silver halide ions supplied or existing in depositing the epitaxial projected part onto the host particle. For example, silver iodide content of the epitaxial projected part can be enhanced by adding a bromide ion and iodine ion prior to deposition of the epitaxial projected part and/or allowing a bromine ion and an iodine ion to exist in an aqueous silver halide alkali solution supplied simultaneously with a silver chloride solution. In some case, an epitaxial projected part having any composition can also be formed by adding silver halide in the form of a fine crystal of which composition is controlled.

For controlling deposited part of the epitaxitial projected part, an adsorption substance which can act as a site director is preferably added before formation of the epitaxitial projected part. As specific examples thereof, cyanine and merocyanine compounds can be preferably used. By controlling the amount added of these pigments, position formed of the epitaxitial projected part can be controlled and occupying area can be controlled. As the site director, nitrogen-containing heterocyclic compounds such as aminoazaindenes and the like can be used in addition to the above-described pigments. In using them, a method disclosed in U.S. Pat. No. 4,435,501 can be referred to.

A metal complex is preferably contained in a silver halide particle or the above-described epitaxial projected part. Herein, the metal complex indicates a complex ion in which a halide ion, cyanide ion and the like are coordinated around a transition metal ion. Among these metal complexes, a metal complex which provides a transitional shallow electron trap in sensitizing process is preferably contained. Whether it acts as the transitional shallow electron trap or not can be checked by measuring the life of a photoelectron generated in irradiating a test piece coated with a silver halide emulsion by a laser pulse light, by utilizing micro wave absorption. As a result of inclusion of the metal complex in the silver halide particle, when the life of a photoelectron generated by the above-described laser pulse is prolonged, it can be judged that the metal complex acts as a transitional shallow electron trap. When the life of a photoelectron is significantly shortened by introduction of a lot of electron traps as well as other reasons in preparation process of the silver halide particle used, and therefor the measurement is difficult, the measurement can be made easy by cooling a sample.

Apart from this, it can be known by a method measuring the depth of an electron trap by dynamical measurement utilizing ESR reported by R. S. Eachus, R. E. Grave and M. T. Olm (Phys. Stat. Sol (b), vol 88, p. 705 (1978)). If trap depth measured by this method is used, the metal complex providing a transitional shallow electron trap in sensitizing process referred to in the present invention provides a trap having a depth of 0.2 eV or less, more preferably provides a trap having a depth of 0.1 eV or less.

The metal complex acting as a transitional electron trap in sensitizing process preferably used in the present invention is a complex in which ligands which can significantly cleave d-orbital on spectral chemical series such as a cyanide ion and the like are coordinated around a metal ion belonging to a first, second or third transition series. It is preferable that the coordination form of these complexes is a 6-coordinated complex in which 6 ligands are coordinated forming octahedron and that the number of a cyane ligand is 4 or more.

As preferable center transition metal, there may be listed iron, cobalt, ruthenium, rhenium, osmium and iridium.

When one or more of the 6 ligands of the metal ion is not (a) cyane ligand(s), the other ligand can be selected from halide ions such as a fluoride ion, chloride ion, bromide ion and the like, inorganic ligands such as SCN, NCS, $H_2O$ and the like, and further, organic ligands such as pyridine, phenanthroline, imidazole, pyrazole and the like.

In the emulsion of the present invention, it is preferable to use a metal complex which provides a deep electron trap in sensitizing process together with the above-described metal complex which provides a transitional shallow electron trap in sensitizing process. Whether it acts as the deep electron trap or not can be checked by measuring the above-described life of a photoelectron and by investigating if the life of an electron is shortened by introduction of the metal complex.

A metal complex having a trap depth measured by the above-described ESR measurement of 0.35 eV or more can be preferably used.

Examples of the metal complex providing a deep electron trap in sensitizing process include ruthenium rhodium, palladium or iridium carrying a halide ion or thiocyanate ion as a ligand, ruthenium having one or more nitrosyl ligands, chromium having a cyanide ion ligand, and so on.

In the silver halide emulsion of the present invention, doping amount of the above-described metal complex into a silver halide particle is generally in the range from $10^{-9}$ to $10^{-2}$ per one mol of a silver halide. More particularly, it is preferable that the metal complex which provides a transitional shallow electron trap in sensitizing process is used in an amount within $10^{-6}$ to $10^{-2}$ per one mol of a silver halide, and that the metal complex which provides a deep electron trap in sensitizing process is used in an amount within $10^{-9}$ to $10^{-5}$ per one mol of a silver halide.

The doping site of these metal complex can be changed variously. Namely, the metal complex may be doped uniformly in a silver halide particle, or may be localized inside or on the surface of the particle. It may be doped in extremely shallow semi-surface near the surface of the particle. Further, in the case of a silver halide particle having structure inside the particle, different metal complexes may be preferably doped in parts having different compositions. For example, there can be preferably used a method in which a hexacyano ferrate (II) ion is doped in a part having high silver chloride content and a hexachloro iridate (III) ion is doped in an epitaxial crystal part having high silver bromide content, a method in which a metal complex is doped intensively inside a silver iodide bromide, a method in which a hexachloro iridate (IV) ion is doped in a silver iodide bromide and a hexacyano ruthenate (II) ion is doped in a corner part of the particle to obtain an epitaxial crystal having high silver chloride content and this crystal is deposited.

For doping these metals in a silver halide particle, a method a metal complex is dissolved in a reaction solution used for particle formation, for example, an aqueous alkali halide solution and is introduced, a method in which a solution of a metal complex is added to a reaction vessel during particle formation and the metal complex is introduced, and the like may be appropriately selected for use.

In the silver halide particle of the present invention, a divalent anion of a what is called chalcogen element such as sulfur, selenium and tellurium is also preferably doped. These dopants are also useful for obtaining high sensitivity and improving exposure condition dependence.

Regarding a preparation method of a silver halide particle which can be used in the present invention, known methods, namely methods described in P. Glafkides, Chimie et Phisique Photographique, Paul Montel, 1967, G. F. Duffin, Photographic Emulsion Chemistry, Focal Press, 1966, V. L. Zelikman et al., Making and Coating of Photographic Emulsion, Focal Press, 1964, and the like can be used as a basic method. Namely, the particle can be prepared in various pH ranges such as an acidic method, neutral method, ammonia method and the like. As a supplying method for a reaction solution of a water-soluble silver salt and water-soluble halogen salt, a one side mixing method, simultaneous mixing method and the like can be used alone or in combination. Further, it is also preferable that a controlled double jet method in which addition of a reaction solution is controlled so as to keep pAg at intended value. Further, there is also used a method in which pH value during reaction is kept constant. In forming a particle, a method in which solubility of a silver halide is controlled by changing pH or pAg can be used, however, thioether, thioureas, rhodan salt and the like can also be used as a solvent. The examples thereof are described in Japanese Patent Application Publication (JP-B) No. 47-11386 and Japanese Patent Application Laid-Open (JP-A) No. 53-144319.

The preparation of the silver halide particle of the present invention is usually conducted by supplying a water-soluble silver salt solution and solution of a water-soluble halogen salt such as an alkali halide into a solution in which a water-soluble binder such as gelatin is dissolved, under controlled conditions.

In formation of a flat silver halide particle having high aspect ratio such as used in the present invention, gelatin during the particle formation also exerts an important influence. For forming a flat particle having thin particle thickness, gelatin containing a small amount of methionine is preferable. For reducing methionine content in gelatin, it is preferable that the gelatin is oxidized using hydrogen peroxide and the like. Further, it is also preferable that an amino group contained in gelatin is modified by a substituent having a carboxyl group. Examples of the preferable substituent include phthalic acid, succinic acid, trimellitic acid and pyromellitic acid.

After the silver halide particle is formed, it is preferable to remove excess water-soluble salts. This process is called a desalting process or water-washing process, and various means are used. For example, there may also be used a Nudel water-washing method in which a gelatin solution containing a silver halide particle is gelled, cut in the form of a string and a water-soluble salt is washed away by cool water, and a precipitation method in which inorganic salts (for example, sodium sulfate), anionic surfactant, anionic polymer (for example, sodium polystyrenesulfonate) comprising a polyvalent anion, or a gelatin derivative (for example, aliphatic acylated gelatin, aromatic acylated gelatin, aromatic carbamoylated gelatin and the like) is added to flocculate the gelatin and excess salts are removed. When the precipitation method is used, the removal of excess salts is carried out quickly.

In the present invention, it is usually preferable to use a silver halide emulsion to which chemical sensitization has been performed. The chemical sensitization contributes to supply of high sensitivity to a silver halide particle prepared and to supply of exposure condition stability and preservation stability. For the chemical sensitization, sensitization methods which are generally known can be used alone or in various combinations.

As the chemical sensitization method, a chalcogen sensitization method using a sulfur, selenium or tellurium compound is preferably used. As the sensitization agent for these methods, a compound which releases the above-described chalcogen element to form a silver chalcogenide when added to the silver halide emulsion is used. Further, it is also preferable to use these compounds together to obtain high sensitivity and to suppress fogging low.

Further, a noble metal sensitization method using gold, platinum, iridium and the like is also preferable. In particular, a gold sensitization method in which chlorine aurate is used alone or together with a thiocyanate ion which is a ligand of gold gives high sensitivity. When the gold sensitization and chalcogen sensitizatin are used together, further high sensitivity can be obtained.

Further, there is also preferably used a so-called reducing sensitization method in which a reductive silver nucleus is introduced by using a compound having suitable reducing ability in forming a particle to obtain high sensitivity. A reductive sensitization method in which an alkylamine compound having an aromatic ring is added in chemical sensitization is also preferable.

Control of reactivity using various compounds having adsorptivity to the silver halide particle is preferably conducted in conducting chemical sensitization. In particular, a method in which a nitrogen-containing heterocyclic compound and mercapto compound, sensitizing pigments of cyanines and merocyanines are added prior to the chalcogen sensitization and gold sensitization is particularly preferable.

Though the reaction conditions when the chemical sensitization is performed differ depending on object, and the temperature is from 30° C. to 95° C., and preferably from 40° C. to 75° C., pH is from 5.0 to 11.0, and preferably from 5.5 to 8.5, and pAg is from 6.0 to 10.5, and preferably from 6.5 to 9.8.

The chemical sensitization technique is described in Japanese Patent Application Laid-Open (JP-A) No. 3-110555, Japanese Patent Application Nos. 4-75798, 62-253159, 5-45833, 62-40446 and the like.

It is also preferable that an epitaxial projected part is formed in these chemical sensitizing process to provide high sensitivity and high contrast.

In the present invention, it is preferable to perform so-called spectral sensitization which gives sensitivity in desired light wave range to a photosensitive silver halide emulsion. In particular, in a color photography photosensitive member, photosensitive layers having photosensitivity against blue, green and red respectively are introduced to conduct color rendering exactly corresponding to original. This photosensitivity is provided by spectral sensitization of a silver halide. In spectral sensitization, so-called spectral sensitization pigment is used which adheres to the silver halide particle and gives sensitivity in adsorption wavelength range of itself.

The examples of these pigments include a cyanine pigment, metocyanine pigment, complicated cyanine pigment, complicated metocyanine pigment, holopolar pigment, hemicyanine pigment, styryl pigment, hemioxonol pigment and the like. The examples thereof are described in U.S. Pat. No. 4,617,257, Japanese Patent Application Nos. 59-180550, 64-13546, 5-45828, 5-45834 and the like. The spectral sensitization pigment is used in combination as well as used alone. This pigment is used for the purpose of regulation of wavelength distribution of spectral photosensitivity and strong color sensitization. By combination of the pigments showing strong color sensitization action, sensitivity remarkably greater than the sum of sensitivities which can be attained alone can be obtained.

Further, it is also preferable to use together a pigment having no spectral sensitizing action-itself or a compound which and does not substantially absorb a visible light but shows strong color sensitizing action. Diaminostilbene compounds and the like are listed as the examples of the strong color sensitization agent. The examples thereof are described in U.S. Pat. No. 3,615,641, Japanese Patent Application Laid-Open (JP-A) No. 63-23145 and the like.

The addition of these spectral sensitization pigment and strong color sensitization agent to the silver halide emulsion may be conducted in any period of time in emulsion preparation. Various methods such addition in preparing a coating solution to an emulsion which has completed chemical sensitization, addition when chemical sensitization is completed, addition during chemical sensitization, addition prior to chemical sensitization, addition before desalting after completion of particle formation, addition during particle formation, addition prior to particle formation and the like can be used alone or in combination. When a crystal phase controlling agent is used in forming a flat particle in the present invention, it is preferable that a spectral sensitizing pigment is added after completion of particle formation, is changed with the controlling agent and adsorbed, and the controlling agent is removed in the following desalting process. It is also preferable that the spectral sensitizing pigment are divided and added in a plural of times in the various processes as described above. In the present invention, it is preferable to add 10% or more of the total addition amount in a process before chemical sensitization for obtaining high sensitivity.

The amounts added of the spectral sensitization pigment and strong color sensitization pigment differ depending on the form and size of a particle and photography characteristics to be imparted, and in general, from $10^{-8}$ to $10^{-1}$ mol, and preferably from $10^{-5}$ to $10^{-2}$ mol per one mol of a silver halide. These compounds can be added in the form of a solution in an organic solvent such as methanol, fluorine alcohol and the like, or in the form of a dispersion in water together with a surfactant and gelatin.

The spectral sensitizing pigment in the present invention can be preferably used as a site director in forming an epitaxial projected part.

It is preferable to add various stabilizing agents to the silver halide emulsion for the purpose of prevention of fogging and increase of stability in preservation. The example of the preferable stabilizing agent include nitrogen-containing heterocycle compounds such as azaindenes, triazols, tetrazols, purines and the like, mercapto compounds such as mercapto tetrazols, mercapto triazols, mercapto imidazols, mercapto thiodiazols, and the like. The details thereof are described in T. H. James, The Theory of the Photographic Process, Macmillan, 1977, pp. 396 to 399 and cited references therein.

In the present invention, mercaptoazoles such as aryl mercaptotriazoles and aryl mercapto tetrazoles can be preferably used. Further, among them, oil-soluble compounds having a substituent containing a lot of carbon atoms can be preferably used.

The addition of these fogging preventing agents and stabilizers to the silver halide emulsion may be conducted at any period of time in emulsion preparation. Various methods such addition in preparing a coating solution to an emulsion which has completed chemical sensitization, addition when chemical sensitization is completed, addition during chemical sensitization, addition prior to chemical sensitization, addition before desalting after completion of particle formation, addition during particle formation, addition prior to particle formation and the like can be used alone or in combination.

The amount added of the fogging preventing agent or stabilizer differs depending on halogen composition of the silver halide emulsion and the purpose, and in general, from $10^{-6}$ to $10^{-1}$ mol, and preferably from $10^{-5}$ to $10^{-2}$ mol per one mol of a silver halide.

The additives for photography used in the photosensitive member of the present invention as described above are described in Research Disclosure (hereinafter, abbreviated as RD) No. 17643 (December, 1978), No. 18716 (November, 1979) and No. 307105 (November, 1989), and the corresponding parts thereof are summarized below.

| Kinds of additives: | RD 17, 643 | RD 18, 715 | RD 307, 105 |
|---|---|---|---|
| 1. Chemical sensitizer | pp. 23 | pp. 648, RC | pp. 866 |
| 2. Sensitivity enhancer | | pp. 648, RC | |
| 3. Spectral sensitizer/ Supersensitizer | pp. 23–24 | pp. 648, RC ~pp. 649, RC | pp. 868 |
| 4. Brightening agent | pp. 24 | pp. 648, RC | pp. 868 |
| 5. Anti-fogging agent/ Stabilizer | pp.24–25 | pp. 649, RC | pp. 868–870 |
| 6. Light absorber/ Filter/Dye/ Ultraviolet ray absorber | pp. 25–26 | pp. 649, RC pp. 650, LC | pp.873 |
| 7. Dye image stabilizer | pp. 25 | pp. 650, LC | pp. 872 |
| 8. Film hardener | pp. 26 | pp. 651, LC | pp. 874–875 |
| 9. Binder | pp. 26 | pp. 651, LC | pp. 873–874 |
| 10. Plasticizer/ Lubricant | pp. 27 | pp. 650, LC | pp. 876 |
| 11. Coating aid/ Surfactant | pp. 26–27 | pp. 650, RC | pp. 875–87 |
| 12. Anti-static agent | pp. 27 | pp. 650, RC | pp. 876–877 |
| 13. Matting agent | | | pp. 878–879 |

The amount of the photosensitive silver halide used in the photosensitive member is from 0.05 to 20g/m$^2$, and preferably from 0.1 to 10 g/m$^2$ in terms of silver.

In the present invention, an organic metal salt can also be used as an oxidizing agent together with the photosensitive silver halide. In these organic metal salts, an organic silver salt is particularly preferably used.

As an organic compound which can be used for forming the above-described organic silver salt oxidizing agent, there are benzotriazols, fatty acids and other compounds described in U.S. Pat. No. 4,500,626, columns 52 to 53 and the like. Further, acetylene silver described in U.S. Pat. No. 4,775,613 is also useful. The organic silver salt may be used in combination of two or more.

The above-described organic silver salt can be used together in an amount from 0.01 to 10 mol, and preferably from 0.01 to 1 mol per one mol of the photosensitive silver halide.

A hydrophilic binder is preferably used as the binder for the photosensitive member and constitutional layer. The examples thereof include those described in the above-described Research Disclosure and Japanese Patent Application Laid-Open (JP-A) No. 64-13546, pp. 71 to 75. Specifically, a transparent or semi-transparent hydrophilic binder is preferred, and the examples thereof include natural compounds such as proteins such as gelatin, gelatin derivative and the like or polysaccharides such as cellulose derivative, starch, gum arabic, dextran, pullulan and the like, and synthetic polymer compounds such as polyvinyl alcohol, modified polyvinyl alcohol (for example, terminal alkyl modified Poval MP103, MP 203 and the like manufactured by Kuraray Co., Ltd.), polyvinyl pyrrolidone, acrylamide polymer and the like. Further, highly water absorbing polymers described in U.S. Pat. No. 4,960,681, Japanese Patent Application Laid-Open (JP-A) No. 62-245260 and the like, namely, homopolymers of a vinyl monomer having —COOM or —$SO_3$M (M indicates a hydrogen atom or alkaline metal) or copolymers of this vinyl monomer or copolymers of this monomer with other vinyl monomer (for example, sodium methacrylate, ammonium methacrylate, Sumika Gel L-5H manufactured by Sumitomo Chemical Co., Ltd.) are also used. These binders can be used in combination of two or more. In particular, the combination of gelatin with the above-described binder is preferable. The gelatin may be selected from lime-processed gelatin, acid-processed gelatin and so-called delimed gelatin in which the content of calcium and the like is reduced, and it is also preferable to use them in combination.

In the present invention, it is appropriate that the amount coated of the binder is from 1 to 20 g/m$^2$, preferably from 2 to 15 g/m$^2$, and further preferably from 3 to 12 g/m$^2$. In this binder, the gelatin is used-in a proportion from 50% to 100%, and preferably from 70% to 100%.

The hydrophobic additives such as a coupler, color developing main chemical and the like can be introduced in the layer of a photosensitive member by known methods such as a method described in U.S. Pat. No. 2,322,027 and the like. In this case, organic solvents having high boiling point such as those described in U.S. Pat. Nos. 4,555,470, 4,536,466, 4,536,467, 4,587,206, 4,555,476, 4,536,467, 4,587,206, 4,555,476, 4,599,296, Japanese Patent Application Publication (JP-B) No. 3-62256 and the like can be used optionally together with an organic solvent having low boiling point of from 50° C. to 160° C. Further, these pigment donative couplers, high boiling point organic solvents and the like can be used in combination of two or more.

The amount of the high boiling point organic solvent is not more than 10 g, preferably not more than 5 g, and more preferably from 1 g to 0.1 g based on 1 g of the hydrophobic additive. Further, the amount is suitably not more than 1 ml, more preferably not more than 0.5 ml, and particularly preferably not more than 0.3 ml based on 1 g of the binder.

Dispersion methods using a polymerized compound described in Japanese Patent Application Publication (JP-B) No. 51-39853 and Japanese Patent Application Laid-Open (JP-A) No. 51-59943 and a method in which a fine particle dispersion is made before addition described in Japanese Patent Application Laid-Open (JP-A) No. 62-30242 can also be used.

In the case of a compound which is substantially insoluble in water, besides of using the above-described method the compound can be dispersed as a fine particle in a binder.

When a hydrophobic compound is dispersed in a hydrophilic colloid, various surfactants can be used. For example, compounds which are listed as a surfactant in pp. 37 to 38 of Japanese Patent Application Laid-Open (JP-A) No. 59-157636 and the above-described Research Disclosure can be used. Further, phosphate type surfactants described in Japanese Patent Application Nos. 5-204325, 6-19247 and OLS No. 1,932,299A can also be used.

When a color photography photosensitive material is constituted of the photosensitive material of the present invention, it is necessary to provide on a substrate a photosensitive layer which releases at least three primary colors which can conduct color reproduction by a color subtraction method, usually pigments of cyan, magenta and yellow. The photosensitive layers are endowed with photosensitivities at different photosensitive wavelength ranges for the purpose of controlling independently the amounts of developed primary colors. The photosensitive wavelength range can be set at a visible light range such as a blue light, green light and red light and one or more layers can also be set at an infrared range. Therefore, correspondence of sensitizing wavelength range with a pigment formed can be freely selected.

In the present invention, it is necessary to use a pigment generating method of coupling mode using the developing agent of the present invention in at least one layer described abode. Though it is preferable that the pigment forming method of the present invention is applied to all pigment generating layers, a pigment forming method using a so-called pre-formed die compound containing pigment parts in the molecule can also be used together in a part of layers. The site of these photosensitive layers is not restricted, however, setting is preferably effected so that transfer of a pigment formed to a pigment fixing material progresses quickly and in good balance.

As the photosensitive material of the present invention, it is also possible to provide a photosensitive layer having sensitivities in three or more wavelength ranges.

Various non-photosensitive layers such as a protective layer, primer layer, intermediate layer, filter layer, anti-halation layer and the like may be made between the above-described silver halide emulsion layers, on the most upper layer and/or lowest layer, and various auxiliary layers such as a backing layer can be made on the opposite side of the supporting substrate. Specifically, layer constitutions such as those described in the above-described publications, a primer layer described in U.S. Pat. No. 5,051,335, intermediate layers containing a solid pigment described in Japanese Patent Application Laid-Open (JP-A) Nos. 1-167838 and 61-20943, intermediate layers containing a reducing agent or DIR compound described in Japanese Patent Application Laid-Open (JP-A) Nos. 1-120553, 5-34884 and 2-64634, intermediate layers containing an electron transporting agent described in U.S. Pat. Nos. 5,017,454 and 5,139,919 and Japanese Patent Application Laid-Open (JP-A) No. 2-235044, a protective layer containing a reducing agent described in Japanese Patent Application Laid-Open (JP-A) No. 4-249245, or a layer obtained by combination thereof can be made.

The photosensitive material of the present invention can contain various dyes, however, it is necessary to select compounds which do not dye a pigment fixing material in developing. For this, it is possible to adopt a method in which a dye having high oil-solibility is incorporated by dissolution and dispersion into an organic solvent having a high boiling point, a method in which a dye which becomes colorless in developing is incorporated, and the like. Specifically, dyes described in EP No. 549489A and dyes of ExF 2 to 6 of Japanese Patent Application Laid-Open (JP-A) No. 7-152129 are listed. There can also be used a dye obtained by dispersion of a solid as described in Japanese Patent Application Laid-Open (JP-A) No. 8-101487.

Further, it is also possible that a dye is mordanted in a mordanting agent and binder previously. In this case, as the mordanting agent and dye, those known in the photography field can be used, and mordanting agents can be listed described in U.S. Pat. No. 4,500,626, columns 58 to 59, Japanese Patent Application Laid-Open (JP-A) No. 61-88256, pp. 32 to 41, Japanese Patent Application Laid-Open (JP-A) Nos. 62-244043 and 62-244036.

It is preferable that the coating layer of the photosensitive member is cured by a curing agent.

The examples of the curing agent include curing agents described in U.S. Pat. No. 4,678,739, column 41, U.S. Pat. No. 4,791,042, Japanese Patent Application Laid-Open (JP-A) Nos. 59-116655, 62-245261, 61-18942,4-218044 and the like. More specifically, aldehyde-based curing agents (formaldehyde and the like), aziridine-based curing agents, epoxy-based curing agent, vinylsulfone-based curing agents (N,N'-ethylene-bis(vinylsulfonylacetamide)ethane and the like), N-methylol-based curing agents (dimethylolurea and the like), boric acid, metaboric acid or polymer curing agents (compounds described in Japanese Patent Application Laid-Open (JP-A) No. 62-234157) are listed. These curing agents are used in an amount from 0.001 to 1 g, and preferably from 0.005 to 0.5 g per 1 g of a hydrophilic binder.

In a photosensitive material, various fogging preventing agents and photography stabilizing agents and precursors thereof can be used. The specific examples thereof include compounds described in the above-described Research Disclosure, U.S. Pat. Nos. 5,089,378, 4,500,627 and 4,614,702, Japanese Patent Application Laid-Open (JP-A) No. 64-13564, pp. 7 to 9, 57 to 71 and 81 to 97, U.S. Pat. Nos. 4,775,610, 4,626,500 and 4,983,494, Japanese Patent Application Laid-Open (JP-A) Nos. 62-174747, 62-239148, 1-150135, 2-110557 and 2-178650, RD 17643 (1978), pp. 24 to 25, and the like.

These compounds are used in an amount from $5\times10^{-6}$ to $1\times10^{-1}$ mol, and preferably from $1\times10^{-5}$ to $1\times10^{-2}$ mol per one mol of silver.

In the photosensitive member, various surfactants can be used for the objects such as coating aid, releasing improvement, sliding improvement, antistatic, development acceleration and the like. The specific examples of the surfactant are described in Known technique No. 5 (Mar. 22, 1991, published by Aztech limited company), pp. 136 to 138, Japanese Patent Application Laid-Open (JP-A) Nos. 62-173463 and 62-183457, and the like.

In the photosensitive member, organic fluoro compounds can be contained for the objects such as sliding improvement, antistatic, releasing improvement and the like. The typical examples of the organic fluoro compound include fluorine-based surfactants, such as described in Japanese Patent Application Publication (JP-B) No. 57-9053, columns 8 to 17, Japanese Patent Application Laid-Open (JP-A) Nos. 61-20944 and 62-135826, and hydrophobic fluorine compounds, such as oily fluorine-based compounds such as a fluorine oil and the like, or solid fluorine compound resins such as an ethylene tetrafluoride resin and the like. A fluorine-based surfactant having a hydrophilic group is also preferably used for sufficing both wettability of and antistatic ability of the photosensitive member.

It is preferable that the photosensitive member has sliding property. It is preferable that a sliding agent-containing layer is used in both photosensitive layer surface and backing surface. The preferred sliding property is not less than 0.01 and not more than 0.25 in terms of dynamic friction coefficient. This value is a measured value when the member is transported at 60 cm/minute against a stainless sphere having a diameter of 5 mm (25° C., RH 60% ). In this evaluation, the same level is obtained even if the subject material is replaced by a photosensitive layer surface.

The examples of the sliding agent which can be used include polyorganosiloxanes, higher fatty amides, higher fatty metal salts, esters of higher fatty acids with higher alcohols and the like, and as the polyorganosiloxane, polydimethylsiloxane, polydiethylsiloxane, polystyrylmethylsiloxane, polymethylphenylsiloxane and the like can be used. As the layer to be added, the most outer layer of an emulsion layer and a backing layer are preferable. In particular, polydimethylsixane and an ester having a log chain alkyl group are preferable. To prevent pressure fogging and decrease feeling of a silver halide, silicon oil and paraffin chloride are preferably used.

Further, in the present invention, an antistatic agent is preferably used. The examples of the antistatic agent include a carboxylic acid and carboxylate, a polymer containing a sulfonate salt, a cationic polymer, and an ionic surface active compound.

The examples of the most preferable antistatic agent include a fine particle of at least one kind of crystalline metal oxide having a volume resistivity of not more than $10^7\Omega\cdot$cm, more preferably not more than $10^5\Omega\cdot$cm and having a particle size from 0.001 to 1.0 μm selected from ZnO, $TiO_2$, $SiO_2$, $Al_2O_3$, $In_2O_3$, $SiO_2$, MgO, BaO, $MoO_3$, $V_2O_5$ or a complex oxide thereof (Sb, P, B, In, S, Si, C and the like), and a particle of a metal oxide in the form of a sol or a complex oxide thereof. The content in the sensitive material is preferably from 5 to 500 mg/$m^2$, and particularly preferably from 10 to 350 mg/$m^2$. The ration of a conductive crystalline oxide or complex oxide thereof to a binder is preferably from 1/300 to 100/1, and more preferably from 1/100 to 100/5. It is also preferable that a water resistant polymer described in Japanese Patent Application Laid-Open (JP-A) No. 8-292514 is coated on the back surface of the supporting substrate of the photosensitive member.

The constitution of the photosensitive member or a treating member described later (including a backing layer) can contain various polymer latex for the purpose of improvement of film physical properties such as dimension stability, curl inhibition, adhesion inhibition, film cracking inhibition, prevention of pressure increase and decrease feeling and the like. Specifically, any of polymer latex described in Japanese Patent Application Laid-Open (JP-A) Nos. 62-245258, 62-136648, 62-110066 and the like can be used. Especially, when a polymer latex having low glass transition temperature (not more than 40° C.) is used in a mordanting layer, cracking of the mordanting layer can be prevented, and when a polymer latex having high glass transition temperature is used in a backing layer, curl inhibition effect is obtained.

It is preferable that the photosensitive member which can be used in the present invention has matting agent. The matting agent may be added to any of an emulsion surface and a backing surface, and particularly preferably added to the most outer layer on the emulsion side. Any of a matting agent soluble in a treating solution and a matting agent insoluble in a treating solution may be permissible, and it is preferable to use both of them together. For example, polymethyl methacrylate, poly(methyl methacrylate/methacrylic acid=9/1 or 5/5 (mol ratio)), polystyrene particle and the like are preferable. The particle size thereof is preferably from 0.8 to 10 μm, it is preferable that the range of the particle size distribution is narrow, and it is preferable that not less than 90% of the total particles have a size of from 0.9 to 1.1-fold of the average particle size. Further, it is also preferable to added a fine particle having a size of not more than 0.8 μm simultaneously to enhance mat property, and for example, polymethyl methacrylate (0.2 μm), poly (methyl methacrylate/methacrylic acid=9/1 (mol ratio)) (0.3 μm), polystyrene particle (0.25 μm), colloidal silica (0.03 μm) and the like are be listed.

The specific examples are described in Japanese Patent Application Laid-Open (JP-A) No. 61-88256, page 29. In addition, a benzoguanamine resin bead, polycarbonate resin bead, AS resin bead and the like described in Japanese Patent Application Laid-Open (JP-A) Nos. 63-274944 and 63-274952 are listed. Further, compounds described in the above-described RD can be used.

These matting agents can optionally be dispersed in various binders described in the above-described binder column, and used as dispersions. In particular, various gelatins, for example, an acid-processed gelatin dispersion easily provides an stable coating solution, then, it is preferable that pH, ionic strength and binder concentration are optionally controlled to be optimum values.

Further, compounds described below can be used.

Dispersion medium of an oil-soluble organic compound: Japanese Patent Application Laid-Open (JP-A) No. 62-215272, P-3, 5, 16, 19, 25, 30, 42, 49, 54, 55, 66, 81, 85, 86, 93 (pp. 140 to 144);

latex for impregnation of an oil-soluble organic compound: latex described in U.S. Pat. No. 4,199,363;

developing main chemical oxide scavenger: compounds represented by the formula (I) in U.S. Pat. No. 4,978,606, column 2, lines 54 to 62 (particularly, I-, (1), (2), (6) and (12) (columns 4 to 5)), compounds represented by the formula in U.S. Pat. No. 4,923,787, column 2, lines 5 to 10 (particularly, compound 1 (column 3));

stain inhibitor: the formulae (I) to (III) described in EP No. 298321A, page 4, lines 30 to 33, in particular, I-47, 72, III-1 and 27 (pp. 24 to 48);

discoloring inhibitor: EP No. 298321A, A-6, 7, 20, 21, 23, 24, 25, 26, 30, 37, 40, 42, 48, 63, 90, 92, 94 and 164 (pp. 69 to 118), U.S. Pat. No. 5,122,444, columns 25 to 38, II-1 to III-23, in particular, III-10, EP No. 471347A, pp. 8 to 12, I-1 to III-4, in particular, II-2, U.S. Pat. No. 5,139,931, columns 32 to 40, A-1 to 48, in particular, A-39 and 42;

material to reduce the amount used of color developing increasing agent or color mixing inhibitor: EP No. 411324A, pp. 5 to 24, I-1 to II-15, in particular, I-46;

formalin scavenger: EP No. 477932A, pp. 24 to 29, SCV-1 to 28, in particular, SCV-8;

curing agent: Japanese Patent-Application Laid-Open (JP-A) No. 1-214845, page 17, H-1, 4, 6, 8 and 14, compounds (H-1 to 54) represented by the formulae (VII) to (XII) described in U.S. Pat. No. 4,618,573, columns 13 to 23, compounds (H-1 to 76) represented by the formula (6) described in Japanese Patent Application Laid-Open (JP-A) No. 2-21485, page 8, lower right part, in particular, H-14, compounds described in claim 1 in U.S. Pat. No. 3,325,287;

developing suppressor precursor: Japanese Patent Application Laid-Open (JP-A) No. 62-168139, P-24, 37 and 39 (pp. 6 to 7); compounds described in claim 1 of U.S. Pat. No. 5,019,492, in particular, column 7,compounds 28 and 29;

preservative, antifungus agent: U.S. Pat. No. 4,923,790, columns 3 to 15, I-1 to III-43, in particular, II-1, 9, 10, 18 and III-25;

stabilizer, fogging inhibitor: U.S. Pat. No. 4,923,793, columns 6 to 16, I-1 to (14), in particular, I-1, 60, (2) and (13), U.S. Pat. No. 4,952,483, columns 25 to 32, compounds 1 to 65, in particular, 36;

chemical sensitization agent: triphenylphosphine selenide, compound 50 in Japanese Patent Application Laid-Open (JP-A) No. 5-40234;

dyes: Japanese Patent Application Laid-Open (JP-A) No. 3-156450, pp. 15 to 18, a-1 to b-20, in particular, a-1, 12, 18, 27, 35, 36 and b-5, pp. 27 to 29, V-1 to 23, in particular, V-1, EP No. 445627A, pp. 33 to 55, F-I-1 to F-II-43, in particular, F-I-11 and F-II-8, EP No. 457153A, pp. 17 to 28, III-1 to 36, in particular III-1, 3, WO88/04794, pp. 8 to 26, Dye-1 to 124, fine particle dispersions, EP No. 319999A, pp. 6 to 11, compounds 1 to 22, in particular, compound 1, compounds D-1 to 87 represented by the formulae (1) to (3) in EP No. 519306A (pp. 3 to 28), compounds 1 to 22 represented by the formula (1) in U.S. Pat. No. 4,268,622 (columns 3 to 10), compounds (1) to (31) represented by the formula (1) in U.S. Pat. No. 4,923,788 (columns 2 to 9);

UV absorber: compounds (18b) to (18r) represented by the formula (1) in Japanese Patent Application Laid- Open (JP-A) No. 46-3335 (pp. 6 to 9), compounds (3) to (66) represented by the formula (1) (pp. 10 to 44) and compounds HBT-1 to 10 represented by the formula (III) (page 14) in EP No. 520938A, compounds (1) to (31) represented by the formula (1) in EP No. 521823A (columns 2 to 9).

The various additives described above, specifically, the curing agent, fogging inhibitor, surfactant, sliding agent, antistatic agent, latex, matting agent and the like optionally can be added to the treating member, or to both the photosensitive member and the treating member.

In the present invention, a pigment fixing material is used together with the heat developing photosensitive material to form an image by diffusion transfer of a pigment. The pigment fixing material may be coated on other substrate than that coated with the photosensitive material, or may be coated on the same substrate on which the photosensitive material is coated. Mutual relation of a photosensitive material and pigment fixing material, relation to a substrate, relation to a white reflective layer each described in U.S. Pat. No. 4,500,626 can also be applied to the present invention.

The pigment fixing material preferably used in the present invention has at least one layer containing a mordanting agent and binder. As the modranting agent, there can be used an agent known in photography filed, and specific examples thereof include mordanting agents described in U.S. Pat. No. 4,500,626, pp. 58 to 59, JP-A No. 61-88,256, pp. 32 to 41 and 1-161,236, pp. 4 to 7, mordanting agents described in U.S. Pat. Nos. 4,774,162, 4,619,883, 4,594,308 and the like. Further, pigment receptive polymer compounds described in U.S. Pat. No. 4,463,079 may also be used.

The binder used in the pigment fixing material of the present invention is preferably the above-described hydrophilic binder. Further, carageenans described in EP No. 443,529 can be preferably used, and latexs having a glass transition temperature of 40° C. or less described in JP-B No. 3-74,820 can preferably be used.

Optionally, auxiliary layers such as a protective layer, releasing layer, primer layer, intermediate layer, backing layer, curl prevention layer and the like can be provided in the pigment fixing material. Particularly, it is useful to provide a protective layer.

In the constitutional layers of the heat developing photosensitive material and pigment fixing material, there can be used a plasticizer and slippery agent, or an organic solvent having a high boiling point as a releasability improving agent between the photosensitive layer and pigment fixing material. Concrete examples thereof are described in the above-described Research Disclosure, JP-A No. 62-245,253 and the like.

Further, for the above-described object, various silicone oils (all silicone oils including dimethyl silicone oil and modified silicone oil obtained by introducing various organic groups into dimethylsiloxane) can be used. Effective examples thereof include various modified silicone oils described in Modified Silicone Oil technical data P6-18B published by Shin-Etsu Silicone Co., Ltd., particularly carboxy-modified silicone (trade name: X-22-3710) and the like.

Further, silicone oil described in JP-A Nos. 62-215,953 and 63-46,449 is also effective.

A brightening agent may also be used in the heat developing photosensitive material and pigment fixing material. It is preferable that the brightening agent is originally contained in the pigment fixing material, it is supplied from outside such as the heat developing photosensitive material and transfer solvent. Examples thereof may include compounds described in K. Veenkataraman, "The Chemistry of Synthetic Dye", v, chapter 8, JP-A No. 61-143,752 and the like. More specific examples thereof include stylbene-based compounds, cumarine-based compounds, biphenyl-based compounds, benzooxazolyl-based compounds, naphthalimide-based compounds, pyrazoline-based compounds, carbostylyl-based compounds and the like.

The brightening agent can be used in combination with a discoloring inhibitor and ultraviolet ray absorber. The concrete examples of these discoloring inhibitor, ultraviolet ray absorber and brightening agent are described in JP-A Nos. 62-215,272, pp. 125 to 137 and 1-161,236, pp. 17 to 43.

In the present invention, an image formation accelerator can be used in the heat developing photosensitive material and/or pigment fixing material. The image formation accelerator has such functions as promotion of a redox reaction of a silver salt oxidizing agent with a reducing agent, promotion of reactions such as formation or decomposition of a pigment from the pigment donative material or releasing of a diffusive pigment, and promotion of transfer of a pigment from the layer of the heat developing photosensitive material to a pigment fixing layer, and the like, and is classified from the viewpoint of physicochemical functions into a base or base precursor, nucleophilic compound, high boiling point organic solvent (oil), heat solvent, surfactant, compound having mutual action with silver or silver ion, and the like. Since these compounds have generally complex functions, they usually have several functions described above in combination. The details thereof are described in U.S. Pat. No. 4,678,739, columns 38 to 40.

Examples of the base precursor include a salt of a base and an organic acid which is de-carbonated by heating, a compound which releases amines by intramolecular nucleophilic substitution reaction, Lossen transformation or Beckmann transformation, and the like. Specific examples thereof are described in U.S. Pat. Nos. 4,514,493, 4,657,848 and the like.

In a system wherein heat development and transfer of a pigment are conducted simultaneously in the presence of a small amount of water, a method in which a base and/or base precursor is contained in the pigment fixing material is preferable in the point of increase in preservability of the heat developing photosensitive material.

In addition to the above-described methods, a combination of a poor-soluble metal compound with a compound (complex forming compound) which can effect complex forming reaction with a metal ion constituting this poor-soluble metal compound described in EP No. 210,660 and U.S. Pat. No. 4,740,445, a compound which generates a base by electrolysis described in JP-A No. 61-232,451, and the like can also be used as the base precursor. Particularly, the former method is effective. It is advantageous that the poor-soluble metal compound and complex forming compound are added separately to the heat developing photosensitive material and pigment fixing material as described in the above-described patents.

In the present invention, various development stopping agents can be used in the heat developing photosensitive material and/or pigment fixing material for the purpose of obtaining always a constant image against variations in treating temperature and treating time upon development.

The development stopping agent is a compound which quickly neutralizes or reacts with a base to decrease concentration of the base in a film for stopping the development, or which effect mutual reaction with silver or silver salt for suppressing the development, after suitable development. Concrete examples thereof include an acid precursor which releases an acid by heating, an electrophic compound which generate substitution reaction with a based coexisting by heating, or a nitrogen-containing heterocyclic compound, mercapto compound and precursors thereof. The further details thereof are described in U.S. Patent No. 62-253,159, pp. 31 to 32.

In the present invention, as the substrate of the heat developing photosensitive material and pigment fixing material, those which can endure the treating temperature can be used. In general, substrates for photography such as paper, synthetic polymer (film) and the like described in "Base for Photographic Technology chapter of silver salt photography" Corona Corp., pp. 223 to 240, can be listed. Specific examples thereof which can be used include films composed of polyethylene terephthalate, polyethylene naphthalate, polycarbonate, poly vinyl chloride, polystyrene, polypropylene, polyimide or celluloses (for example, triacetylcellulose) or such films containing a pigment such as titanium oxide and the like, and film method synthetic paper made from polypropylene, mixed paper made from natural pulp and synthetic resin pulp such as polyethylene and the like, Yankee paper, baryta paper, coated paper (particularly, cast-coated paper), metal, fabrics, glasses and the like.

These may be used alone, or may be used in the form of a substrate of which one side or both sides are laminated with a synthetic polymer such as polyethylene and the like. This laminated layer can optionally contain a pigment and dye such as titanium oxide, ultramarine blue pigment, carbon black and the like.

In addition to them, substrates described in JP-A Nos. 62-253,159, pp. 29 to 31, JP-A No. 1-61,236, pp. 14 to 17, JP-A Nos. 63-316,848, 2-22,651, 3-56,955, U.S. Pat. No. 5,001,033 and the like can be used.

The back surface of this substrate may be coated with a hydrophilic binder and a semiconductive metal oxide such as alumina sol and tin oxide, carbon black and other antistatic agents. Specifically, substrates which are described in JP-A No. 63-220,246 and the like can be used.

Further, the front surface of the substrate is preferably subjected to various surface treatments and primer coating for the purpose of improving adhesion with the hydrophilic binder.

For exposure and recording of an image on the heat developing photosensitive material, there are, for example, methods in which scenery and people are directly photographed using a camera, methods in which exposure is effected through a reversal film or negative film using a printer and projector, methods in which scanning exposure of an original image is effected through a slit and the like using an exposing apparatus of a copy machine, a method in which light emission is effected from an emission diode, various lasers (laser diode, gas laser) and the like via electric signals and scanning exposure is conducted on an image information (methods described in JP-A Nos. 2-129625, 5-176114, 5-199372, 6-127021 and the like), methods in which an image information is output on image showing apparatus such as CRT, liquid crystal display, electroluminescence display, plasma display and the like, and exposure is effected directly or with an optical system, and the like.

As the light source for recording an image on the heat developing photosensitive material and exposing methods, natural light, tungsten lamp, light emitting diode, laser light source, CRT light source and the lie, as described in U.S. Pat. No. 4,500,626, column 56, JP-A Nos. 2-53,378 and 2-54,672 can be used.

Further, image exposure can also be conducted using a wavelength converting element which is obtained by combining a non-linear optical material with a coherent light source such as laser light and the like. The non-liner optical material is a material which can manifest non-linear characteristic between electric field and polarization which occurs when strong light electric field such as laser light is imparted, and there are preferably used inorganic compounds represented by lithium niobate, potassium dihydrogen phosphate (KDP), lithium iodate, $BaB_2O_4$ and the like, urea derivatives, nitroaniline derivatives, for example, nitropyridine-N-oxide derivatives such as 3-methyl-4-nitropyridine-N-oxide (POM), compounds described in JP-A Nos. 61-53462 and 62-210432. As the form of the wavelength converting element, monocrystalline light directing route type, fiber type and the like are known, and all of them are effective.

Further, the above-described image information can utilize image signals obtained from a video camera, electronic still camera and the like, television signals such as represented by that stipulated by Nippon Television Signal Criteria (NTSC), image signals obtained by dividing an original image into many picture elements such as a scanner, and image signals made by a computer represented by CG, CAD.

The heat developing photosensitive material and/or pigment fixing material of the present invention may adopt form having an electroconductive heat generating layer as a heating means for heat development diffusion transfer of a pigment. As the heat generating element in this case, those described in JP-A No. 61-145544 and the like can be used.

The heating temperature in the heat developing is from about 50 to 250° C., and a temperature from about 60 to 180° C. is particularly useful. The diffusion transfer process of a pigment may be conducted simultaneously with the heat development or may be conducted after completion of the heat development process. In the latter case, it is preferable that the heating temperature in the transfer process is particularly 50° C. or higher and lower than the temperature in the heat developing-process by about 10° C., though the transfer process can be conducted at from room temperature to the temperature in the heat developing process.

Though movement of a pigment is caused only by heat, a solvent may be used to promote the pigment movement. A method is also useful in which development ant transfer are conducted simultaneously or continuously by heating in the presence of a small amount of solvent (especially, water) described in U.S. Pat. Nos. 4,704,345, 4,740,445, JP-A No. 61-238,056 and the like. In this method, the heating temperature is preferably 50° C. or higher and not more than boiling point of the solvent. For example, when the solvent is water, it is preferably from 50 to 100° C., and more preferably from 60 to 100° C. When the heating temperature is less than 50° C., promotion of pigment migration is insufficient, and transfer in a short period of time becomes difficult, and when over 100° C., generation of bubble accompanying steep vaporization of water cause image defects, therefore, both ranges are not preferable.

The heating time can be suitably selected in relation to the heating temperature, and in general, about 5 to 60 seconds is preferable. When it is 5 seconds or shorter, image forming reaction is unstable, and when over 60 seconds, the reaction is not successful in quickness.

Examples of the solvent used for promotion of development and/or diffusion transfer of a pigment include water, an aqueous basic solution containing an inorganic alkaline metal salt and/or an organic base (as these bases, those described in the column of the image formation promoter can be used), a solvent having a low boiling point, or a mixed solvent of the solvent having a low boiling point and water or the above-described aqueous basic solution. Further, the solvent may contain a surfactant, fogging inhibitor, compound which forms a complex with a poor-soluble metal salt, antifungal agent and antimicrobial agent.

As the solvent used in these heat developing and diffusion transfer, water is preferably used, and any water usually used may be used. Specifically, distilled water, tap water, well water, mineral water and the like can be used. Further, in a heat developing apparatus using the heat developing photosensitive material and pigment fixing material of the present invention, water may be used without recycling or may be recycled and used repeatedly. In the latter case, water containing components eluted from wood shall be used. There may also be used apparatuses and water described in JP-A Nos. 63-144,354, 63-144,355, 62-38,460, 3-21,055 and the like.

These solvents may be added to the heat developing photosensitive material, pigment fixing material or both of them. The amount used thereof may be not more than the weight of solvent corresponding to the maximum swollen volume of the total coated film and preferably is an amount of 1/10 to 1-fold of that of a solvent corresponding to the maximum swelling volume.

As this method for imparting water, there are preferably used methods described in JP-A Nos. 62-253,159, pp. 5,63-85,544, Japanese Patent Application No. 8-181,045 and the like. It is also possible that a solvent is enclosed in a micro capsule, or a solvent is previously contained in the heat developing photosensitive material or pigment fixing element or both of them in the form of a hydrate.

The temperature of water added may be from 30 to 60° C. as described in JP-A No. 63-85,544 and the like. Particularly, it is useful that the temperature is 45° C. or higher for the purpose of preventing proliferation of contaminant bacteria in water.

To promote pigment movement, a hydrophilic hot solvent which is solid at ambient temperature and is dissolved at high temperature can be contained in the heat developing photosensitive material and/or pigment fixing material. The layer which contains the solvent may be any of a photosensitive silver halide emulsion layer, intermediate layer, protective layer and pigment fixing layer, and a pigment fixing layer and/or adjacent layer thereof is preferable.

Examples of the hydrophilic hot solvent include ureas, pyridines, amides, sulfonamides, imides, alcohols, oximes and other heterocyclic rings.

Examples of heating method in the development and/or transfer process include contact to a heated block and plate, contact to a heat plate, hot presser, heat roller, heat drum, halogen lamp heater, infrared and far infrared lamp heaters and the like, passing through high temperature atmosphere, and the like. For laminating the heat developing photosensitive material and pigment fixing material, there can be adopted methods described in JP-A Nos. 62-253,159, 61-147,244 p. 27 and the like.

For treatment of the photographic element of the present invention, any of various heat developing apparatuses. For examples, apparatuses described in JP-A Nos. 59-75,247, 59-177,547,59-181,353, 60-18,951, 62-25,944, 6-130,509, 6-95,338, and 6-95,267 and the like are preferably used. As the commercially available apparatus, there can be used PICTOROSTAT 100, 200, PICTOROGRAPHY 3000, 2000 manufactured by Fuji Photo Film Co., Ltd., and the like.

When an image obtained from the above-described photosensitive material and pigment fixing element is used as a color proof for printing, the method for concentration expression thereof may be conducted by any of a continuous gradation control method, area gradation control method utilizing parts of discontinuous concentration, or a gradation control method obtained by combining them.

When LD or LED is used as a light source, output of a digital signal is possible. By this, a using method in which control of design and hue of a print is conducted on CRT and a color proof is output as final output (DDCP) is possible. Namely, DDCP is an effective means for conducting output of a proof efficiently in the field of a color proof. The reason for this is that a color printer has relatively simple structure and is inexpensive, and by using the color printer, as is well known, production of a preparation film for a color printer and production of a press plate (PS plate) and the like are not necessary, therefore, a hard copy obtained by forming an image on a sheet can be easily produced in a short period of time for several times.

When LD or LED is used as a light source, it is preferable that three spectral sensitivities of yellow, magenta and cyan, four spectral sensitivities of yellow, magenta, cyan and black, or, for the purpose of obtaining desirable hue, spectral sensitivities of respective colors obtained by mixing two or more pigments, have respective peaks of the spectral sensitivities at separate wavelengths respectively apart by 20 nm or more. Further, as other method, when spectral sensitivities of two or more different colors have difference by 10 times or more, there is also adopted a method in which an image of two or more colors is obtained by one radiation wavelength.

Next, a method for reproducing moire of a print by a color printer is described below.

To produce a color proof for printing which correctly reproduces moire and the like appearing on a print of high resolution by a color printer of low resolution, respective net point area ration data aj of a CMYK4 size plate are converted to 48800DPI bit map data b'j respectively by referring to a threshold matrix 24. Then, area ratio ci of each color is counted by referring simultaneously to bit map data b'j in given range. Then, primary three stimulation value data X, Y, Z of 1600 DPI which show measured value data of the above-described respective colors previously calculated are calculated. Secondary three stimulation value data X', Y', Z' of 400 DPI are calculated by conducting anti-areazing filter treatment against this primary three stimulation value data X, Y, Z. These calculated data are used as input data for the color printer. (This is described in Japanese Patent Application No. 8-192540 in detail.)

When color image recording is conducted using an output apparatus such as a color printer and the like, it is possible, for example, that a color image having desired color is realized by manipulating color signals of yellow, magenta, cyan. However, since the color signals depend on output property of an output apparatus, it is necessary that a color signal supplied from an extraneous apparatus having different property is subjected to color converting treatment with considering the above-described output property.

Then, a plurality of known color patches having different colors are produced by using the output apparatus, and the color of the above-described color patch is measured, to obtain, for example, conversion relation (hereinafter, referred to as orderly conversion relation) in which known color signals CMY of the above-described color patch are converted to stimulation value signals XYZ which do not depend on the output apparatus, then conversion relation (hereinafter, referred to as reverse conversion relation) by which stimulation value signals XYZ are converted to color signals CMY is calculated utilizing the orderly conversion relation, and the above-described color conversion treatment is conducted using this reverse conversion relation.

Herein, the following three examples are listed as a method for calculating color signals CMY from the stimulation value signals, however, examples of the present invention are not limited to them.

(1) A tetrahedral in which four stimulation value signals XYZ constitute respective summits is made, space of the stimulation value signals XYZ is divided by this tetrahedron, and space of color signals CMY is also divided by the tetrahedron in the same manner, and color signals CMY against any stimulation value signals XYZ in corresponding tetrahedron are calculated by liner computing.

(2) Color signals CMY against any stimulation value signals XYZ are calculated by repeated computing using the Newton method (see, PHOTOGRAPHIC SCIENCE AND ENGINEERING Volume 16, Number 2. March-April 1972 pp. 136–143 "Metameric color matching in subtractive color photography").

(3) A color conversion method which converts color signals from Table 1 color group to Table 2 color group, comprising first step in which relation of real color signals in the Table 1 color group obtained from known real color signals in the Table 2 color group is found as first orderly conversion relation, second step in which hypothesis color signals are set outside the area composed of the real color signals by approximating the first orderly conversion relation by monotone function, third step in which relation of the color signals in the Table 1 color group obtained by color signals composed of the real color signals and hypothesis color signals in the Table 2 color group is found as the second orderly conversion relation, and forth step in which relation of color signals in the Table 1 color group is found as reverse conversion relation using a repeated computing method from the second conversion relation, and a color signal is converted using the reverse conversion relation. Namely, by this conversion method, in a color conversion method which convert color signals from Table 1 color group to Table 2 color group, real color signals (for example, XYZ color signals) in Table 1 color group corresponding to known real color signals (for example, CMY color signals) in Table 2 color group is found, then, the first orderly conversion relation between these real color signals is approximated by a monotone function, and hypothesis color signals are set outside the area composed of the real color signals. Then, according to the second orderly conversion relation between Table 1 color group and Table 2 color group respectively composed of the real color signals and hypothesis color signals, reverse conversion relation is found which effect conversion to the Table 1 color group and the Table 2 color group by repeated computing represented by the Newton method, and color conversion is conducted using this reverse conversion relation. Further, other-methods than this are also listed.

The size of an image obtained from the heat developing photosensitive material and pigment fixing element may be any of A line book size, A1 to A6, octavo (kiku size), B line book size, B1 to B6, four-six size. The size of the heat developing photosensitive material and pigment fixing element may be any size in the width range from 100 mm to 2000 mm, corresponding to the above-described size.

For heat developing photosensitive material and pigment fixing element, the raw materials may be supplied in the form of either roll or sheet, and it is also possible that only one of them is in the form of roll, and other is in the form of sheet.

The treating material layer of the treating member used in the prevent invention contains at least a base and/or base precursor.

As the base, and inorganic or organic base can be used. The examples of the inorganic based include hydroxides, phosphates, carbonates, borates and organic acid salts described in Japanese Patent Application Laid-Open (JP-A) No. 62-209448, and acetylides of alkaline metal or alkaline earth metal, and the like described in Japanese Patent Application Laid-Open (JP-A) No. 63-25208.

The examples of the organic based include ammonia, aliphatic or aromatic amines (for example, primary amines, secondary amines, tertiary amines, polyamines, hydroxylamines, heterocyclicamines), amidines, bis or tris or tetraamidine, guanidines, water-insoluble mono, bis, tris or tetraguanidines, hydroxides of quaternary ammonium, and the like.

As the base precursor, decarboxylated type, decomposition type, reaction type and complex salt-formind type precursors can be used.

In the present invention, as described in EP No. 210,660 and U.S. Pat. No. 4,740,445, it is effective to adopt a method in which a base is generated by combining as the base precursor a basic metal compound poorly soluble in water with a compound which can cause a complex forming reaction (referred to as complex forming compound) using as a medium a metal ion and water constituting this basic basic metal compound. In this case, it is desirable that the basic metal compound poorly soluble in water is added to the photosensitive member and the complex forming compound is added to the treating member, however, the reverse structure is possible.

The amount used of the base or base precursor is from 0.1 to 20 g/m$^2$, and preferably from 1 to 10 g/m$^2$.

As the binder of constituting the pigment fixing material, the same hydrophilic polymer as that for photosensitive materials can be used.

It is preferable that the pigment fixing material is cured by a curing agent like the photosensitive material. As the curing agent, the same compound as that for the photosensitive material can be used.

In the present invention, it is also permissible that a development terminating agent or a precursor of the development terminating agent is contained in a pigment fixing material, and the development terminating agent may be allowed to act simultaneously with development or in delayed timing.

By using the photosensitive material of the resent invention comprising the color coupler of the present invention, a contained developing agent and a silver halide particle having uniform composition, a color image having high sensitivity and high image quality can be formed simply and quickly at low cost, and the material can be applied in various fields as described above, and according to the method for forming a color image of the present invention using the same, an image which has high image quality and is cheap can be formed.

EXAMPLES

The following examples further illustrate the present invention in detail, but do not limit the scope thereof.

Example 1

First, a method for producing a photosensitive silver halide emulsion is described.

Photosensitive silver halide emulsion (for blue sensitive emulsion layer)

1200 ml of distilled water was prepared in a reaction vessel, and to this was dissolved 60 g of lime-processed gelatin and 4.9 g of potassium bromide and dissolved at 40° C. To this solution 5 mg of N,N'-dimethylimidazolidine-2-thione was added and the mixture was heated to 76° C. Then, 260 ml of an aqueous solution containing 36.3 g of silver nitrate and 260 ml of an aqueous solution containing 22.1 g of potassium bromide were added with vigorous stirring over 30 minutes. 2 minutes after the completion of the addition, 100 ml of an aqueous solution containing 1.7 g of potassium iodide was added to a reaction vessel. After five minutes, 350 ml of an aqueous solution containing 133.6 g of silver nitrate and 350 ml of an aqueous solution containing 95.1 g of potassium bromide were added with vigorous stirring over 28 minutes. After the completion of the addition, the mixture was kept at 76° C. for 10 minutes, then, cooled down to 35° C.

pH of the solution was lowered to 3.8, and de-salting was conducted by a normal method using a polymer coagulating agent. Then, by adding to this 50 g of lime-treated ossein gelatin and 0.1 mg of benzoisothiazolone, pH was controlled to 6.1, pAg was controlled to 8.4 and the temperature was controlled to 60° C. 150 mg of a nucleic acid decomposed material and 0.96 mg of sodium thiosulfate were added and chemical sensitization was conducted optimally, then, 120 mg of 3-methylureidophenyl-mercaptotetrazole and 500 mg of a spectral sensitizing pigment (b1) described below were added, and the mixture was cooled. Thus prepared emulsion was named an emulsion B1.

According to observation by an electron microscope, the emulsion B1 was composed of a silver halide particle in the form of a bulk partially containing round shape having an average particle size of 0.53 μm, and had a variation coefficient of particle size of 22%. Halogen composition of each particle was measured according to an EPMA method regarding this emulsion, to find that the average silver iodide content was 1.1% and the variation coefficient of silver iodide content distribution between particles was 34%.

Pigment (b1)

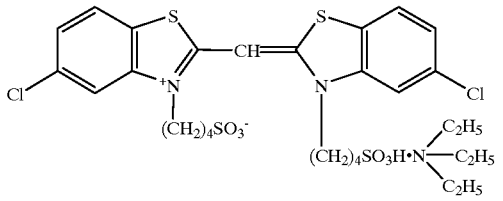

An emulsion B2 was prepared in the same manner as for the emulsion B1 only excepting that the amount added of the potassium bromide solution was controlled so that the silver potential in the reaction vessel was maintained at −60 mV, measured by using a silver/saturated calomel electrode in forming a silver halide particle. According to observation by an electron microscope, the emulsion B2 was composed of a silver halide particle in the form of octahedron having an average particle size of 0.51 μm, and had a variation coefficient of particle size of 14%. Halogen composition of each particle was measured in the same manner as for the emulsion B1, to find that the average silver iodide content was 1.0% and the variation coefficient of silver iodide content distribution between particles was 17%.

1200 ml of distilled water was prepared in a reaction vessel, and to this was dissolved 35 g of lime-processed gelatin and 2.4 g of sodium chloride and dissolved at 40° C. To this solution was added 25 mg of N,N'-dimethylimidazolidine-2-thione and the mixture was heated to 52° C. Then, 260 ml of an aqueous solution containing 63.7 g of silver nitrate and 260 ml of an aqueous solution containing 22.1 g of sodium chloride were added with vigorous stirring over 45 minutes. 5 minutes after the completion of the addition, 250 ml of an aqueous solution containing 106.2 g of silver nitrate, and 250 ml of an aqueous solution containing 6 mg of potassium hexacyano ferrate (II) 3-hydrate and 6 μg of potassium hexachloro iridate (IV) were added with vigorous stirring over 28 minutes. After the completion of the addition, the mixture was kept at 52° C. for 10 minutes, then, cooled down to 35° C.

The pH of the solution was lowered to 3.8, and de-salting was conducted by a normal method using a polymer coagulating agent. Then, to this was added 70 g of lime-treated ossein gelatin and 0.1 mg of benzoisothiazolone, pH was controlled to 6.8, pAg was controlled to 7.6 and the temperature was controlled to 50° C. 24 ml of an aqueous solution containing 2.4 g of potassium bromide was added, then, to this was added 250 mg of a nucleic acid decomposed material and 1.9 mg of triethylthiourea and chemical sensitization was conducted optimally, then, 150 mg of 3-methylureidophenyl-mercaptotetrazole and 500 mg of a spectral sensitizing pigment (b2) described below were added, and the mixture was cooled. Thus prepared emulsion was named an emulsion B3.

According to observation by an electron microscope, the emulsion B3 was composed of a silver halide particle in the form of a cube having an average particle size of 0.55 μm, and had a variation coefficient of particle size of 12%. Halogen composition of each particle was measured according to an EPMA method, to find that the average silver iodide content was 2.2% and the variation coefficient of silver iodide content distribution between particles was 32%.

Pigment (b2)

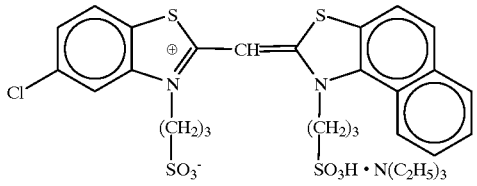

An emulsion B4 was prepared in the same manner as for the emulsion B3 excepting that potassium bromide added before the chemical sensitization was substituted by a silver bromide fine particle emulsion having a particle size of 0.05 μm in an amount of 2.2 g in terms of silver.

According to observation by an electron microscope, the emulsion B4 was composed of a silver halide particle in the form of a cube having an average particle size of 0.55 μm, and had a variation coefficient of particle size of 12%. Halogen composition of each particle was measured in the same manner as for the emulsion B3, to find that the average silver iodide content was 2.3% and the variation coefficient of silver iodide content distribution between particles was 14%.

Next, a method for preparing a hydrophobic additive dispersed in gelatin will be described below. 9.14 g of the exemplified compound C-3 as a yellow dye forming coupler, 3.92 g of the exemplified compound (22) as a developing agent and 0.85 g of a developing agent (d1) described below were dissolved at 70° C. in 15.0 g of an organic solvent (4) having high boiling point and 40 ml of ethyl acetate. This solution was added to 200 g of a 7% gelatin aqueous solution containing 1.0 g of sodium dodecylbenzenesulfonate kept at 60° C., then, the mixture was dispersed to provide an emulsion for 10 minutes by a homogenizer at 10000 rpm.

Developing agent (d1)

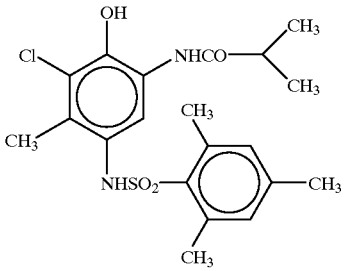

Solvent having high boiling point (4)

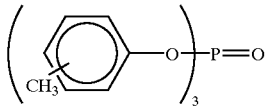

Next, zinc hydroxide dispersed in gelatin was prepared according to recipe shown in Table 1. Namely, components were mixed and dissolved, then, dispersed by a mill for 30 minutes using a glass bead having an average particle size of 0.75 mm. Further, the glass bead was separated and removed to obtain a uniform dispersed material.

TABLE 1

| | Composition of dispersed material |
|---|---|
| Zinc hydroxide | 15.9 g |
| Carboxymethyl cellulose | 0.7 g |
| Poly sodium acrylate | 0.07 g |
| Lime-processed gelatin | 4.2 g |
| Water | 100 ml |
| Preservative (2) | 0.4 g |

Preservative (2)

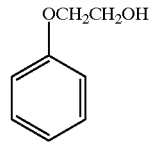

Next, polymer latex (a) dispersed in gelatin was prepared according to recipe shown in table 2. Namely, to a mixed solution containing polymer latex (a), a surfactant and water in amounts shown in table 2, an anionic surfactant was added over 10 minutes, to obtain a uniform dispersed material. Further, the resulted dispersed material was subjected to dilution by water and concentration repeatedly using a ultrafiltration module (ultrafiltration module manufactured by asahi chemical industry, co., Ltd.: Acv-3050), to make the salt concentration in the dispersed material to ⅙ of the original.

TABLE 2

| | Composition of dispersed material |
|---|---|
| Polymer latex (a) aqueous solution (solid content: 13%) | 108 ml |
| Surfactant (5) | 20 g |
| Surfactant (6) | 600 ml |
| Water | 1232 ml |

Polymer latex (a)

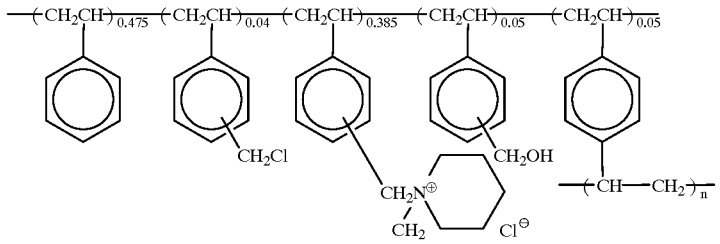

Surfactant (5)

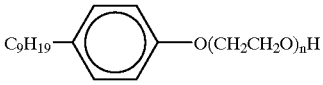

n = 50

Surfactant (6)

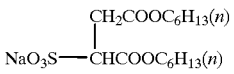

Next, a method for preparing a matting agent dispersed in gelatin, added into a protecting layer will be described below. A solution prepared by dissolving PMMA in methylene chloride was added into gelatin together with a small amount of a surfactant, and the mixture was dispersed with stirring at high speed. Then, methylene chloride was removed using a vacuum solvent removing apparatus to obtain a uniform dispersed material having an average particle size of 4.3 μm.

The dispersed material of the silver halide emulsion B1, the emulsified dispersed material of a yellow dye forming coupler, the dispersed material of zinc hydroxide, and the dispersed material of the polymer latex and the dispersed material of the matting agent as prepared above were combined, and coated with the protecting layer to make compositions shown in table 3, to make a photosensitive material 101.

TABLE 3

Main material constitution of photosensitive material 101

| Layer | Name of layer | Additive | Amount added ($mg/m^2$) |
|---|---|---|---|
| Third layer | Protective layer | Acid-processed gelatin | 387 |
| | | Matting agent (PMMA resin) | 17 |
| | | Surfactant (2) | 6 |
| | | Surfactant (3) | 20 |
| | | Polymer latex (a) dispersion | 10 |
| Second layer | Intermediate layer | Lime-processed gelatin | 862 |
| | | Anti-fogging agent | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 5 |
| | | Zinc hydroxide | 320 |
| | | Calcium nitrate | 6 |
| First layer | Blue sensitive layer | Lime-processed gelatin | 587 |
| | | Photosensitive silver halide emulsion B1 | 399 |
| | | Yellow dye forming coupler C-3 | 366 |
| | | Developing agent (22) | 157 |
| | | Developing agent (d1) | 35 |
| | | Anti-fogging agent (2) | 15 |
| | | Solvent having a high boiling point (4) | 433 |
| | | Surfactant (1) | 12 |
| | | Water-soluble polymer (1) | 40 |

Substrate (a substrate obtained by depositing aluminum on PET providing a thickness of 20 μm, and further by applying a gelatin primer on the surface thereof.)

The amount coated of the silver halide was expressed in terms of the amount of silver.

The photosensitive materials 102 to 104 were produced in the same manner only excepting the composition of the first layer was changed as described below.

A photosensitive material 102 was prepared in the same manner as for the photosensitive material 101 except that the composition of the first layer of the photosensitive material 101 was changed as described in the following table 4, a photosensitive material 103 was prepared in the same manner as for the photosensitive material 101 except that the composition of the first layer of the photosensitive material 101 was changed as described in the following table 5, and a photosensitive material 104 was prepared in the same manner as for the photosensitive material 101 except that the composition of the first layer of the photosensitive material 101 was changed as described in the following table 6, respectively.

TABLE 4

Photosensitive material
main material constitution of first layer of 102

| First layer | | |
|---|---|---|
| Blue sensitive layer | Lime-processed gelatin | 587 |
| | Photosensitive silver halide emulsion B2 | 399 |
| | Yellow dye forming coupler C-3 | 366 |
| | Developing agent (22) | 157 |
| | Developing agent (d1) | 35 |
| | Anti-fogging agent (2) | 15 |
| | Solvent having a high boiling point (4) | 433 |
| | Surfactant (1) | 12 |
| | Water-soluble polymer (1) | 40 |

TABLE 5

Photosensitive material
main material constitution of first layer of 103

| First layer | | |
|---|---|---|
| Blue sensitive layer | Lime-processed gelatin | 587 |
| | Photosensitive silver halide emulsion B3 | 399 |
| | Yellow dye forming coupler C-3 | 366 |
| | Developing agent (22) | 157 |
| | Developing agent (d1) | 35 |
| | Anti-fogging agent (2) | 15 |
| | Solvent having a high boiling point (4) | 433 |
| | Surfactant (1) | 12 |
| | Water-soluble polymer (1) | 40 |

TABLE 6

Photosensitive material
main material constitution of first layer of 104

| First layer | | |
|---|---|---|
| Blue sensitive layer | Lime-processed gelatin | 587 |
| | Photosensitive silver halide emulsion B4 | 399 |
| | Yellow dye forming coupler C-3 | 366 |
| | Developing agent (22) | 157 |
| | Developing agent (d1) | 35 |
| | Anti-fogging agent (2) | 15 |
| | Solvent having a high boiling point (4) | 433 |
| | Surfactant (1) | 12 |
| | Water-soluble polymer (1) | 40 |

Surfactant (2)

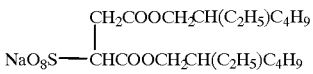

Surfactant (3)

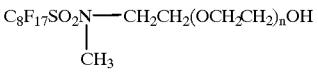

Curing agent (1)

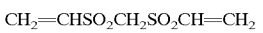

Anti-fogging agent (4)

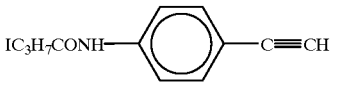

Reducing agent (1)

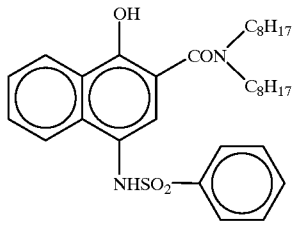

Solvent having high boiling point (2)

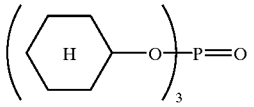

Solvent having high boiling point (5) $C_{26}H_{48.9}Cl_{7.1}$ (enpara 40 manufactured by ajinomoto co., Inc.)

Surfactant (1)

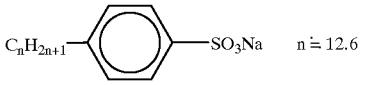

Surfactant (4)

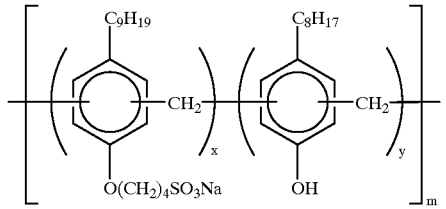

x:y = 4:6
m ≒ 6.8

Water-soluble polymer (1)

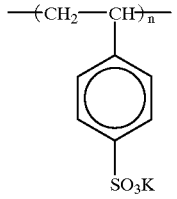

Intrinsic viscosity [η]=1.6

(0.1N NaCl, 30° C.)

Molecular weight≈1,000, 000

Anti-fogging agent (2)

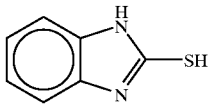

A pigment fixing element R101 having structure shown in tables 7 and 8 was prepared.

TABLE 7

Structure of pigment fixing element r101

| Number of layer | Additive | Amount coated (mg/m$^2$) |
|---|---|---|
| Sixth layer | Water-soluble polymer (1) | 130 |
| | Soluble polymer (2) | 35 |
| | Soluble polymer (3) | 45 |
| | Potassium nitrate | 20 |
| | Anionic surfactant (1) | 6 |
| | Anionic surfactant (2) | 6 |
| | Ampholytic surfactant (1) | 50 |
| | Stain preventing agent (1) | 7 |
| | Stain preventing agent (2) | 12 |
| | Matting agent (1) | 7 |
| Fifth layer | Gelatin | 250 |
| | Soluble polymer (1) | 25 |
| | Anionic surfactant (3) | 9 |
| | Curing agent (1) | 185 |
| Forth layer | Mordanting agent (1) | 1850 |
| | Soluble polymer (2) | 260 |
| | Soluble polymer (4) | 1400 |
| | Latex dispersed material (1) | 600 |
| | Anionic surfactant (3) | 25 |
| | Nonionic surfactant (1) | 18 |
| | Guanidine picolinate | 2550 |
| | Sodium quinolinate | 350 |
| Third layer | Gelatin | 370 |
| | Mordanting agent (1) | 300 |
| | Anionic surfactant (3) | 12 |
| Second layer | Gelatin | 700 |
| | Mordanting agent (1) | 290 |
| | Soluble polymer (1) | 55 |
| | Soluble polymer (2) | 330 |
| | Anionic surfactant (3) | 30 |
| | Anionic surfactant (4) | 7 |
| | Organic solvent having a high boiling point (1) | 700 |
| | Brightening agent (1) | 30 |
| | Stain preventing agent (3) | 32 |
| | Guanidine picolinate | 360 |
| | Potassium pocolinate | 45 |
| First layer | Gelatin | 280 |
| | Soluble polymer (1) | 12 |
| | Anionic surfactant (1) | 14 |
| | Sodium metaborate | 35 |
| | Curing agent (1) | 185 |

Paper substrate laminated with polyethylene (having a thickness of 215 μm)

The amount coated of the latex dispersed material is an amount coated of latex solid components.

TABLE 8

Constitution of substrate

| Name of layer | Composition | Thickness of film (μm) |
|---|---|---|
| Primer layer on surface | Gelatin | 0.1 |
| PE layer on surface (glossy) | Low density polyethylene (density: 0.923): 90.2 parts<br>Surface-treated titanium | 36.0 |

TABLE 8-continued

| Name of layer | Constitution of substrate: Composition | Thickness of film (μm) |
|---|---|---|
| | oxide: 9.8 parts<br>Ultramarine: 0.001 part | |
| Pulp layer | High quality paper (LBKP/NBSP = 6/4: density: 1.053) | 152.0 |
| Pe layer on rear surface (mat) | High density polyethylene (density: 0.955) | 27.0 |
| Primer layer on rear surface | Styrene/acrylate copolymer<br>Colloidal silica<br>Poly sodium styrene sulfonate | 0.1 |
| | | 215.2 |

Anionic surfactant (1)

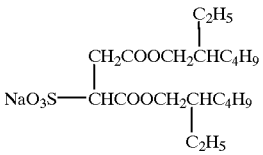

Anionic surfactant (2)

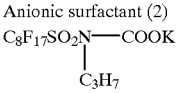

Anionic surfactant (3)

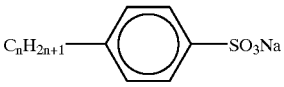

n ≈ 12.6

Anionic surfactant (4)

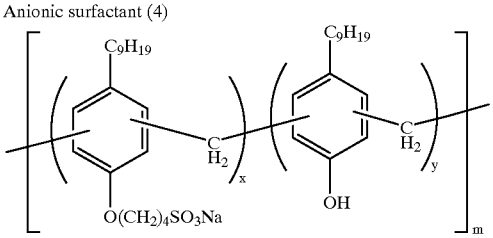

x:y = 4:6 m ≈ 6.8

Nonionic surfactant (1)

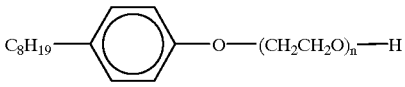

n = 85

Ampholytic surfactant (1)

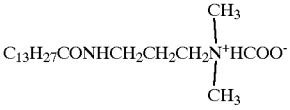

Brightening agent (1)

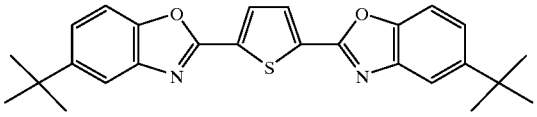

-continued

Mordanting agent (1)

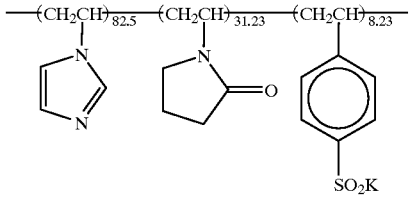

Stain preventing agent (1)

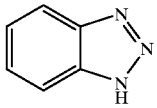

Stain preventing agent (2)

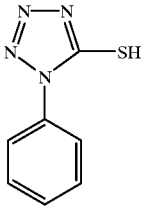

Stain preventing agent (3)

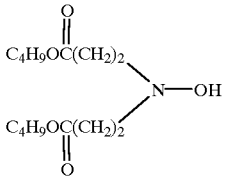

Organic solvent having a high boiling point (1) $C_{26}H_{46.9}Cl_{7.1}$ (enpara 40 manufactured by ajinomono co, inc.)

Water-soluble polymer (1)

Sumika gel 15-h (manufactured by Sumitomo chemical Co., Ltd.)

Water-soluble polymer (2)

Dextran (having a molecular weight of 70,000)

Water-soluble polymer (3)

K-carageenan (manufactured by Taito k. K.)

Water-soluble polymer (4)

MP polymer MP-102 (manufactured by Kuraray co., Ltd.)

Water-soluble polymer (5)

Acryl moldied copolymer of-polyvinyl alcohol (degree of modification: 17%)

Latex dispersed material

LX-438 (menufactured by Nippon zeon k. K.)

Mat agent (1)

SYLOID79 (manufactured by Fuji devidson chemical corp.)

Mat atent (2)

PMMA particle (average particle size: 4 μm)

Curing agent (1)

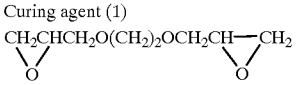

The photosensitive materials 101 to 104 were exposed to a light at 2500 lux for 1/50 seconds through an optical wedge and a blue filer. Then water in an amount corresponding to 5 ml per 1 $m^2$ (amount corresponding to about 0.40-fold of the amount of water required for the maximum swelling of the whole coated film of the photosensitive material and the pigment fixing material) was imparted to the surface of the photosensitive material, and laminated with the above-describe pigment fixing material and the laminate was heated at 80° c. for 30 seconds, then, they were released. On the released pigment fixing material, a brilliant yellow wedge-formed image was formed.

Then, the amount of water imparted to the photosensitive material after exposure was changed to 4 ml (amount corresponding to about 0.32-fold) and 6 ml (amount corresponding to about 0.48-fold) per 1 $m^2$, and a pigment image was formed on the pigment fixing material in the same manner.

The reflection of the pigment image formed on the pigment fixing material was measured, to obtain a so-called specific curve. Using this specific curve, the minimum concentration, the maximum concentration and the shoulder concentration of the specific curve (color developing concentration corresponding to an exposing amount which is lower by 0.6 logE than the exposing amount giving a concentration which is higher by 0.5 than the minimum concentration) were measured. The results are shown in table 9.

TABLE 9

| Photosensitive material | | | 101 | 102 | 103 | 104 |
|---|---|---|---|---|---|---|
| Minimum concentration | Amount of water | 10 ml | 0.11 | 0.08 | 0.15 | 0.09 |
| | Amount of water | 12 ml | 0.09 | 0.08 | 0.12 | 0.08 |
| | Amount of water | 14 ml | 0.07 | 0.07 | 0.08 | 0.07 |
| Maximum concentration | Amount of water | 10 ml | 2.25 | 2.34 | 2.29 | 2.35 |
| | Amount of water | 12 ml | 2.18 | 2.32 | 2.21 | 2.33 |
| | Amount of water | 14 ml | 2.09 | 2.31 | 2.05 | 2.32 |
| Shoulder concentration | Amount of water | 10 ml | 1.98 | 2.10 | 2.08 | 2.12 |
| | Amount of water | 12 ml | 1.89 | 2.07 | 1.94 | 2.10 |
| | Amount of water | 14 ml | 1.75 | 2.05 | 1.79 | 2.09 |
| | Reference | | Comparative example | Example | Comparative example | Example |

From the results shown in table 9, the following facts are known. When the photosensitive material 101 and the photosensitive material 102 are compared, the variation coefficient of particle size distribution and the variation coefficient of halogen composition distribution between particles are within the prescriptions of the present invention, and as a result, variation in abilities against variation in the amount of water imparted in thermal development is small and stable. Particularly, variation in shoulder concentration in the specific curve remarkably decreases.

In the results of the photosensitive material 103 having large variation coefficient of halogen composition distribution between particles, increase in fogging when the amount of water decreases is remarkable, though the variation coefficient of particle size distribution is small. In the photosensitive material 104 using a silver halide emulsion having small dependency on halogen composition between particles.

Example 2

Preparation of photosensitive silver halide emulsion [for green sensitive emulsion layer]

1000 ml of distilled water was prepared in a reaction vessel, and to this was added 35 g of lime-processed gelatin, 0.5 g of potassium bromide and 3.4 g of sodium chloride, and the mixture was dissolved at 40° c. To this solution was added 50 mg of N,N'-dimethylimidazolidine-2-thione and the mixture was heated to 46° c. Then, 220 ml of an aqueous solution containing 17.0 g of silver nitrate and 220 ml of an aqueous solution containing 5.9 g of potassium bromide and 2.9 g of sodium chloride were added with vigorous stirring over 9 minutes. 5 minutes after the completion of the addition, 480 ml of an aqueous solution containing 152.9 g of silver nitrate and 480 ml of an aqueous solution containing 97. 0 g of potassium bromide, 5.3 g of sodium chloride and 0.05 mg of potassium hexachloroiridate (iv) were added with vigorous stirring over 32 minutes. After the completion of these solutions, 100 ml of a methanol solution containing 610 mg of the spectral sensitizing pigment (g1) and 125 mg of the pigment (g2) was added. After the addition, the mixture was kept at 46° c. for 10 minutes, then, cooled down to 35° c. The pH of the solution was lowered to 3.8, and de-salting was conducted by a normal method using a polymer coagulating agent. Then, by adding to this 40 g of lime-treated ossein gelatin and 0.1 mg of benzoisothiazolone, ph was controlled to 6.4, pag was controlled to 7.6 and the temperature was controlled to 60° c. To this emulsion was added 50 mg of 4-hydroxy-6-methyl-1,3,3a,7-tetrazaindene and 3.1 mg of sodium thiosulfate, and after 5 minutes, 200 mg of a nucleic acid decomposed material was added and chemical sensitization was conducted optimally, then, 150 mg of 3-methylureidophenyl-mercaptotetrazole was added, and the mixture was cooled. Thus prepared emulsion was named an emulsion G1.

According to observation by an electron microscope, the emulsion G1 was composed of a silver halide particle in the form of a cube having an average particle size of 0.31 $\mu$m, and had a variation coefficient of particle size of 16%. Halogen composition of each particle was measured according to an EPMA method regarding this emulsion, to find that the average silver bromide content was 86.5% and the variation coefficient of silver bromide content distribution between particles was 29%.

Pigment (g1)

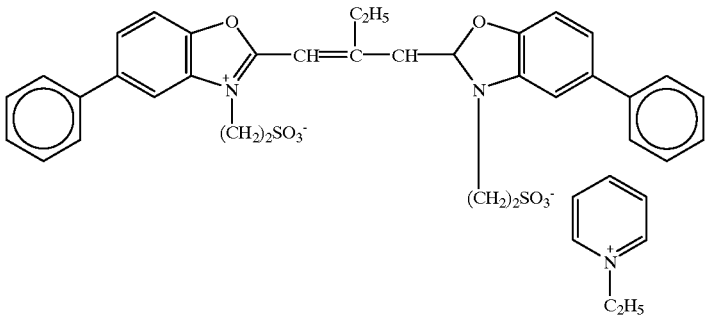

Pigment (g2)

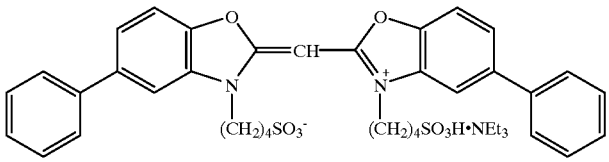

An emulsion G2 was prepared in the same manner as for the emulsion G1 only excepting that the amount potassium bromide was changed to 103.1 g and the amount of sodium chloride was changed to 5.6 g contained in the alkali halide aqueous solution added in the second adding operation, the adding time was changed to 34 minutes, and the adding could be continued alone for 2 minutes after the completion of the addition of the silver nitrate aqueous solution, in forming the particle.

According to observation by an electron microscope, the emulsion G2 was composed of a silver halide particle in the form of a cube having an average particle size of 0.31 μm, and had a variation coefficient of particle size of 16%. Halogen composition of each particle was measured according to the EPMA method, to find that the average silver bromide content was 91.5% and the variation coefficient of silver bromide content distribution between particles was 19%.

Then, an emulsion G3 was prepared in the same manner as for the emulsion B3 excepting that the average particle size was changed to 0.32 μm by changing the temperature in the particle formation, the spectral sensitizing pigment was changed to the following (g3) and (g4), and addition of these pigments was conducted directly after the particle formation. The average silver bromide content was 2.1% and the variation coefficient of silver bromide content distribution between particles was 30%.

Pigment (g3)

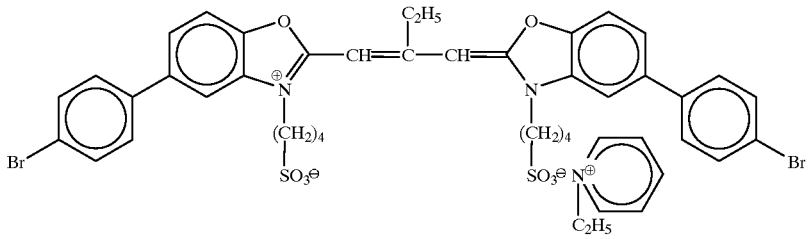

Pigment (g4)

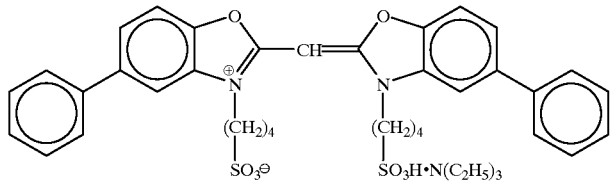

An emulsion G4 was prepared in the same manner as for the emulsion G3 excepting that regarding potassium bromide added before the chemical sensitization, a silver bromide fine particle emulsion having a particle size of 0.05 μm was added in an amount corresponding to 2.2 g in terms of silver.

According to observation by an electron microscope, the emulsion G4 was composed of a silver halide particle in the form of a cube having an average particle size of 0.32 μm, and had a variation coefficient of particle size of 12%. Halogen composition of each particle was measured in the same manner as for the emulsion b3, to find that the average silver bromide content was 2.3% and the variation coefficient of silver iodide content distribution between particles was 12%.

Next, a photosensitive material 201 was constituted in the same manner as in example 1, by combining a experiment standard in which the exemplified compound C-2 as a magenta dye forming coupler is combined with the exemplified compound D-5 and the compound (d1) as a developing agent, and a experiment standard in which the exemplified compound C-8 as a magenta dye forming coupler is combined with the exemplified compound (26) and the compound (d1) as a developing agent, with these silver halide emulsions so that the composition shown in table 10 was obtained.

TABLE 10

Main material constitution of photosensitive material 201

| Layer | Name of layer | Additive | Amount added ($mg/m^2$) |
|---|---|---|---|
| Third layer | Protecting layer | Acid-processed gelatin | 387 |
| | | Mat agent (PMMA resin) | 17 |
| | | Surfactant (2) | 6 |
| | | Surfactant (3) | 20 |
| | | Polymer latex (a) dispersed material | 10 |
| | | Curing agent (1) | 20 |
| Second layer | Intermediate layer | Lime-treated gelatin | 862 |
| | | Anti-fogging agent (4) | 7 |
| | | Reducing agent (1) | 57 |
| | | Solvent having high boiling point (2) | 101 |
| | | Solvent having high boiling point (5) | 9 |
| | | Surfactant (1) | 21 |
| | | Surfactant (4) | 21 |
| | | Water-soluble polymer (1) | 5 |
| | | Zinc hydroxide | 320 |
| | | Calcium nitrate | 6 |
| First layer | Green sensitive layer | Lime-processed gelatin | 452 |
| | | Photosensitive silver halide emulsion G1 | 234 |
| | | Magenta dye forming coupler C-2 | 349 |
| | | Developing agent D-5 | 304 |
| | | Developing agent (d1) | 35 |
| | | Anti-fogging agent(2) | 15 |
| | | Solvent having a high boiling point (4) | 444 |
| | | Surfactant (1) | 12 |
| | | Water-soluble polymer (1) | 10 |

Substrate (a substrate obtained by depositing aluminum on PET providing a thickness of 20 $\mu$m, and further by applying a gelatin primer on the surface thereof.)

The amount coated of the silver halide was expressed in terms of the amount of silver.

The photosensitive materials 202 to 204 were produced in the same manner only excepting the composition of the first layer was changed as described below.

A photosensitive material 202 was prepared in the same manner as for the photosensitive material 201 except that the composition of the first layer of the photosensitive material 201 was changed as described in the following Table 11, a photosensitive material 203 was prepared in the same manner as for the photosensitive material 201 except that the composition of the first layer of the photosensitive material 201 was changed as described in the following Table 12, a photosensitive material 204 was prepared in the same manner as for the photosensitive material 201 except that the composition of the first layer of the photosensitive material 201 was changed as described in the following Table 13, a photosensitive material 205 was prepared in the same manner as for the photosensitive material 201 except that the composition of the first layer of the photosensitive material 201 was changed as described in the following Table 14, a photosensitive material 206 was prepared in the same manner as for the photosensitive material 201 except that the composition of the first layer of the photosensitive material 201 was changed as described in the following Table 15, a photosensitive material 207 was prepared in the same manner as for the photosensitive material 201 except that the composition of the first layer of the photosensitive material 201 was changed as described in the following Table 16, and a photosensitive material 208 was prepared in the same manner as for the photosensitive material 201 except that the composition of the first layer of the photosensitive material 201 was changed as described in the following Table 17, respectively.

TABLE 11

Photosensitive material main material constitution of first layer of 202

| First layer | | |
|---|---|---|
| Green sensitive layer | Lime-processed gelatin | 452 |
| | Photosensitive silver halide emulsion G2 | 234 |
| | Magenta dye forming coupler C-8 | 324 |
| | Developing agent 26 | 311 |
| | Developing agent (d1) | 35 |
| | Anti-fogging agent (2) | 15 |
| | Solvent having a high boiling point (4) | 444 |
| | Surfactant (1) | 12 |
| | Water-soluble polymer (1) | 10 |

TABLE 12

Photosensitive material main material constitution of first layer of 203

| First layer | | |
|---|---|---|
| Green sensitive layer | Lime-processed gelatin | 452 |
| | Photosensitive silver halide emulsion G3 | 234 |
| | Magenta dye forming coupler C-8 | 324 |
| | Developing agent 26 | 311 |
| | Developing agent (d1) | 35 |
| | Anti-fogging agent (2) | 15 |
| | Solvent having a high boiling point (4) | 444 |
| | Surfactant (1) | 12 |
| | Water-soluble polymer (1) | 10 |

TABLE 13

Photosensitive material main material constitution of first layer of 204

| First layer | | |
|---|---|---|
| Green sensitive layer | Lime-processed gelatin | 452 |
| | Photosensitive silver halide emulsion G4 | 234 |
| | Magenta dye forming coupler C-8 | 324 |
| | Developing agent 26 | 311 |
| | Developing agent (d1) | 35 |
| | Anti-fogging agent (2) | 15 |
| | Solvent having a high | 444 |

TABLE 13-continued

| Photosensitive material main material constitution of first layer of 204 | | |
|---|---|---|
| First layer | | |
| | boiling point (4) | |
| | Surfactant (1) | 12 |
| | Water-soluble polymer (1) | 10 |

TABLE 14

| Photosensitive material main material constitution of first layer of 205 | | |
|---|---|---|
| First layer | | |
| Green sensitive layer | Lime-processed gelatin | 452 |
| | Photosensitive silver halide emulsion G1 | 234 |
| | Magenta dye forming coupler C-8 | 324 |
| | Developing agent 26 | 311 |
| | Developing agent (d1) | 35 |
| | Anti-fogging agent (2) | 15 |
| | Solvent having a high boiling point (4) | 444 |
| | Surfactant (1) | 12 |
| | Water-soluble polymer (1) | 10 |

TABLE 15

| Photosensitive material main material constitution of first layer of 206 | | |
|---|---|---|
| First layer | | |
| Green sensitive layer | Lime-processed gelatin | 452 |
| | Photosensitive silver halide emulsion G2 | 234 |
| | Magenta dye forming coupler C-8 | 324 |
| | Developing agent 26 | 311 |
| | Developing agent (d1) | 35 |
| | Anti-fogging agent (2) | 15 |
| | Solvent having a high boiling point (4) | 444 |
| | Surfactant (1) | 12 |
| | Water-soluble polymer (1) | 10 |

TABLE 16

| Photosensitive material main material constitution of first layer of 207 | | |
|---|---|---|
| First layer | | |
| Green sensitive layer | Lime-processed gelatin | 452 |
| | Photosensitive silver halide emulsion G3 | 234 |
| | Magenta dye forming coupler C-8 | 324 |
| | Developing agent 26 | 311 |
| | Developing agent (d1) | 35 |
| | Anti-fogging agent (2) | 15 |
| | solvent having a high boiling point (4) | 444 |
| | Surfactant (1) | 12 |
| | water-soluble polymer (1) | 10 |

TABLE 17

| Photosensitive material main material constitution of first layer of 208 | | |
|---|---|---|
| First layer | | |
| Green sensitive layer | Lime-processed gelatin | 452 |
| | Photosensitive silver halide emulsion G4 | 234 |
| | Magenta dye forming coupler C-8 | 324 |
| | Developing agent 26 | 311 |
| | Developing agent (d1) | 35 |
| | Anti-fogging agent (2) | 15 |
| | Solvent having a high boiling point (4) | 444 |
| | Surfactant (1) | 12 |
| | water-soluble polymer (1) | 10 |

The photosensitive materials 201 to 208 were exposed to a light at 2500 lux for 1/50 seconds through an optical wedge and a green filer. Then water in an amount corresponding to 5 ml per 1 $m^2$ (amount corresponding to about 0.42-fold of the amount of water required for the maximum swelling of the whole coated film of the photosensitive material and the pigment fixing material) was imparted to the surface of the photosensitive material, and laminated with the above-describe pigment fixing material and the laminate was heated at 80° C. for 30 seconds, then, they were released. On the released pigment fixing material, a brilliant magenta wedge-formed image was formed.

Then, the amount of water imparted to the photosensitive material after exposure was changed to 4 ml (amount corresponding to about 0.33-fold) and 6 ml (amount corresponding to about 0.50-fold) per 1 $m^2$, and a pigment image was formed on the pigment fixing material in the same manner.

The reflection of the pigment image formed on the pigment fixing material was measured, to obtain a so-called specific curve. Using this specific curve, the minimum concentration, the maximum concentration and the shoulder concentration of the specific curve (color developing concentration corresponding to an exposing amount which is lower by 0.6 logE than the exposing amount giving a concentration which is higher by 0.5 than the minimum concentration) were measured. The results are shown in Tables 18 and 19.

TABLE 18

| Photosensitive material | | 201 | 202 | 203 | 204 |
|---|---|---|---|---|---|
| Minimum concentration | Amount of water 10 ml | 0.13 | 0.09 | 0.19 | 0.10 |
| | Amount of water 12 ml | 0.11 | 0.09 | 0.14 | 0.09 |
| | Amount of water 14 ml | 0.09 | 0.08 | 0.10 | 0.09 |
| Maximum concentration | Amount of water 10 ml | 2.37 | 2.46 | 2.41 | 2.48 |
| | Amount of water 12 ml | 2.30 | 2.44 | 2.33 | 2.46 |
| | Amount of water 14 ml | 2.19 | 2.43 | 2.16 | 2.45 |
| Shoulder concentration | Amount of water 10 ml | 2.10 | 2.21 | 2.19 | 2.24 |
| | Amount of water 12 ml | 1.99 | 2.18 | 2.04 | 2.22 |
| | Amount of water 14 ml | 1.81 | 2.17 | 1.86 | 2.21 |
| | Reference | Comp- | Example | Comp- | Example |

TABLE 18-continued

| Photosensitive material | 201 | 202 | 203 | 204 |
|---|---|---|---|---|
| | arative example | | arative example | |

TABLE 19

| Photosensitive material | | | 204 | 205 | 206 | 207 |
|---|---|---|---|---|---|---|
| Minimum concentration | Amount of water | 10 ml | 0.14 | 0.09 | 0.21 | 0.10 |
| | Amount of water | 12 ml | 0.12 | 0.09 | 0.16 | 0.10 |
| | Amount of water | 14 ml | 0.09 | 0.08 | 0.12 | 0.09 |
| Maximum concentration | Amount of water | 10 ml | 2.21 | 2.29 | 2.24 | 2.30 |
| | Amount of water | 12 ml | 2.12 | 2.27 | 2.16 | 2.28 |
| | Amount of water | 14 ml | 2.04 | 2.26 | 2.00 | 2.27 |
| Shoulder concentration | Amount of water | 10 ml | 1.94 | 2.06 | 2.05 | 2.08 |
| | Amount of water | 12 ml | 1.85 | 2.03 | 1.91 | 2.06 |
| | Amount of water | 14 ml | 1.71 | 2.01 | 1.75 | 2.05 |
| | Reference | | Comparative example | Example | Comparative example | Example |

From the results shown in Tables 18 and 19, the same effects as in Example 1 are apparent.

Example 3

Preparation of photosensitive silver halide emulsion (for red sensitive emulsion layer)

1100 ml of distilled water was prepared in a reaction vessel, and to this was added 34 g of lime-processed gelatin, 0.5 g of potassium bromide and 3.4 g of sodium chloride, and the mixture was dissolved at 40° C. To this solution was added 50 mg of N,N'-dimethylimidazolidine-2-thione and the mixture was heated to 53° C. Then, 280 ml of an aqueous solution containing 51.0 g of silver nitrate and 280 ml of an aqueous solution containing 23.2 g of potassium bromide, 6.1 g of sodium chloride and 0.15 mg of potassium hexachloro iridate (IV) were added with vigorous stirring over 9 minutes. 5 minutes after the completion of the addition, 425 ml of an aqueous solution containing 118.9 g of silver nitrate and 425 ml of an aqueous solution containing 75.0 g of potassium bromide and 4.1 g of sodium chloride were added with vigorous stirring over 24 minutes. After the addition, the mixture was kept at 53° C. for 10 minutes, then, cooled down to 35° C.

Then, the pH was reduced to 3.8, and de-salting was conducted by a normal method using a polymer coagulating agent. Then, by adding to this 40 g of lime-treated ossein gelatin and 0.1 mg of benzoisothiazolone, pH was controlled to 6.1, pAg was controlled to 7.4 and the temperature was controlled to 60° C. To this emulsion 1.35 mg of trimethylthiourea and 110 mg of 4-hydroxy-6-methyl-1,3,3a,7-tetrazaindene were added, and after 5 minutes, 450 mg of a nucleic acid decomposed material was added and chemical sensitization was conducted optimally, then, 200 ml of a methanol solution containing 140 mg of a spectral sensitizing pigment (r1) was added. Further, 150 mg of 3-methylureidophenyl-mercaptotetrazole was added, and the mixture was cooled. Thus prepared emulsion was named an emulsion R1.

According to observation by an electron microscope, the emulsion R1 was composed of a silver halide particle in the form of a cube having an average particle size of 0.35 μm, and had a variation coefficient of particle size of 15%. Halogen composition of each particle was measured according to an EPMA method regarding this emulsion, to find that the average silver bromide content was 83.5% and the variation coefficient of silver bromide content distribution between particles was 30%.

Pigment (r1)

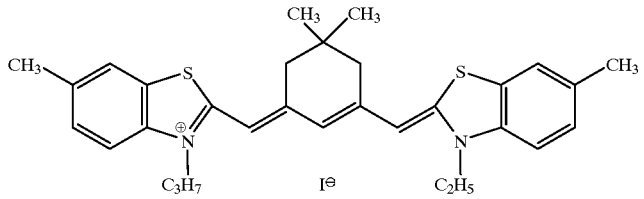

An emulsion R2 was prepared in the same manner as for the emulsion R1 only excepting that the amount potassium bromide was changed to 79.7 g and the amount of sodium chloride was changed to 4.4 g contained in the alkali halide aqueous solution added in the second adding operation, the adding time was changed to 25 minutes and 30 seconds, and the adding could be continued alone for 1 minute and 30 seconds after the completion of the addition of the silver nitrate aqueous solution, in forming the particle.

According to observation by an electron microscope, the emulsion R2 was composed of a silver halide particle in the form of a cube having an average particle size of 0.35 μm, and had a variation coefficient of particle size of 15%. Halogen composition of each particle was measured according to the EPMA method regarding this emulsion, to find that the average silver bromide content was 86.9% and the variation coefficient of silver bromide content distribution between particles was 19%.

Next, an emulsion R3 was prepared in the same manner as for the emulsion B3 excepting that the average particle size was changed to 0.36 μm by changing the temperature in the particle formation, the spectral sensitizing pigment was changed to the following (r2), and addition of these pigments was conducted at initiation of the chemical sensitization. The emulsion R3 has an average silver bromide content of 2.1% and a variation coefficient of silver bromide content distribution between particles of 30%.

Sensitizing pigment (r2)

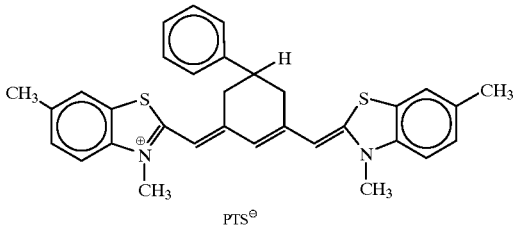

An emulsion R4 was prepared in the same manner as for the emulsion R3 excepting that regarding potassium bromide added before the chemical sensitization, a silver bromide fine particle emulsion having a particle size of 0.05 μm was added in an amount corresponding to 2.2 g in terms of silver.

According to observation by an electron microscope, the emulsion R4 was composed of a silver halide particle in the form of a cube having an average particle size of 0.35 μm, and had a variation coefficient of particle size of 12%. Halogen composition of each particle was measured in the same manner as for the emulsion B3, to find that the average silver bromide content was 2.3% and the variation coefficient of silver iodide content distribution between particles was 12%.

Next, a photosensitive material 301 was constituted in the same manner as in Example 1, by combining a experiment standard in which the exemplified compound C-12 as a cyan dye forming coupler is combined with the exemplified compound D-5 and the compound (d1) as a developing agent, and a experiment standard in which the exemplified compound C-14 as a cyan dye forming coupler is combined with the exemplified compound (10) and the compound (d1) as a developing agent, with these silver halide emulsions so that the composition shown in Table 20 was obtained.

Table 20

TABLE 18

Main material constitution of photosensitive material 301

| Layer | Name of layer | Additive | Amount added (mg/m$^2$) |
|---|---|---|---|
| Third layer | Protective layer | Acid-processed gelatin | 387 |
| | | Matting agent (PMMA resin) | 17 |
| | | Surfactant (2) | 6 |
| | | Surfactant (3) | 20 |
| | | Polymer latex (a) dispersion | 10 |
| | | Curing agent (1) | 20 |
| Second layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | surfactant (1) | 21 |
| | | Surfactant (4) | 21 |
| | | Water-soluble polymer (1) | 5 |
| | | Zinc hydroxide | 320 |
| | | Calcium nitrate | 6 |

TABLE 18-continued

Main material constitution of photosensitive material 301

| Layer | Name of layer | Additive | Amount added (mg/m$^2$) |
|---|---|---|---|
| First layer | Red sensitive layer | Lime-processed gelatin | 373 |
| | | Photosensitive silver halide emulsion R1 | 160 |
| | | Cyan dye forming coupler C-12 | 262 |
| | | Developing agent D-5 | 304 |
| | | Developing agent (d1) | 35 |
| | | Anti-fogging agent (2) | 14 |
| | | Solvent having a high boiling point (4) | 412 |
| | | Surfactant (1) | 11 |
| | | Water-soluble polymer (2) | 25 |

Substrate (a substrate obtained by depositing aluminum on PET providing a thickness of 20 μm, and further by applying a gelatin primer on the surface thereof.)

The amount coated of the silver halide was expressed in terms of the amount of silver.

The photosensitive materials 202 to 204 were produced in the same manner only excepting the composition of the first layer was changed as described below.

A photosensitive material 302 was prepared in the same manner as for the photosensitive material 301 except that the composition of the first layer of the photosensitive material 301 was changed as described in the following Table 21, a photosensitive material 303 was prepared in the same manner as for the photosensitive material 301 except that the composition of the first layer of the photosensitive material 301 was changed as described in the following Table 22, a photosensitive material 304 was prepared in the same manner as for the photosensitive material 301 except that the composition of the first layer of the photosensitive material 301 was changed as described in the following Table 23, a photosensitive material 305 was prepared in the same manner as for the photosensitive material 301 except that the composition of the first layer of the photosensitive material 301 was changed as described in the following Table 24, a photosensitive material 306 was prepared in the same manner as for the photosensitive material 301 except that the composition of the first layer of the photosensitive material 301 was changed as described in the following Table 25, a photosensitive material 307 was prepared in the same manner as for the photosensitive material 301 except that the composition of the first layer of the photosensitive material 301 was changed as described in the following Table 26, and a photosensitive material 308 was prepared in the same manner as for the photosensitive material 301 except that the composition of the first layer of the photosensitive material 301 was changed as described in the following Table 27, respectively.

TABLE 21

Photosensitive material
main material constitution of first layer of 302

| First layer | | |
|---|---|---|
| Red sensitive layer | Lime-processed gelatin | 373 |
| | Photosensitive silver halide emulsion R2 | 160 |
| | Cyan dye forming coupler C-12 | 262 |
| | Developing agent D-5 | 304 |
| | Developing agent (d1) | 35 |

TABLE 21-continued

| Photosensitive material main material constitution of first layer of 302 | | |
|---|---|---|
| First layer | | |
| | Anti-fogging agent (2) | 14 |
| | Solvent having a high boiling point (4) | 412 |
| | Surfactant (1) | 11 |
| | Water-soluble polymer (2) | 25 |

TABLE 22

| Photosensitive material main material constitution of first layer of 303 | | |
|---|---|---|
| First layer | | |
| Red sensitive layer | Lime-processed gelatin | 373 |
| | Photosensitive silver halide emulsion R3 | 160 |
| | Cyan dye forming coupler C-12 | 262 |
| | Developing agent D-5 | 304 |
| | Developing agent (d1) | 35 |
| | Anti-fogging agent (2) | 14 |
| | Solvent having a high boiling point (4) | 412 |
| | Surfactant (1) | 11 |
| | Water-soluble polymer (2) | 25 |

TABLE 23

| Photosensitive material main material constitution of first layer of 304 | | |
|---|---|---|
| First layer | | |
| Red sensitive layer | Lime-processed gelatin | 373 |
| | Photosensitive silver halide emulsion R4 | 160 |
| | Cyan dye forming coupler C-12 | 262 |
| | Developing agent D-5 | 304 |
| | Developing agent (d1) | 35 |
| | Anti-fogging agent (2) | 14 |
| | Solvent having a high boiling point (4) | 412 |
| | Surfactant (1) | 11 |
| | water-soluble polymer (2) | 25 |

TABLE 24

| Photosensitive material main material constitution of first layer of 305 | | |
|---|---|---|
| First layer | | |
| Red sensitive layer | Lime-processed gelatin | 373 |
| | Photosensitive silver halide emulsion R1 | 160 |
| | Cyan dye forming coupler C-14 | 278 |
| | Developing agent (10) | 233 |
| | Developing agent (d1) | 35 |
| | Anti-fogging agent (2) | 14 |
| | Solvent having a high boiling point (4) | 412 |
| | Surfactant (1) | 11 |
| | water-soluble polymer (2) | 25 |

TABLE 25

| Photosensitive material main material constitution of first layer of 306 | | |
|---|---|---|
| First layer | | |
| Red sensitive layer | Lime-processed gelatin | 373 |
| | Photosensitive silver halide emulsion R2 | 160 |
| | Cyan dye forming coupler C-14 | 278 |
| | Developing agent (10) | 233 |
| | Developing agent (d1) | 35 |
| | Anti-fogging agent (2) | 14 |
| | Solvent having a high boiling point (4) | 412 |
| | Surfactant (1) | 11 |
| | Water-soluble polymer (2) | 25 |

TABLE 26

| Photosensitive material main material constitution of first layer of 307 | | |
|---|---|---|
| First layer | | |
| Red sensitive layer | Lime-processed gelatin | 373 |
| | Photosensitive silver halide emulsion R3 | 160 |
| | Cyan dye forming coupler C-14 | 278 |
| | Developing agent (10) | 233 |
| | Developing agent (d1) | 35 |
| | Anti-fogging agent (2) | 14 |
| | Solvent having a high boiling point (4) | 412 |
| | Surfactant (1) | 11 |
| | Water-soluble polymer (2) | 25 |

TABLE 27

| Photosensitive material main material constitution of first layer of 308 | | |
|---|---|---|
| First layer | | |
| Red sensitive layer | Lime-processed gelatin | 373 |
| | Photosensitive silver halide emulsion R4 | 160 |
| | Cyan dye forming coupler C-14 | 278 |
| | Developing agent (10) | 233 |
| | Developing agent (d1) | 35 |
| | Anti-fogging agent (2) | 14 |
| | Solvent having a high boiling point (4) | 412 |
| | Surfactant (1) | 11 |
| | Water-soluble polymer (1) | 25 |

The photosensitive materials 301 to 308 were exposed to a light at 2500 lux for 1/50 seconds through an optical wedge and a green filer. Then water in an amount corresponding to 12 ml per 1 $m^2$ (amount corresponding to about 0.42-fold of the amount of water required for the maximum swelling of the whole coated film of the photosensitive material and the pigment fixing material) was imparted to the surface of the photosensitive material, and laminated with the above-describe pigment fixing material and the laminate was heated at 80° C. for 30 seconds, then, they were released. On the released pigment fixing material, a brilliant cyan wedge-formed image was formed.

Then, the amount of water imparted to the photosensitive material after exposure was changed to 4 ml (amount corresponding to about 0.34-fold) and 6 ml (amount corresponding to about 0.51-fold) per 1 $m^2$, and a pigment image was formed on the pigment fixing material in the same manner.

The reflection of the pigment image formed on the pigment fixing material was measured, to obtain a so-called specific curve. Using this specific curve, the minimum concentration, the maximum concentration and the shoulder concentration of the specific curve (color developing concentration corresponding to an exposing amount which is lower by 0.6 logE than the exposing amount giving a concentration which is higher by 0.5 than the minimum concentration) were measured. The results are shown in Tables 28 and 29.

TABLE 28

| Photosensitive material | | | 301 | 302 | 303 | 304 |
|---|---|---|---|---|---|---|
| Minimum concentration | Amount of water | 10 ml | 0.12 | 0.08 | 0.17 | 0.09 |
| | Amount of water | 12 ml | 0.10 | 0.08 | 0.12 | 0.08 |
| | Amount of water | 14 ml | 0.08 | 0.07 | 0.09 | 0.08 |
| Maximum concentration | Amount of water | 10 ml | 2.28 | 2.36 | 2.32 | 2.38 |
| | Amount of water | 12 ml | 2.21 | 2.35 | 2.24 | 2.36 |
| | Amount of water | 14 ml | 2.10 | 2.32 | 2.07 | 2.35 |
| Shoulder concentration | Amount of water | 10 ml | 2.02 | 2.13 | 2.10 | 2.15 |
| | Amount of water | 12 ml | 1.91 | 2.10 | 1.96 | 2.14 |
| | Amount of water | 14 ml | 1.74 | 2.09 | 1.79 | 2.12 |
| | Reference | | Comparative example | Example | Comparative example | Example |

TABLE 29

| Photosensitive material | | | 304 | 305 | 306 | 307 |
|---|---|---|---|---|---|---|
| Minimum concentration | Amount of water | 10 ml | 0.15 | 0.09 | 0.20 | 0.09 |
| | Amount of water | 12 ml | 0.13 | 0.09 | 0.15 | 0.09 |
| | Amount of water | 14 ml | 0.10 | 0.08 | 0.12 | 0.08 |
| Maximum concentration | Amount of water | 10 ml | 2.17 | 2.24 | 2.20 | 2.25 |
| | Amount of water | 12 ml | 2.08 | 2.22 | 2.12 | 2.24 |
| | Amount of water | 14 ml | 1.99 | 2.21 | 1.96 | 2.23 |
| Shoulder concentration | Amount of water | 10 ml | 1.90 | 2.02 | 2.02 | 2.04 |
| | Amount of water | 12 ml | 1.81 | 2.00 | 1.89 | 2.02 |
| | Amount of water | 14 ml | 1.68 | 1.99 | 1.72 | 2.01 |
| | Reference | | Comparative example | Example | Comparative example | Example |

From the results shown in Tables 28 and 29, the same effects as in Example 1 are apparent.

Example 4

A multi-layer color photosensitive material 401 was prepared shown in Tables 30 to 32 by combining the silver halide emulsions and coupler dispersed materials prepared in Examples 1 to 3.

TABLE 30

Main material constitution of photosensitive element 402

| Layer | Name of layer | Additive | Amount added ($mg/m^2$) |
|---|---|---|---|
| Seventh layer | Protective layer | Acid-processed gelatin | 387 |
| | | Matting agent (PMMA resin) | 17 |
| | | Surfactant (2) | 6 |
| | | Surfactant (3) | 20 |
| | | Polymer latex (a) dispersion | 10 |
| Sixth layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 5 |
| | | Zinc hydroxide | 558 |
| | | Calcium nitrate | 6 |
| Fifth layer | Blue sensitive layer | Lime-processed gelatin | 587 |
| | | Photosensitive silver halide emulsion B1 | 399 |
| | | Yellow dye forming coupler C-3 | 366 |
| | | Developing agent (22) | 157 |
| | | Developing agent (d1) | 35 |
| | | Anti-fogging agent (2) | 15 |
| | | Solvent having a high boiling point (4) | 433 |
| | | Surfactant (1) | 12 |
| | | Water-soluble polymer (1) | 40 |
| Forth layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 4 |
| | | Zinc hydroxide | 341 |
| | | Calcium nitrate | 8 |
| Third layer | Green sensitive layer | Lime-processed gelatin | 452 |
| | | photosensitive silver halide emulsion Gi | 234 |
| | | Magenta dye forming coupler C-2 | 349 |
| | | Developing agent D-5 | 304 |
| | | Developing agent (d1) | 35 |
| | | Anti-fogging agent (2) | 15 |
| | | Solvent having a high boiling point (4) | 444 |
| | | Surfactant (1) | 12 |
| | | Water-soluble polymer (1) | 10 |
| Second layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 10 |
| | | Calcium nitrate | 6 |
| First layer | Red photosensitive layer | Lime-processed gelatin | 373 |
| | | Photosensitive silver halide emulsion R1 | 160 |
| | | Cyan dye forming coupler C-12 | 262 |
| | | Reducing agent D-5 | 304 |
| | | Reducing agent (d1) | 35 |
| | | Anti-fogging agent (2) | 14 |
| | | Solvent having a high boiling point (4) | 412 |

TABLE 30-continued

| Main material constitution of photosensitive element 402 | | | |
|---|---|---|---|
| Layer | Name of layer | Additive | Amount added ($mg/m^2$) |
| | | Surfactant (1) | 11 |
| | | Water-soluble polymer (2) | 25 |
| | | Curing agent (1) | 45 |

Substrate (a substrate obtained by depositing aluminum on PET providing a thickness of 20 $\mu$m, and further by applying a gelatin primer on the surface thereof.)

The amount coated of the silver halide was expressed in terms of the amount of silver.

Water-soluble polymer (2)

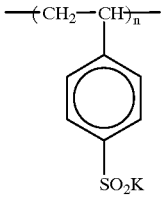

Intrinsic viscosity [η]=0.8

(0.1N NaCl, 30° C.)

Molecular weight≈400,000

Photosensitive materials 402 to 404 were prepared by making changes as shown in the following Table 33 in the photosensitive material 401.

TABLE 33

| | 402 | | 403 | | 404 | |
|---|---|---|---|---|---|---|
| Fifth layer | | | | | | |
| Silver halide emulsion | B2 | 399 | B3 | 399 | B4 | 399 |
| Yellow dye forming coupler | C-3 | 366 | C-3 | 366 | C-3 | 366 |
| Developing agent | (22) | 157 | (22) | 157 | (22) | 157 |
| Developing agent | (d1) | 35 | (d1) | 35 | (d1) | 35 |
| Third layer | | | | | | |
| Silver halide emulsion | G2 | 234 | G3 | 234 | G4 | 234 |
| Magenta dye forming coupler | C-2 | 349 | C-2 | 349 | C-2 | 349 |
| Developing agent | D-5 | 304 | D-5 | 304 | D-5 | 304 |
| Developing agent | (d1) | 35 | (d1) | 35 | (d1) | 35 |
| First layer | | | | | | |
| Silver halide emulsion | R2 | 160 | R3 | 160 | R4 | 160 |
| Cyan dye forming coupler | C-12 | 262 | C-12 | 262 | C-12 | 262 |
| Developing agent | D-5 | 304 | D-5 | 304 | D-5 | 304 |
| Developing agent | (d1) | 35 | (d1) | 35 | (d1) | 35 |

The photosensitive materials 401 to 404 were exposed to a light at 2500 lux for 1/50 seconds through an optical wedge and a red filer, green filter and blue filter. Then water in an amount corresponding to 12 ml per 1 $m^2$ (amount corresponding to about 0.6-fold of the amount of water required for the maximum swelling of the whole coated film of the photosensitive material and the pigment fixing material) was imparted to the surface of the photosensitive material, and laminated with the above-describe pigment fixing material and the laminate was heated at 80° C. for 30 seconds, then, they were released. On the release pigment fixing material, brilliant cyan, magenta and magenta wedge-formed images were formed, the colors being in complementary relation to the exposed light.

Then, the amount of water imparted to the photosensitive material after exposure was changed to 10 ml (amount corresponding to about 0.5-fold) and 14 ml (amount corresponding to about 0.7-fold) per 1 $m^2$, and a pigment image was formed on the pigment fixing material in the same manner.

The reflection of the pigment image formed on the pigment fixing material was measured, to obtain a so-called specific curve. Using this specific curve, the minimum concentration, the maximum concentration and the shoulder concentration of the specific curve (color developing concentration corresponding to an exposing amount which is lower by 0.6 logE than the exposing amount giving a concentration which is higher by 0.5 than the minimum concentration) were measured. The results are shown in Tables 34 to 36.

TABLE 34

| Yellow color developing part | | | | | | |
|---|---|---|---|---|---|---|
| Photosensitive material | | | 401 | 402 | 403 | 404 |
| Minimum concentration | Amount of water | 10 ml | 0.10 | 0.08 | 0.14 | 0.08 |
| | Amount of water | 12 ml | 0.08 | 0.07 | 0.11 | 0.07 |
| | Amount of water | 14 ml | 0.07 | 0.07 | 0.07 | 0.07 |
| Maximum concentration | Amount of water | 10 ml | 2.21 | 2.29 | 2.23 | 2.35 |
| | Amount of water | 12 ml | 2.17 | 2.28 | 2.18 | 2.33 |
| | Amount of water | 14 ml | 2.07 | 2.26 | 2.03 | 2.32 |
| Shoulder concentration | Amount of water | 10 ml | 1.95 | 2.04 | 2.02 | 2.08 |
| | Amount of water | 12 ml | 1.84 | 2.03 | 1.88 | 2.07 |
| | Amount of water | 14 ml | 1.71 | 2.02 | 1.76 | 2.06 |
| | Reference | | Comparative example | Example | Comparative example | Example |

TABLE 35

| Magenta color developing part | | | | | | |
|---|---|---|---|---|---|---|
| Photosensitive material | | | 401 | 402 | 403 | 404 |
| Minimum concentration | Amount of water | 10 ml | 0.12 | 0.08 | 0.17 | 0.09 |
| | Amount of water | 12 ml | 0.10 | 0.08 | 0.13 | 0.08 |
| | Amount of water | 14 ml | 0.08 | 0.07 | 0.09 | 0.08 |

TABLE 35-continued

| Magenta color developing part | | | | | | |
|---|---|---|---|---|---|---|
| Photosensitive material | | | 401 | 402 | 403 | 404 |
| Maximum concentration | Amount of water | 10 ml | 2.27 | 2.31 | 2.27 | 2.36 |
| | Amount of water | 12 ml | 2.21 | 2.29 | 2.17 | 2.34 |
| | Amount of water | 14 ml | 2.11 | 2.29 | 2.04 | 2.33 |
| Shoulder concentration | Amount of water | 10 ml | 2.03 | 2.08 | 2.06 | 2.11 |
| | Amount of water | 12 ml | 1.93 | 2.07 | 1.94 | 2.09 |
| | Amount of water | 14 ml | 1.74 | 2.07 | 1.77 | 2.09 |
| | Reference | | Comparative example | Example | Comparative example | Example |

TABLE 36

| Cyan color developing part | | | | | | |
|---|---|---|---|---|---|---|
| Photosensitive material | | | 401 | 402 | 403 | 404 |
| Minimum concentration | Amount of water | 10 ml | 0.11 | 0.08 | 0.16 | 0.08 |
| | Amount of water | 12 ml | 0.09 | 0.07 | 0.11 | 0.08 |
| | Amount of water | 14 ml | 0.07 | 0.07 | 0.08 | 0.07 |
| Maximum concentration | Amount of water | 10 ml | 2.22 | 2.28 | 2.23 | 2.33 |
| | Amount of water | 12 ml | 2.15 | 2.26 | 2.16 | 2.31 |
| | Amount of water | 14 ml | 2.04 | 2.25 | 2.00 | 2.31 |
| Shoulder concentration | Amount of water | 10 ml | 1.97 | 2.05 | 2.03 | 2.09 |
| | Amount of water | 12 ml | 1.88 | 2.03 | 1.90 | 2.07 |
| | Amount of water | 14 ml | 1.70 | 2.01 | 1.72 | 2.06 |
| | Reference | | Comparative example | Example | Comparative example | Example |

From the results shown in Tables 34 to 36, the same effects as in Example 1 are apparent.

Example 5

A silver halide emulsion was prepared according to the following method.

Photosensitive silver halide emulsion [emulsion for fifth layer (680 nm photosensitive layer)]

1100 ml of distilled water was prepared in a reaction vessel, and to this was dissolved 34 g of lime-processed gelatin, 28 ml of sulfuric acid (4.9%), 0.5 g of potassium bromide and 3.4 g of sodium chloride, and dissolved at 40° C. To this solution 50 mg of N,N'-dimethylimidazolidine-2-thione was added and the mixture was heated to 45° C. Then, 220 ml of an aqueous solution containing 51.0 g of silver nitrate, and 220 mg of an aqueous solution containing 23.2 g of potassium bromide and 6.1 g of sodium chloride were added with vigorous stirring over 13 minutes. 5 minutes after the completion of the addition, 430 ml of an aqueous solution containing 118.9 g silver nitrate and 430 ml of an aqueous solution containing 75.0 g of potassium bromide, 4.1 g of sodium chloride and 0.08 mg of potassium hexachloro iridate (IV) were added with vigorous stirring over 32 minutes. From 12 minutes after initiation of the addition, 225 ml of a 0.35% aqueous solution of the following spectral sensitizing pigment (r3) was added over 25 minutes.

The mixture was kept at 45° C. for 10 minutes after completion of the addition, then, cooled to 35° C.

Then, pH of the solution was reduced to 3.8, and de-salting was conducted by a normal method using a polymer coagulating agent. Then, by adding to this 40 g of lime-treated ossein gelatin and 0.1 mg of benzoisothiazolone, pH was controlled to 6.4, pAg was controlled to 7.9 and the temperature was controlled to 60° C. To this emulsion was added 3.8 mg of sodium thiosulfate and 220 mg of 4-hydroxy-6-methyl-1,3,3a,7-tetrazaindene, and after 5 minutes, 250 mg of a nucleic acid decomposed material was added and chemical sensitization was conducted optimally. Further, 190 mg of 3-methylureidophenylmercaptotetrazole was added, and the mixture was cooled. Thus prepared emulsion was named an emulsion R5.

According to observation by an electron microscope, the emulsion R5 was composed of a silver halide particle in the form of a cube having an average particle size of 0.20 μm, and had a variation coefficient of particle size of 12%. Halogen composition of each particle was measured according to an EPMA method regarding this emulsion, to find that the average silver bromide content was 83.0% and the variation coefficient of silver bromide content distribution between particles was 32%.

Sensitizing pigment (r3)

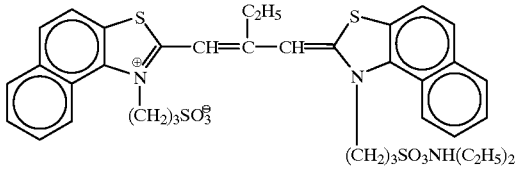

An emulsion R6 was prepared in the same manner as for the emulsion R1 only excepting that the amount potassium bromide was changed to 79.7 g and the amount of sodium chloride was changed to 4.4 g contained in the alkali halide aqueous solution added in the second adding operation, the adding time was changed to 34 minutes, and the adding could be continued alone for 2 minutes after the completion of the addition of the silver nitrate aqueous solution, in forming the particle.

According to observation by an electron microscope, the emulsion R6 was composed of a silver halide particle in the form of a cube having an average particle size of 0.20 μm, and had a variation coefficient of particle size of 12.5%. Halogen composition of each particle was measured according to the EPMA method regarding this emulsion, to find that the average silver bromide content was 87.0% and the variation coefficient of silver bromide content distribution between particles was 19%. Photosensitive silver halide emulsion [emulsion for third layer (750 nm photosensitive layer)]

1100 ml of distilled water was prepared in a reaction vessel, and to this was dissolved 34 g of lime-processed gelatin, 28 ml of sulfuric acid (4.9%), 0.5 g of potassium bromide and 3.4 g of sodium chloride, and dissolved at 40° C. To this solution was added 50 mg of N,N'-dimethylimidazolidine-2-thione and the mixture was heated to 45° C. Then, 220 ml of an aqueous solution containing 51.0 g of silver nitrate, and 220 mg of an aqueous solution containing 23.2 g of potassium bromide and 6.1 g of sodium chloride were added with vigorous stirring over 18 minutes. 5 minutes after the completion of the addition, 430 ml of an aqueous solution containing 118.9 g silver nitrate and 430 ml of an aqueous solution containing 75.0 g of potassium bromide, 4.1 g of sodium chloride, 0.08 mg of potassium hexachloro iridate (IV) and 120 mg of potassium hexacyano ferrate (II) 3-hydrate were added with vigorous stirring over 24 minutes.

The mixture was kept at 45° C. for 10 minutes after completion of the addition, then, cooled to 35° C.

Then pH of the solution was reduced to 3.8, and de-salting was conducted by a normal method using a polymer coagulating agent. Then, by adding to this 40 g of lime-treated ossein gelatin of which calcium content had been decreased to 100 ppm or less by de-ionizing treatment and 0.1 mg of benzoisothiazolone, pH was controlled to 6.0, pAg was controlled to 7.8 and the temperature was controlled to 65° C. To this emulsion was added 5.6 mg of triethylthiourea and 520 mg of 4-hydroxy-6-methyl-1,3,3a,7-tetrazaindene, and after 5 minutes, 550 mg of a nucleic acid decomposed material was added and chemical sensitization was conducted optimally. Further, 33 ml of a 1% methanol solution of the following sensitizing pigment (ir1) was added, kept for 20 minutes, then, 190 mg of 3-methylureidophenylmercaptotetrazole was added, and the mixture was cooled to 40° C. To this emulsion was added the following stabilizer (irs) in an amount corresponding to 300 mg dispersed in gelatin was kept for 10 minutes, then cooled. Thus prepared emulsion was named an emulsion IR1.

According to observation by an electron microscope, the emulsion IR1 was composed of a silver halide particle in the form of a cube having an average particle size of 0.25 μm, and had a variation coefficient of particle size of 13%. Halogen composition of each particle was measured according to an EPMA method regarding this emulsion, to find that the average silver bromide content was 82.8% and the variation coefficient of silver bromide content distribution between particles was 31%.

Sensitizing pigment (ir1)

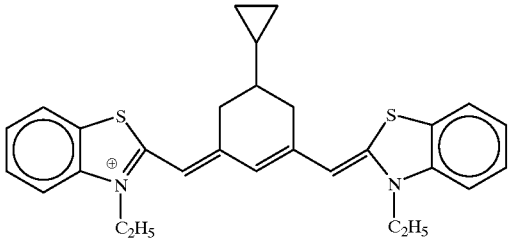

Stabilizer (irs)

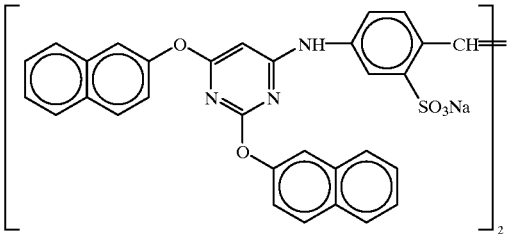

An emulsion IR2 was prepared in the same manner as for the emulsion IR1 only excepting that the amount potassium bromide was changed to 79.7 g and the amount of sodium chloride was changed to 4.4 g contained in the alkali halide aqueous solution added in the second adding operation, the adding time was changed to 25 minutes and 30 seconds, and the adding could be continued alone for 1 minute and 30 seconds after the completion of the addition of the silver nitrate aqueous solution, in forming the particle.

According to observation by an electron microscope, the emulsion IR2 was composed of a silver halide particle in the form of a cube having an average particle size of 0.25 μm, and had a variation coefficient of particle size of 13.5%. Halogen composition of each particle was measured according to the EPMA method regarding this emulsion , to find that the average silver bromide content was 86.8% and the variation coefficient of silver bromide content distribution between particles was 18%. Photosensitive silver halide emulsion [emulsion for first layer (810 nm photosensitive layer)]

1100 ml of distilled water was prepared in a reaction vessel, and to this was dissolved 34 g of lime-processed gelatin, 28 ml of sulfuric acid (4.9%), 0.5 g of potassium bromide and 3.4 g of sodium chloride, and dissolved at 40° C. To this solution was added 50 mg of N,N'-dimethylimidazolidine-2-thione and the mixture was heated to 50° C. Then, 220 ml of an aqueous solution containing 51.0 g of silver nitrate, and 220 ml of an aqueous solution containing 23.2 g of potassium bromide and 6.1 g of sodium chloride were added with vigorous stirring over 18 minutes. 5 minutes after the completion of the addition, 430 ml of an aqueous solution containing 118.9 g silver nitrate and 430 ml of an aqueous solution containing 75.0 g of potassium bromide, 4.1 g of sodium chloride, 0.04 mg of potassium hexachloro iridate (IV) and 120 mg of potassium hexacyano ferrate (II) 3-hydrate were added with vigorous stirring over 24 minutes.

The mixture was kept at 50° C. for 10 minutes after completion of the addition, then, cooled to 35° C.

Then, pH of the solution was reduced to 3.8, and de-salting was conducted by a normal method using a polymer coagulating agent. Then, by adding to this 40 g of lime-treated ossein gelatin and 0.1 mg of benzoisothiazolone, pH was controlled to 7.4, pAg was controlled to 7.8 and the temperature was controlled to 60° C. To this emulsion was added 5.6 mg of triethylthiourea and 520 mg of 4-hydroxy-6-methyl-1,3,3a,7-tetrazaindene, and after 5 minutes, 550 mg of a nucleic-acid decomposed material was added and chemical sensitization was conducted optimally. Further, 320 mg of 3-methylureidophenylmercaptotetrazole was added; and the mixture was cooled to 40° C. To this emulsion 10 ml of a 0.1% methanol solution of the following sensitizing pigment (ir2) was added, and was kept for 20 minutes, then, the following stabilizer (irs) in an amount corresponding to 200 mg dispersed in gelatin was kept for 10 minutes, then cooled. Thus prepared emulsion was named an emulsion IR3.

According to observation by an electron microscope, the emulsion IR3 was composed of a silver halide particle in the form of a cube having an average particle size of 0.32 μm, and had a variation coefficient of particle size of 11%. Halogen composition of each particle was measured according to an EPMA method regarding this emulsion, to find that the average silver bromide content was 83.0% and the variation coefficient of silver bromide content distribution between particles was 30%.

Sensitizing pigment (ir2)

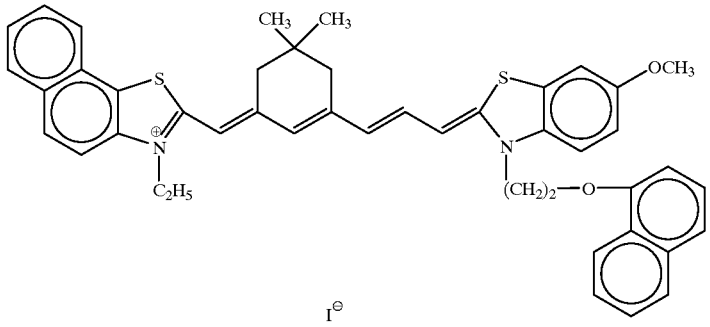

An emulsion IR4 was prepared in the same manner as for the emulsion IR3 only excepting that the amount potassium bromide was changed to 79.7 g and the-amount of sodium chloride was changed to 4.4 g contained in the alkali halide aqueous solution added in the second adding operation, the adding time was changed to 25 minutes and 30 seconds, and the adding could be continued alone for 1 minute and 30 seconds after the completion of the addition of the silver nitrate aqueous solution, in forming the particle.

According to observation by an electron microscope, the emulsion IR4 was composed of a silver halide particle in the form of a cube having an average particle size of 0.33 $\mu$m, and had a variation coefficient of particle size of 11.5%. Halogen composition of each particle was measured according to the EPMA method regarding this emulsion, to find that the average silver bromide content was 87.4% and the variation coefficient of silver bromide content distribution between particles was 15%.

A multi-layer color photosensitive material 501 was prepared shown in Tables 37 to 39 by combining the silver halide emulsions and coupler dispersed materials prepared in Examples 1 to 4.

TABLE 37

Main material constitution of photosensitive element 501

| Layer | Name of layer | Additive | Amount added (mg/m$^2$) |
|---|---|---|---|
| Seventh layer | Protective layer | Acid-processed gelatin | 442 |
| | | Reducing agent (2) | 47 |
| | | Solvent having a high boiling point (1) | 30 |
| | | Colloid silver particle | 2 |
| | | Matting agent (PMMA resin) | 17 |
| | | Surfactant (2) | 6 |
| | | Surfactant (3) | 20 |
| | | Polymer latex (a) dispersion | 10 |
| Sixth layer | Intermediate layer | Lime-processed gelatin | 862 |
| | | Anti-fogging agent | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 5 |
| | | Zinc hydroxide | 558 |
| | | Calcium nitrate | 6 |
| Fifth layer | Red sensitive layer | Lime-processed gelatin | 452 |
| | | Photosensitive silver halide emulsion R5 | 301 |
| | | Magenta dye forming coupler | 349 |

TABLE 37-continued

Main material constitution of photosensitive element 501

| Layer | Name of layer | Additive | Amount added (mg/m$^2$) |
|---|---|---|---|
| | | C-2 | |
| | | Developing agent D-5 | 304 |
| | | Developing agent (d1) | 35 |
| | | Reducing agent (2) | 15 |
| | | Solvent having a high boiling point (4) | 444 |
| | | Surfactant (1) | 12 |
| | | Water-soluble polymer (1) | 10 |
| Forth layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (1) | 4 |
| | | Calcium nitrate | 6 |
| Third layer | Second red sensitive layer | Lime-processed gelatin | 373 |
| | | photosensitive silver halide emulsion IR1 | 160 |
| | | Cyan dye forming coupler C-12 | 262 |
| | | Developing agent D-5 | 304 |
| | | Developing agent (d1) | 35 |
| | | Anti-fogging agent (2) | 14 |
| | | Solvent having a high boiling point | 412 |
| | | Surfactant (1) | 11 |
| | | Water-soluble polymer (1Y | 11 |
| Second layer | Intermediate layer | Lime-processed gelatin | 862 |
| | | Anti-fogging agent (4) | 7 |
| | | Reducing agent (1) | 57 |
| | | Solvent having a high boiling point (2) | 101 |
| | | Solvent having a high boiling point (5) | 9 |
| | | Surfactant (1) | 21 |
| | | Surfactant (4) | 21 |
| | | Water-soluble polymer (2) | 25 |
| | | Zinc hydroxide | 341 |
| | | Calcium nitrate | 6 |
| First layer | First red photosensitive layer | Lime-processed gelatin | 587 |
| | | Photosensitive silver halide emulsion IR3 | 311 |
| | | Yellow dye forming coupler C-3 | 366 |
| | | Reducing agent (22) | 157 |
| | | Reducing agent (d1) | 35 |
| | | Anti-fogging agent (2) | 15 |
| | | Solvent having a high boiling point (4) | 433 |
| | | Surfactant (1) | 12 |

TABLE 37-continued

| Main material constitution of photosensitive element 501 | | | |
|---|---|---|---|
| Layer | Name of layer | Additive | Amount added ($mg/m^2$) |
| | | Water-soluble polymer (2) | 40 |
| | | Curing agent (1) | 45 |

Substrate (a substrate obtained by depositing aluminum on PET providing a thickness of 20 $\mu$m, and further by applying a gelatin primer on the surface thereof.)

The amount coated of the silver halide was expressed in terms of the amount of silver.

Reducing agent (2)

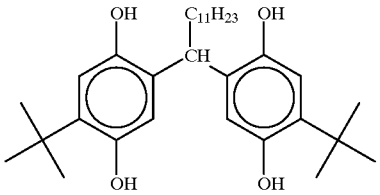

Photosensitive materials 502 to 504 were prepared by making changes as shown in the following Table 40 in the photosensitive material 501.

TABLE 40

| | | 402 | | 403 | | 404 | |
|---|---|---|---|---|---|---|---|
| Fifth layer | Silver halide emulsion | R6 | 301 | R5 | 301 | R6 | 301 |
| | Magenta dye forming coupler | C-2 | 349 | C-8 | 324 | C-8 | 324 |
| | Developing agent | D-5 | 304 | (26) | 311 | (26) | 311 |
| | Developing agent | (d1) | 35 | (d1) | 35 | (d1) | 35 |
| Third layer | Silver halide emulsion | IR2 | 160 | IR1 | 160 | IR2 | 160 |
| | Cyan dye forming coupler | C-12 | 262 | C-14 | 278 | C-14 | 278 |
| | Developing agent | D-5 | 304 | (10) | 233 | (10) | 233 |
| | Developing agent | (d1) | 35 | (d1) | 35 | (d1) | 35 |
| First layer | Silver halide emulsion | IR4 | 311 | IR3 | 311 | R14 | 311 |
| | Yellow dye forming coupler | C-3 | 366 | C-3 | 366 | C-3 | 366 |
| | Developing agent | (22) | 157 | (22) | 157 | (22) | 157 |
| | Developing agent | (d1) | 35 | (d1) | 35 | (d1) | 35 |

The photosensitive materials 501 to 504 were exposed to a light based on a digital information controlled so that a wedge formed image was obtained for sensitometry of cyan, magenta and yellow using digital color printer Fujix Pictorography PG-3000 manufacture by Fuji Photo Film Cor., Ltd, and then water in an amount corresponding to 12 ml per 1 $m^2$ (amount corresponding to about 0.60-fold of the amount of water required for the maximum swelling of the whole coated film of the photosensitive material and the pigment fixing material) was imparted between the photosensitive material and a pigment fixing material, and the photosensitive material was laminated with the pigment fixing material and the laminate was heated at 80° C. for 30 seconds, for conducting image formation. On the pigment fixing material, a brilliant color image was formed.

Then, the amount of water imparted to the photosensitive material after exposure was changed to 10 ml (amount corresponding to about 0.50-fold) and 14 ml (amount corresponding to about 0.69-fold) per 1 m , and a pigment image was formed on the pigment fixing material in the same manner.

The maximum concentration and the minimum concentration were measured by using a reflection densitometer X-lite 304 manufactured by X-like Corp.

The obtained results are shown in Tables 41 to 43. As apparent from these results, the effect of the present invention is remarkable also in this photosensitive system.

TABLE 41

| Magenta color developing part | | | | | | |
|---|---|---|---|---|---|---|
| Photosensitive material | | | 501 | 502 | 503 | 504 |
| Minimum concentration | Amount of water | 10 ml | 0.13 | 0.09 | 0.14 | 0.09 |
| | Amount of water | 12 ml | 0.11 | 0.08 | 0.11 | 0.09 |
| | Amount of water | 14 ml | 0.08 | 0.08 | 0.09 | 0.08 |
| Maximum concentration | Amount of water | 10 ml | 2.29 | 2.34 | 2.11 | 2.25 |
| | Amount of water | 12 ml | 2.22 | 2.32 | 2.03 | 2.23 |
| | Amount of water | 14 ml | 2.11 | 2.31 | 1.96 | 2.23 |
| Shoulder concentration | Amount of water | 10 ml | 2.05 | 2.10 | 1.87 | 1.99 |
| | Amount of water | 12 ml | 1.95 | 2.09 | 1.78 | 1.98 |
| | Amount of water | 14 ml | 1.75 | 2.09 | 1.66 | 1.97 |
| | Reference | | Comparative example | Example | Comparative example | Example |

TABLE 42

| Cyan color developing part | | | | | | |
|---|---|---|---|---|---|---|
| Photosensitive material | | | 501 | 502 | 503 | 504 |
| Minimum concentration | Amount of water | 10 ml | 0.11 | 0.08 | 0.13 | 0.08 |
| | Amount of water | 12 ml | 0.09 | 0.07 | 0.11 | 0.08 |
| | Amount of water | 14 ml | 0.07 | 0.07 | 0.08 | 0.07 |
| Maximum concentration | Amount of water | 10 ml | 2.26 | 2.32 | 2.08 | 2.18 |
| | Amount of water | 12 ml | 2.21 | 2.31 | 2.00 | 2.17 |
| | Amount of water | 14 ml | 2.11 | 2.30 | 1.92 | 2.15 |
| Shoulder concentration | Amount of water | 10 ml | 1.99 | 2.09 | 1.85 | 1.99 |
| | Amount of water | 12 ml | 1.91 | 2.07 | 1.76 | 1.97 |
| | Amount of water | 14 ml | 1.74 | 2.07 | 1.65 | 1.95 |
| | Reference | | Comparative example | Example | Comparative example | Example |

TABLE 43

| Photosensitive material | | | Yellow color developing part 501 | 502 | 503 | 504 |
|---|---|---|---|---|---|---|
| Minimum concentration | Amount of water | 10 ml | 0.11 | 0.08 | 0.12 | 0.09 |
| | Amount of water | 12 ml | 0.09 | 0.08 | 0.10 | 0.08 |
| | Amount of water | 14 ml | 0.07 | 0.08 | 0.08 | 0.08 |
| Maximum concentration | Amount of water | 10 ml | 2.24 | 2.33 | 2.25 | 2..34 |
| | Amount of water | 12 ml | 2.19 | 2.31 | 2.20 | 2.33 |
| | Amount of water | 14 ml | 2.10 | 2.30 | 2.11 | 2.32 |
| Shoulder concentration | Amount of water | 10 ml | 1.97 | 2.07 | 1.98 | 2.08 |
| | Amount of water | 12 ml | 1.86 | 2.05 | 1.88 | 2.07 |
| | Amount of water | 14 ml | 1.74 | 2.05 | 1.76 | 2.06 |
| | Reference | | Comparative example | Example | Comparative example | Example |

As described above, according to the silver halide photosensitive material for color photography of the present invention, there can be provided stably a color image having high quality even by treatment which is simple, quick and which has small load against environment. Further, the method for forming a color image of the present invention can realize high sensitization since a compound which is not colored before developing reaction is used as a pigment forming compound, and can form a stable ornamental image which has high image quality and is advantageous in cost.

What is claimed is:

1. A silver halide photosensitive material for color photography comprising a substrate carrying thereon a photographic constituent layer including at least one photographic photosensitive layer containing a photosensitive silver halide, wherein said photosensitive material comprises at least one silver halide emulsion in which the variation coefficient of the particle size of contained silver halide particles is 15% or less and the variation coefficient of a halogen composition between particles is 25% or less, said silver halide emulsion comprising silver chloride bromide particles of normal crystal, and further comprises a compound represented by any one of the following general formulae [I], [II] and [III], and comprises a color coupler which is capable of forming a diffusible dye by a coupling reaction with the compound represented by any one of the following formulae [I], [II] and [III]:

General formula [I]

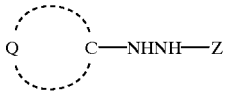

wherein, Z represents a carbamoyl group, acyl group, alkoxycarbonyl group, aryloxycarbonyl group, sulfonyl group or sulfamoyl group, and Q represents an atom group forming an unsaturated ring with C; and General formula [II]

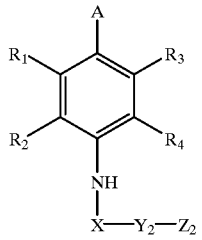

General formula [III]

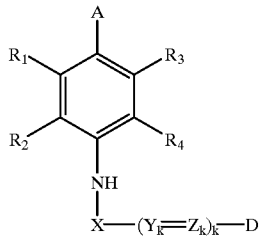

wherein, in the general formula [II], $R_1$ to $R_4$ each independently represents a hydrogen atom or a substituent, A represents a hydroxyl group or a substituted amino group, X represents a connecting group selected from —CO—, —SO—, —$SO_2$—, —(Q)PO— (Q represents a monovalent group connected to a phosphorus atom), $Y_2$ represents a bivalent connecting group, $Z_2$ represents a group that is a nucleophilic and can attack X when the present compound is oxidized, and two or more atoms optionally selected from $R_1$ and $R_2$, $R_3$ and $R_4$, and substituents thereof may be each independently connected to form a ring, and in the general formula [III], $R_1$ to $R_4$, A and X are as defined for the general formula [II], $Y_k$ and $Z_k$ represent a nitrogen atom or a group of —$CR_5$═ (herein, $R_5$ represents a hydrogen atom or substituent), k represents an integer of 0 or more, D represents a proton dissociating group or a group which can be a cation, and two or more atoms optionally selected from $R_1$ and $R_2$, $R_3$ and $R_4$, and $Y_k$, $Z_k$ and D and substituents thereof may be each independently connected to form a ring.

2. A silver halide photosensitive material for color photography according to claim 1, wherein said variation coefficient of the particle size of the particles comprising the silver halide emulsion is 12% or less.

3. A silver halide photosensitive material for color photography according to claim 1, wherein said variation coefficient of the halogen composition between the particles comprising the silver halide emulsion is 20% or less.

4. A silver halide photosensitive material for color photography according to claim 1, wherein said variation coefficient of the halogen composition between the particles comprising the silver halide emulsion is 15% or less.

5. A silver halide photosensitive material for color photography according to claim 1, wherein said photosensitive material contains in the photographic constituent layer as a yellow coupler capable of forming a diffusible dye, at least one compound represented by the following general formula [IV]:

General formula [IV]

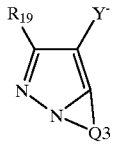

wherein, $R_{19}$ represents a hydrogen atom or a substituent, $Q_3$ represents a group of nonmetallic atoms required for forming a 5-membered azole ring containing 2 to 4 nitrogen atoms, Y represents a group which provides a coupler with resistance to diffusion and is capable of separating from the remainder of the compound by oxidative coupling reaction, and said azole ring may have a substituent (including a fused ring).

6. A color image forming method, wherein a silver halide photography photosensitive material according to claim 1 is exposed imagewise, an image receiving material separately prepared comprising a substrate carrying thereon an image receiving layer is laminated with said photosensitive material with water present between the photosensitive material and the image receiving material in an amount corresponding to 1/10 to 1-fold of that required for the maximum swelling of the entire coated film of the photosensitive material and the image receiving material, and the laminate is heated at a temperature between 60° C. to 100° C. for 5 or more-to 60 or less seconds to form an image on the image receiving material.

7. A silver halide photosensitive material for color photography according to claim 1, wherein said photosensitive material contains in the photographic constituent layer as a magenta coupler capable of forming a diffusible dye, at least one compound represented by the following general formula [IV] or general formula [V]:

General formula [IV]

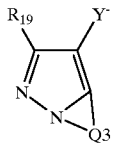

wherein, $R_{19}$ represents a hydrogen atom or a substituent, $Q_3$ represents a group of nonmetallic atoms required for forming a 5-membered azole ring containing 2 to 4 nitrogen atoms, Y represents a group which provides a coupler with resistance to diffusion and is capable of separating from the remainder of the compound by oxidative coupling reaction, and said azole ring may have a substituent (including a fused ring);

General formula [V]

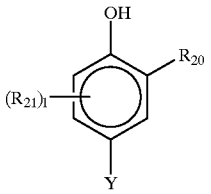

wherein, $R_{20}$ represents a hydrogen atom or a group selected from $—CONR_{22}R_{23}$, $—SO_2NR_{22}R_{23}$, $—NHCOR_{22}$, $—NHCONR_{22}R_{23}$, and $—NHSO_2NR_{22}R_{23}$, $R_{22}$ and $R_{23}$ each independently represents a hydrogen atom or a substituent, $R_{21}$ represents a substituent, l represents an integer selected from 0 to 2, Y represents a group which provides a coupler with resistance to diffusion and is capable of separating from the remainder of the compound by oxidative coupling reaction, and when l is 2, $R_{21}$ may be different.

8. A silver halide photosensitive material for color photography according to claim 7, wherein said photosensitive material contains in the photographic constituent layer as a cyan coupler capable of forming a diffusible dye, at least one compound represented by the following general formula [V], general formula [VI] or general formula [VII]

General formula [V]

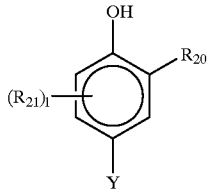

wherein, $R_{20}$ represents a hydrogen atom or a group selected from $—CONR_{22}R_{23}$, $—SO_2NR_{22}R_{23}$, $—NHCOR_{22}$, $—NHCONR_{22}R_{23}$, and $—NHSO_2NR_{22}R_{23}$, $R_{22}$ and $R_{23}$ each independently represents a hydrogen atom or a substituent, $R_{21}$ represents a substituent, l represents an integer selected from 0 to 2, Y represents a group which provides a coupler with resistance to diffusion and is capable of separating from the remainder of the compound by oxidative coupling reaction, and when l is 2, $R_{21}$ may be different;

General formula [VI]

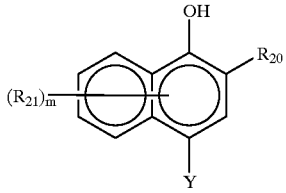

wherein, $R_{20}$ represents a hydrogen atom or a group selected from $—CONR_{22}R_{23}$, $—SO_2NR_{22}R_{23}$, $—NHCOR_{22}$, $—NHCONR_{22}R_{23}$, and $—NHSO_2NR_{22}R_{23}$, $R_{22}$ and $R_{23}$ each independently represents a hydrogen atom or a substituent, $R_{21}$ represents a substituent, m represents an integer selected from 0 to 4, Y represents a group which provides a coupler with resistance to diffusion and is capable of separating from the remainder of the compound by oxidative coupling reaction, and when m is 2 or more, $R_{21}$ may be different;

General formula [VII]

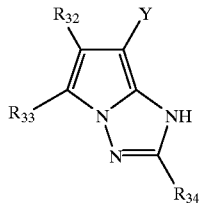

[VII-1]

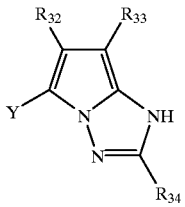

[VII-2]

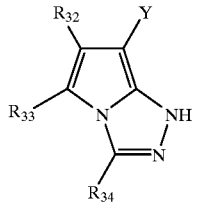

[VII-3]

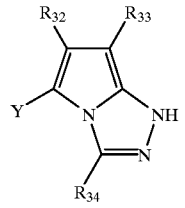

[VII-4]

the general formula [VII] being representable by the general formula [VII-1], the general formula [VII-2], the general formula [VII-3] and the general formula [VII-4], in which, $R_{32}$, $R_{33}$ and $R_{34}$ each independently represents a hydrogen atom or a substituent.

9. A silver halide photosensitive material for color photography comprising a substrate carrying thereon a photographic constituent layer including at least one photographic photosensitive layer containing a photosensitive silver halide, wherein said photosensitive material comprises at least one silver halide emulsion in which the variation coefficient of the particle size of contained silver halide particles is 15% or less and the variation coefficient of a halogen composition between particles is 25% or less, said silver halide emulsion comprising silver iodide bromide particles of normal crystal, and further comprises a compound represented by any one of the following general formulae [I], [II] and [III], and comprises a color coupler which is capable of forming a diffusible dye by a coupling reaction with the compound represented by any one of the following formulae [I], [II] and [III]:

General formula [I]

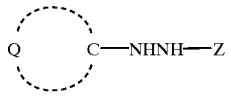

wherein, Z represents a carbamoyl group, acyl group, alkoxycarbonyl group, aryloxycarbonyl group, sulfonyl group or sulfamoyl group, and Q represents an atom group forming an unsaturated ring with C; and General formula [II]

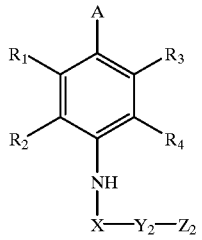

General formula [III]

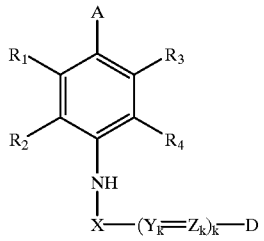

wherein, in the general formula [II], $R_1$ to $R_4$ each independently represents a hydrogen atom or a substituent, A represents a hydroxyl group or a substituted amino group, X represents a connecting group selected from —CO—, —SO—, —$SO_2$—, —(Q)PO— (Q represents a monovalent group connected to a phosphorus atom), $Y_2$ represents a bivalent connecting group, $Z_2$ represents a group that is a nucleophilic and can attack X when the present compound is oxidized, and two or more atoms optionally selected from $R_1$ and $R_2$, $R_3$ and $R_4$, and substituents thereof may be each independently connected to form a ring, and in the general formula [III], $R_1$ to $R_4$, A and X are as defined for the general formula [II], $Y_k$ and $Z_k$ represent a nitrogen atom or a group of —$CR_5$= (herein, $R_5$ represents a hydrogen atom or substituent), k represents an integer of 0 or more, D represents a proton dissociating group or a group which can be a cation, and two or more atoms optionally selected from $R_1$ and $R_2$, $R_3$ and $R_4$, and $Y_k$, $Z_k$ and D and substituents thereof may be each independently connected to form a ring.

10. A silver halide photosensitive material for color photography according to claim 9, wherein said variation coefficient of the particle size of the particles comprising the silver halide emulsion is 12% or less.

11. A silver halide photosensitive material for color photography according to claim 9, wherein said variation coefficient of the halogen composition between the particles comprising the silver halide emulsion is 20% or less.

12. A silver halide photosensitive material for color photography according to claim 9, wherein said variation coefficient of the halogen composition between the particles comprising the silver halide emulsion is 15% or less.

13. A silver halide photosensitive material for color photography according to claim 9, wherein said photosensitive material contains in the photographic constituent layer as a yellow coupler capable of forming a diffusible dye, at least one compound represented by the following general formula [IV]:

General formula [IV]

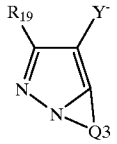

wherein, $R_{19}$ represents a hydrogen atom or a substituent, $Q_3$ represents a group of nonmetallic atoms required for forming a 5-membered azole ring containing 2 to 4 nitrogen atoms, Y represents a group which provides a coupler with resistance to diffusion and is capable of separating from the reminder of the compound by oxidative coupling reaction, and said azole ring may have a substituent (including a fused ring).

14. A color image forming method, wherein a silver halide photography photosensitive material according to claim 9 is exposed imagewise, an image receiving material separately prepared comprising a substrate carrying thereon an image receiving layer is laminated with said photosensitive material with water present between the photosensitive material and the image receiving material in an amount corresponding to 1/10 to 1-fold of that required for the maximum swelling of the entire coated film of the photosensitive material and the image receiving material, and the laminate is heated at a temperature between 60° C. to 100° C. for 5 or more to 60 or less seconds to form an image on the image receiving material.

15. A silver halide photosensitive material for color photography according to claim 9, wherein said photosensitive material contains in the photographic constituent layer as a magenta coupler capable of forming a diffusible dye, at least one compound represented by the following general formula [IV] or general formula [V]:

General formula [IV]

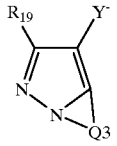

wherein, $R_{19}$ represents a hydrogen atom or a substituent, $Q_3$ represents a group of nonmetallic atoms required for forming a 5-membered azole ring containing 2 to 4 nitrogen atoms, Y represents a group which provides a coupler with resistance to diffusion and is capable of separating from the remainder of the compound by oxidative coupling reaction, and said azole ring may have a substituent (including a fused ring);

General formula [V]

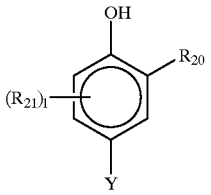

wherein, $R_{20}$ represents a hydrogen atom or a group selected from $—CONR_{22}R_{23}$, $—SO_2NR_{22}R_{23}$, $—NHCOR_{22}$, $—NHCONR_{22}R_{23}$, and $—NHSO_2NR_{22}R_{23}$, $R_{22}$ and $R_{23}$ each independently represents a hydrogen atom or a substituent, $R_{21}$ represents a substituent, l represents an integer selected from 0 to 2, Y represents a group which provides a coupler with resistance to diffusion and is capable of separating from the remainder of the compound by oxidative coupling reaction, and when l is 2, $R_{21}$ may be different.

16. A silver halide photosensitive material for color photography according to claim 15, wherein said photosensitive material contains in the photographic constituent layer as a cyan coupler capable of forming a diffusible dye, at least one compound represented by the following general formula [V], general formula [VI] or general formula [VII]:

General formula [V]

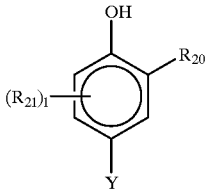

wherein, $R_{20}$ represents a hydrogen atom or a group selected from $—CONR_{22}R_{23}$, $—SO_2NR_{22}R_{23}$, $—NHCOR_{22}$, $—NHCONR_{22}R_{23}$, and $—NHSO_2NR_{22}R_{23}$, $R_{22}$ and $R_{23}$ each independently represents a hydrogen atom or a substituent, $R_{21}$ represents a substituent, l represents an integer selected from 0 to 2, Y represents a group which provides a coupler with resistance to diffusion and is capable of separating from the remainder of the compound by oxidative coupling reaction, and when l is 2, $R_{21}$ may be different;

wherein, $R_{20}$ represents a hydrogen atom or a group selected from $—CONR_{22}R_{23}$, General formula [VI]

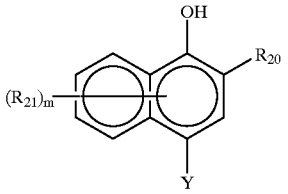

—$SO_2NR_{22}R_{23}$, —$NHCOR_{22}$, —$NHCONR_{22}R_{23}$, and —$NHSO_2NR_{22}R_{23}$, $R_{22}$ and $R_{23}$ each independently represents a hydrogen atom or a substituent, $R_{21}$ represents a substituent, m represents an integer selected from 0 to 4, Y represents a group which provides a coupler with resistance to diffusion and is capable of separating from the remainder of the compound by oxidative coupling reaction, and when m is 2 or more, $R_{21}$ may be different;

General formula [VII]

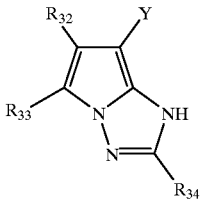

[VII-1]

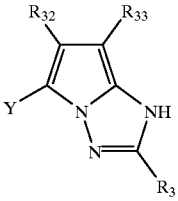

[VII-2]

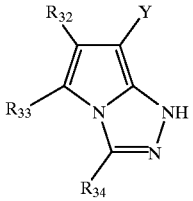

[VII-3]

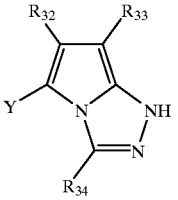

[VII-4]

the general formula [VII] being representable by the general formula [VII-1], the general formula [VII-2], the general formula [VII-3] and the general formula [VII-4], in which, $R_{32}$, $R_{33}$ and $R_{34}$ each independently represents a hydrogen atom or a substituent.

17. A silver halide photosensitive material for color photography comprising a substrate carrying thereon a photographic constituent layer including at least one photographic photosensitive layer containing a photosensitive silver halide, wherein said photosensitive material comprises at least one silver halide emulsion in which the variation coefficient of the particle size of contained silver halide particles is 15% or less and the variation coefficient of a halogen composition between particles is 25% or less, said silver halide emulsion comprising silver chloride iodide bromide particles of normal crystal, and further comprises a compound represented by any one of the following general formulae [I], [II] and [III], and comprises a color coupler which is capable of forming a diffusible dye by a coupling reaction with the compound represented by any one of the following formulae [I], [II] and [III]:

General formula [I]

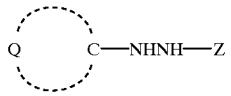

wherein, Z represents a carbamoyl group, acyl group, alkoxycarbonyl group, aryloxycarbonyl group, sulfonyl group or sulfamoyl group, and Q represents an atom group forming an unsaturated ring with C; and General formula [II]

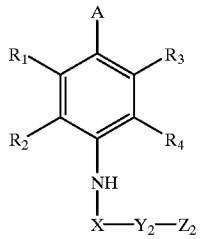

General formula [III]

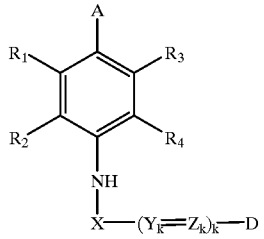

wherein, in the general formula [II], $R_1$ to $R_4$ each independently represents a hydrogen atom or a substituent, A represents a hydroxyl group or a substituted amino group, X represents a connecting group selected from —CO—, —SO—, —$SO_2$—, —(Q)PO— (Q represents a monovalent group connected to a phosphorus atom), $Y_2$ represents a bivalent connecting group, $Z_2$ represents a group that is a nucleophilic and can attack X when the present compound is oxidized, and two or more atoms optionally selected from $R_1$ and $R_2$, $R_3$ and $R_4$, and substituents thereof may be each independently connected to form a ring, and in the general formula [III], $R_1$ to $R_4$, A and X are as defined for the general formula [II], $Y_k$ and $Z_k$ represent a nitrogen atom or a group of —$CR_5$= (herein, $R_5$ represents a hydrogen atom or substituent), k represents an integer of 0 or more, D represents a proton dissociating group or a group which can be a cation, and two or more atoms optionally selected from $R_1$ and $R_2$, $R_3$ and $R_4$, and $Y_k$, $Z_k$ and D and substituents thereof may be each independently connected to form a ring.

18. A silver halide photosensitive material for color photography according to claim 17, wherein said variation coefficient of the particle size of the particles comprising the silver halide emulsion is 12% or less.

19. A silver halide photosensitive material for color photography according to claim 17, wherein said variation coefficient of the halogen composition between the particles comprising the silver halide emulsion is 20% or less.

20. A silver halide photosensitive material for color photography according to claim 17, wherein said variation coefficient of the halogen composition between the particles comprising the silver halide emulsion is 15% or less.

21. A silver halide photosensitive material for color photography according to claim 17, wherein said photosensitive material contains in the photographic constituent layer as a yellow coupler capable of forming a diffusible dye, at least one compound represented by the following general formula [IV]:

General formula [IV]

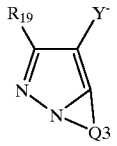

wherein, $R_{19}$ represents a hydrogen atom or a substituent, $Q_3$ represents a group of nonmetallic atoms required for forming a 5-membered azole ring containing 2 to 4 nitrogen atoms, Y represents a group which provides a coupler with resistance to diffusion and is capable of separating from the reminder of the compound by oxidative coupling reaction, and said azole ring may have a substituent (including a fused ring).

22. A color image forming method, wherein a silver halide photography photosensitive material according to claim 17 is exposed imagewise, an image receiving material separately prepared comprising a substrate carrying thereon an image receiving layer is laminated with said photosensitive material with water present between the photosensitive material and the image receiving material in an amount corresponding to 1/10 to 1-fold of that required for the maximum swelling of the entire coated film of the photosensitive material and the image receiving material, and the laminate is heated at a temperature between 60° C. to 100° C. for 5 or more to 60 or less seconds to form an image on the image receiving material.

23. A silver halide photosensitive material for color photography according to claim 17, wherein said photosensitive material contains in the photographic constituent layer as a magenta coupler capable of forming a diffusible dye, at least one compound represented by the following general formula [IV] or general formula [V]:

General formula [IV]

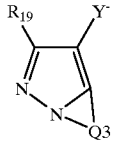

wherein, $R_{19}$ represents a hydrogen atom or a substituent, $Q_3$ represents a group of nonmetallic atoms required for forming a 5-membered azole ring containing 2 to 4 nitrogen atoms, Y represents a group which provides a coupler with resistance to diffusion and is capable of separating from the remainder of the compound by oxidative coupling reaction, and said azole ring may have a substituent (including a fused ring);

General formula [V]

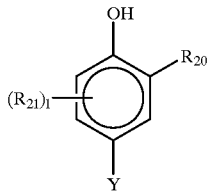

wherein, $R_{20}$ represents a hydrogen atom or a group selected from $—CONR_{22}R_{23}$, $—SO_2NR_{22}R_{23}$, $—NHCOR_{22}$, $—NHCONR_{22}R_{23}$, and $—NHSO_2NR_{22}R_{23}$, $R_{22}$ and $R_{23}$ each independently represents a hydrogen atom or a substituent, $R_{21}$ represents a substituent, l represents an integer selected from 0 to 2, Y represents a group which provides a coupler with resistance to diffusion and is capable of separating from the remainder of the compound by oxidative coupling reaction, and when l is 2, $R_{21}$ may be different.

24. A silver halide photosensitive material for color photography according to claim 23, wherein said photosensitive material contains in the photographic constituent layer as a cyan coupler capable of forming a diffusible dye, at least one compound represented by the following general formula [V], general formula [VI] or general formula [VII]:

General formula [V]

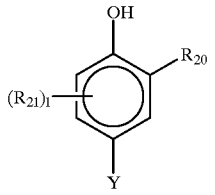

wherein, $R_{20}$ represents a hydrogen atom or a group selected from $—CONR_{22}R_{23}$, $—SO_2NR_{22}R_{23}$, $—NHCOR_{22}$, $—NHCONR_{22}R_{23}$, and $—NHSO_2NR_{22}R_{23}$, $R_{22}$ and $R_{23}$ each independently represents a hydrogen atom or a substituent, $R_{21}$ represents a substituent, l represents an integer selected from 0 to 2, Y represents a group which provides a coupler with resistance to diffusion and is capable of separating from the remainder of the compound by oxidative coupling reaction, and when l is 2, $R_{21}$ may be different;

General formula [VI]

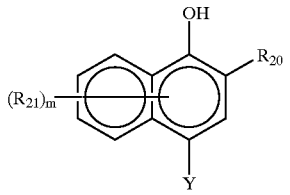

wherein, $R_{20}$ represents a hydrogen atom or a group selected from $—CONR_{22}R_{23}$, $—SO_2NR_{22}R_{23}$, $—NHCOR_2$, $—NHCONR_{22}R_{23}$, and $—NHSO_2NR_{22}R_{23}$, $R_{22}$ and $R_{23}$ each independently represents a hydrogen atom or a substituent, $R_{21}$ represents a substituent, m represents an integer selected from 0 to 4, Y represents a group which provides a coupler with resistance to diffusion and is capable of separating from the remainder of the compound by oxidative coupling reaction, and when m is 2 or more, $R_{21}$ may be different;

General formula [VII]

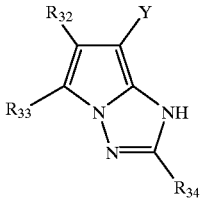

[VII-1]

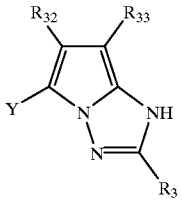

[VII-2]

-continued

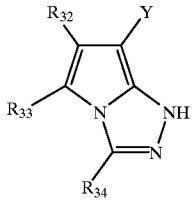

[VII-3]

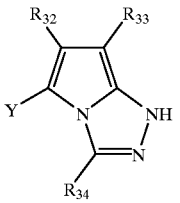

[VII-4]

the general formula [VII] being representable by the general formula [VII-1], the general formula [VII-2], the general formula [VII-3] and the general formula [VII-4], in which, $R_{32}$, $R_{33}$ and $R_{34}$ each independently represents a hydrogen atom or a substituent.

* * * * *